US009549244B2

(12) United States Patent
Shigenaga et al.

(10) Patent No.: US 9,549,244 B2
(45) Date of Patent: Jan. 17, 2017

(54) DIRECTIVITY CONTROL SYSTEM, DIRECTIVITY CONTROL METHOD, SOUND COLLECTION SYSTEM AND SOUND COLLECTION CONTROL METHOD

(71) Applicant: PANASONIC INTELLECTUAL PROPERTY MANAGEMENT CO., LTD., Osaka (JP)

(72) Inventors: Shinichi Shigenaga, Fukuoka (JP); Kazunori Hayashi, Fukuoka (JP); Toshimichi Tokuda, Fukuoka (JP); Hirotaka Sawa, Fukuoka (JP); Kosuke Shinozaki, Fukuoka (JP); Shuichi Watanabe, Fukuoka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 126 days.

(21) Appl. No.: 14/333,821

(22) Filed: Jul. 17, 2014

(65) Prior Publication Data

US 2015/0023524 A1 Jan. 22, 2015

(30) Foreign Application Priority Data

Jul. 19, 2013 (JP) ..... 2013-151012
Sep. 12, 2013 (JP) ..... 2013-189379
Jun. 30, 2014 (JP) ..... 2014-135117

(51) Int. Cl.
*H04R 1/32* (2006.01)
*H04R 3/00* (2006.01)
*H04R 1/40* (2006.01)

(52) U.S. Cl.
CPC ..... *H04R 1/32* (2013.01); *H04R 1/326* (2013.01); *H04R 3/005* (2013.01); *H04R 1/406* (2013.01);

(Continued)

(58) Field of Classification Search
CPC ..... H04R 1/326; H04R 1/32; H04R 2420/01; H04R 1/406; H04R 3/005; H04R 2430/23; H04R 2460/07

(Continued)

(56) References Cited

U.S. PATENT DOCUMENTS 8,411,165 B2 4/2013 Ozawa
2001/0024233 A1* 9/2001 Urisaka ..... H04N 5/232 348/211.6

(Continued)

FOREIGN PATENT DOCUMENTS

JP 2005-124090 A 5/2006
JP 2008-193196 A 8/2008

(Continued)

OTHER PUBLICATIONS

Extended European Search Report dated Sep. 23, 2015, for corresponding EP Application No. 14177551.0-1901 / 2827610, 24 pages.

(Continued)

*Primary Examiner* — David Ton
(74) *Attorney, Agent, or Firm* — Seed IP Law Group LLP

(57) ABSTRACT

A directivity control system includes: a sound collection unit, configured to collect a sound; a display unit, configured to display a designation screen used to designate a directivity direction oriented from the sound collection unit to a first sound position; a directivity direction calculation unit, configured to calculate a horizontal angle and a vertical angle from the sound collection unit to the first sound position corresponding to the designated directivity direction in accordance with a designation of the directivity direction on the designation screen displayed by the display unit; and a control unit, configured to form directivity of the sound collected by the sound collection unit based on the horizon- (Continued)

tal angle and the vertical angle calculated by the directivity direction calculation unit.

13 Claims, 36 Drawing Sheets

(52) U.S. Cl.
CPC ..... *H04R 2420/01* (2013.01); *H04R 2430/23* (2013.01); *H04R 2460/07* (2013.01)

(58) Field of Classification Search
USPC ..... 381/92; 348/345–347, 211.6, 211.13, 348/E5.042, E5.045, E5.063, E7.086
See application file for complete search history.

(56) References Cited

U.S. PATENT DOCUMENTS

| | | | | |
|---|---|---|---|---|
| 2005/0140810 | A1 | 6/2005 | Ozawa | |
| 2010/0254543 | A1 | 10/2010 | Kjolerbakken | |
| 2012/0155703 | A1* | 6/2012 | Hernandez-Abrego ..... | H04R 3/005 382/103 |

FOREIGN PATENT DOCUMENTS

| | | | |
|---|---|---|---|
| JP | 2010-145524 | A | 7/2010 |
| JP | 2011-041096 | A | 2/2011 |
| JP | 2012-186551 | A | 9/2012 |

OTHER PUBLICATIONS

Partial European Search Report dated Apr. 13, 2015, for corresponding EP Application No. 14177551.0-1901 / 2827610, 10 pages.

* cited by examiner

FIG. 14A

| PRESET POSITION | SOUND COLLECTION AREA | DIRECTIVITY DIRECTION (PRESET VALUE) |
|---|---|---|
| P1 | REGISTER 1 | $(\theta_{hp1}, \theta_{vp1})$ |
| P2 | REGISTER 2 | $(\theta_{hp2}, \theta_{vp2})$ |
| P3-1 | MAGAZINE RACK | $(\theta_{hp31}, \theta_{vp31})$ |
| P3-2 | MAGAZINE RACK | $(\theta_{hp32}, \theta_{vp32})$ |
| ⋮ | ⋮ | ⋮ |

FIG. 14B

| PRESET POSITION | SOUND COLLECTION AREA | PRESET VALUE (HORIZONTAL DISTANCE, HORIZONTAL ANGLE) |
|---|---|---|
| P1 | REGISTER 1 | $(L_{P1}, \theta_{P1})$ |
| P2 | REGISTER 2 | $(L_{P2}, \theta_{P2})$ |
| P3-1 | MAGAZINE RACK | $(L_{P31}, \theta_{P31})$ |
| P3-2 | MAGAZINE RACK | $(L_{P32}, \theta_{P32})$ |
| ⋮ | ⋮ | ⋮ |

FIG. 14C

| PRESET POSITION | SOUND COLLEC-TION AREA | PRESET VALUE (FIRST HORIZONTAL DISTANCE, SECOND HORIZONTAL DISTANCE) |
|---|---|---|
| P1 | REGISTER 1 | $(L_{Px1}, L_{Py1})$ |
| P2 | REGISTER 2 | $(L_{Px2}, L_{Py2})$ |
| P3-1 | MAGAZINE RACK | $(L_{Px31}, L_{Py31})$ |
| P3-2 | MAGAZINE RACK | $(L_{Px32}, L_{Py32})$ |
| ⋮ | ⋮ | ⋮ |

FIG. 14D

| PRESET POSITION | SOUND COLLEC-TION AREA | DIRECTIVITY DIRECTION (PRESET VALUE) |
|---|---|---|
| P1-1, P1-2 | REGISTER 1 | $(\theta_{hp11}, \theta_{vp11}), (\theta_{hp12}, \theta_{vp12})$ |
| P2 | REGISTER 2 | $(\theta_{hp2}, \theta_{vp2})$ |
| P3-1 | MAGAZINE RACK | $(\theta_{hp31}, \theta_{vp31})$ |
| P3-2 | MAGAZINE RACK | $(\theta_{hp32}, \theta_{vp32})$ |
| ⋮ | ⋮ | ⋮ |

| PRESET POSITION | SOUND COLLECTION AREA | DIRECTIVITY DIRECTION (PRESET VALUE) | INVOLVED CAMERA APPARATUS |
|---|---|---|---|
| P1 | REGISTER 1 | $(\theta_{h11}, \theta_{v1})$ | CAMERA APPARATUS C11 |
| P2 | REGISTER 2 | $(\theta_{h12}, \theta_{v2})$ | CAMERA APPARATUS C11 |
| P3-1 | MAGAZINE RACK | $(\theta_{h31}, \theta_{v31})$ | CAMERA APPARATUS C12 |
| P3-2 | MAGAZINE RACK | $(\theta_{h32}, \theta_{v32})$ | CAMERA APPARATUS C12 |
| ⋮ | ⋮ | ⋮ | ⋮ |

| PRESET POSITION | SOUND COLLECTION AREA | PRESET VALUE | | INVOLVED CAMERA APPARATUS |
|---|---|---|---|---|
| | | DIRECTIVITY DIRECTION | DIRECTIVITY CONTROL PARAMETER | |
| P1 | REGISTER 1 | $(\theta_{h1}, \theta_{v1})$ | $(P_{11}, \ldots, P_{1m})$ | C11 |
| P2 | REGISTER 2 | $(\theta_{h2}, \theta_{v2})$ | $(P_{11}, \ldots, P_{1m})$ | C12 |
| P3 | MAGAZINE RACK | $(\theta_{h3}, \theta_{v3})$ | $(P_{11}, \ldots, P_{1m})$ | C13 |
| ⋮ | ⋮ | ⋮ | ⋮ | ⋮ |
| Pn | DRINK RACK | $(\theta_{hn}, \theta_{vn})$ | $(P_{11}, \ldots, P_{1m})$ | C1n |

| PRESET POSITION | SOUND COLLECTION AREA | PRESET VALUE (DIRECTIVITY DIRECTION) |
|---|---|---|
| P1 | REGISTER 1 | ($\theta_{hp1}$, $\theta_{vp1}$) |
| P2 | REGISTER 2 | ($\theta_{hp2}$, $\theta_{vp2}$) |
| P3 | MAGAZINE RACK | ($\theta_{hp3}$, $\theta_{vp3}$) |
| . . . | . . . | . . . |
| Pn | DRINK RACK | ($\theta_{hpn}$, $\theta_{vpn}$) |

| SOUND COLLECTION AREA | PRESET VALUE | |
|---|---|---|
| | DIRECTIVITY DIRECTION | IDENTIFICATION NUMBER OF MONITORING CAMERA APPARATUS |
| REGISTER 1 | ( $\theta_{hp1}$, $\theta_{vp1}$ ) | CM11 |
| REGISTER 2 | ( $\theta_{hp2}$, $\theta_{vp2}$ ) | CM12 |
| MAGAZINE RACK | ( $\theta_{hp3}$, $\theta_{vp3}$ ) | CM13 |
| ⋮ | ⋮ | ⋮ |
| DRINK RACK | ( $\theta_{hpn}$, $\theta_{vpn}$ ) | CMIn |

DIRECTIVITY CONTROL SYSTEM, DIRECTIVITY CONTROL METHOD, SOUND COLLECTION SYSTEM AND SOUND COLLECTION CONTROL METHOD

BACKGROUND

1. Field of the Invention

The present invention relates to a directivity control system, a directivity control method, a sound collection system and a sound collection control method of forming directivity of a sound in a directivity direction oriented from a microphone array apparatus to a prearranged sound position.

2. Description of the Related Art

In the past, in monitoring systems installed at predetermined positions (for example, ceilings) of factories or stores (for example, retail stores or banks) or public places (for example, libraries), wide angles of view of video data (including still images and moving images, and the same applies hereinafter) of predetermined ranges of monitoring targets have been contrived by connecting a plurality of camera apparatuses (for example, pan-tilt camera apparatuses or omnidirectional camera apparatuses) via networks.

Since the amount of information obtained from monitoring of only videos are restricted anyhow, there have been high demands for monitoring systems obtaining sound data in directions (hereinafter, referred to as "imaging directions") in which specific subjects are imaged by camera apparatuses by disposing not only the camera apparatus but also microphone array apparatuses.

Here, a control apparatus is known which obtains sound data of a subject present in an imaging direction of a camera apparatus by controlling operations of the camera apparatus and a microphone array apparatus (for example, see JP-A-2012-186551). The control apparatus disclosed in JP-A-2012-186551 is installed in a conference room in which, for example, a TV conference system can be used and controls the operations of the camera apparatus which can be operated in a horizontal direction (pan direction) and the microphone array apparatus which can change a sound collection range.

The control apparatus disclosed in JP-A-2012-186551 changes the sound collection range of the microphone array apparatus based on a distance between the position of the camera apparatus and the position of a subject pictured in an image obtained by the camera apparatus, a pan direction of the camera apparatus, a distance between the position of the camera apparatus and the position of the microphone array apparatus, and a direction of the position of the microphone array apparatus with reference to the position of the camera apparatus.

SUMMARY

In JP-A-2012-186551, for example, a usage in the television conference system is supposed and it is assumed that the camera apparatus, the microphone array apparatus, and a subject (for example, a speaking person) are present on the same plane. In the above-described monitoring system, however, cases in which the camera apparatus, the microphone array apparatus, and all of the subjects (for example, shop assistants or guests in a store) are actually present on the same plane are infrequent.

For example, since the camera apparatus and the microphone array apparatus are installed on an upward side (for example, a ceiling surface of a store) from a subject in many cases, the camera apparatus, the microphone array apparatus, and the subject are not present on planar two-dimensional coordinates, but rather are present on stereoscopic three-dimensional coordinates in many cases.

Accordingly, when the microphone array apparatus collects a sound of dialog of a subject in a video captured by the camera apparatus in the above-described monitoring system, there is a problem that it is difficult to directly use coordinates (a horizontal angle and a vertical angle) calculated according to the method of JP-A-2012-186551 and indicating a direction in which the microphone array apparatus collects a sound.

According to a place (for example, a store) in which the monitoring system is introduced, it is desirable to determine a directivity direction in advance to collect a sound at a position at which the microphone array apparatus is preset, for example, even in a case in which no camera apparatus is installed in the monitoring system, when a prearranged sound position (hereinafter referred to as a "preset position") at which a sound is desired to be acquired in the store is determined.

A non-limited object of the present invention is to provide a directivity control system and a directivity control method outputting a clear sound of an object present in a direction oriented from a microphone array apparatus to a preset position by calculating a directivity direction oriented from the microphone array apparatus to the preset position and forming directivity in the calculated directivity direction.

A first aspect of the present invention provides a directivity control system including: a sound collection unit, configured to collect a sound; a display unit, configured to display a designation screen used to designate a directivity direction oriented from the sound collection unit to a first sound position; a directivity direction calculation unit, configured to calculate a horizontal angle and a vertical angle from the sound collection unit to the first sound position corresponding to the designated directivity direction in accordance with a designation of the directivity direction on the designation screen displayed by the display unit; and a control unit, configured to form directivity of the sound collected by the sound collection unit based on the horizontal angle and the vertical angle calculated by the directivity direction calculation unit.

A second aspect of the present invention provides a directivity control system including: a sound collection unit, configured to collect a sound; a display unit, configured to display a setting screen of a directivity direction oriented from the sound collection unit to a prearranged second sound position in one or more sound collection areas or a designation screen of a directivity direction oriented from the sound collection unit to a third arbitrary sound position in the one or more sound collection areas; a directivity direction calculation unit, configured to calculate a horizontal angle and a vertical angle from the sound collection unit to the prearranged second sound position corresponding to the directivity direction as set in accordance with a set value of the directivity direction on the setting screen displayed by the display unit; a storage unit, configured to store the horizontal angle and the vertical angle calculated for each of the prearranged second sound positions in the sound collection areas in association with each of the prearranged second sound positions in the sound collection areas; and a control unit, configured to form directivity of the sound collected by the sound collection unit based on the horizontal angle and the vertical angle calculated by the directivity direction calculation unit, wherein the directivity direction calculation unit calculates the horizontal angle and the vertical angle of the directivity direction oriented to the third arbitrary sound position as designated in accordance with designation of the directivity direction oriented to the third arbitrary sound position of the one more sound collection areas on the designation screen displayed by the display unit, based on the horizontal angle and the vertical angle corresponding to the prearranged second sound position in the sound collection area stored in the storage unit.

A third aspect of the present invention provides a directivity control system including: a sound collection unit, configured to collect a sound; a display unit, configured to display a setting screen of a directivity direction oriented from the sound collection unit to a prearranged second sound position in one or more sound collection areas or a designation screen of a directivity direction oriented from the sound collection unit to a third arbitrary sound position in the one or more sound collection areas; a storage unit, configured to store a set value of the one or more directivity directions on the setting screen displayed by the display unit in association with the prearranged second sound position in the sound collection area; a directivity direction calculation unit, configured to calculate a horizontal angle and a vertical angle up to the prearranged second sound position corresponding to the directivity direction based on the set value of the directivity direction stored in the storage unit; and a control unit, configured to form directivity of the sound collected by the sound collection unit based on the horizontal angle and the vertical angle calculated by the directivity direction calculation unit, wherein the set value of the directivity direction indicates a horizontal distance and a horizontal angle or a first horizontal distance and a second horizontal distance from the sound collection unit to the prearranged second sound position, and the directivity direction calculation unit calculates the horizontal angle and the vertical angle of the directivity direction oriented to the third arbitrary sound position as designated in accordance with designation of the directivity direction oriented to the third arbitrary sound position of the one or more sound collection areas on the designation screen displayed by the display unit, based on the set value of the horizontal angle and the vertical angle corresponding to the prearranged second sound position in the sound collection area stored in the storage unit.

A fourth aspect of the present invention provides a directivity control method in a directivity control system including a sound collection unit that collects a sound, the directivity control method including: displaying a designation screen used to designate a directivity direction oriented from the sound collection unit to a first sound position; calculating a horizontal angle and a vertical angle from the sound collection unit to the first sound position corresponding to the directivity direction as designated in accordance with designation of the directivity direction on the displayed designation screen; and forming directivity of the sound collected by the sound collection unit based on the calculated horizontal angle and the calculated vertical angle.

A fifth aspect of the present invention provides a directivity control method in a directivity control system including a sound collection unit that collects a sound, the directivity control method including: displaying a setting screen of a directivity direction oriented from the sound collection unit to a prearranged second sound position in one or more sound collection areas; calculating a horizontal angle and a vertical angle from the sound collection unit to the prearranged second sound position corresponding to the directivity direction as set in accordance with a set value of the directivity direction on the displayed setting screen; storing the horizontal angle and the vertical angle calculated for each of the prearranged second sound positions in the sound collection areas in association with each of the prearranged second sound positions in the sound collection areas; displaying a designation screen of the directivity direction oriented from the sound collection unit to the third arbitrary sound position on the one or more sound collection areas; calculating the horizontal angle and the vertical angle of the directivity direction oriented to the third arbitrary sound position as designated in accordance with designation of the directivity direction oriented to the third arbitrary sound position of the one more sound collection areas on the displayed designation screen, based on the stored directivity direction of each of the prearranged second sound positions in the sound collection areas; and forming directivity of the sound collected by the sound collection unit based on the calculated horizontal angle and the calculated vertical angle.

A sixth aspect of the present invention provides a directivity control method in a directivity control system including a sound collection unit that collects a sound, the directivity control method including: displaying a setting screen of a directivity direction oriented from the sound collection unit to a prearranged second sound position in one or more sound collection areas; storing a set value of the directivity direction on the displayed setting screen in association with the prearranged second sound position in the sound collection area; calculating a horizontal angle and a vertical angle up to the prearranged second sound position corresponding to the directivity direction based on the stored set value of the directivity direction; displaying a designation screen of the directivity direction oriented from the sound collection unit to the third arbitrary sound position on the one or more sound collection areas; and calculating the horizontal angle and the vertical angle of the directivity direction oriented to the third arbitrary sound position as designated in accordance with designation of the directivity direction oriented to the third arbitrary sound position of the one more sound collection areas on the displayed designation screen, based on the stored set value of the directivity direction of each of the prearranged second sound positions in the sound collection areas, wherein the set value of the directivity direction indicates a horizontal distance and a horizontal angle or a first horizontal distance and a second horizontal distance from the sound collection unit to the prearranged second sound position.

A seventh aspect of the present invention provides a sound collection system including: a sound collection unit, configured to collect a sound; a first camera apparatus that has a same reference coordinate system as the sound collection unit; a display unit, configured to display a designation screen used to designate a position corresponding to one or more prearranged fourth sound positions from a captured image of the first camera apparatus; a directivity direction calculation unit, configured to calculate a horizontal angle and a vertical angle from the sound collection unit to the prearranged fourth sound position in accordance with designation of the position corresponding to the prearranged fourth sound position on the designation screen; a storage unit, configured to store the horizontal angle and the vertical angle acquired for each of the prearranged fourth sound positions in association with the prearranged fourth sound position; and a directivity control unit, configured to form directivity of the sound collected by the sound collection unit based on the horizontal angle and the vertical angle stored for each of the prearranged fourth sound positions.

An eighth aspect of the present invention provides a sound collection system including: a sound collection unit, configured to collect a sound; a first camera apparatus that has a same reference coordinate system as the sound collection unit; one or more second camera apparatuses, configured to image predetermined different sound collection areas; a display unit, configured to display a designation screen used to designate a position corresponding to one or more prearranged fifth sound positions from a captured image of the first camera apparatus corresponding to any one selected from the second camera apparatuses; a directivity direction calculation unit, configured to calculate a horizontal angle and a vertical angle from the sound collection unit to the prearranged fifth sound position in accordance with designation of the position corresponding to the prearranged fifth sound position on the designation screen; a storage unit, configured to store the horizontal angle and the vertical angle acquired for each of the prearranged fifth sound positions, in association with the prearranged fifth sound position; and a directivity control unit, configured to form directivity of the sound collected by the sound collection unit based on the horizontal angle and the vertical angle stored for each of the prearranged fifth sound positions.

A ninth aspect of the present invention provides a sound collection control method in a sound collection system including a sound collection unit that collects a sound, the sound collection control method including: displaying a captured image captured by a first camera apparatus having a same reference coordinate system as the sound collection unit; displaying a designation screen used to designate a position corresponding to one or more prearranged fourth sound positions from the captured image of the first camera apparatus; calculating a horizontal angle and a vertical angle from the sound collection unit to the prearranged fourth sound position in accordance with designation of the position corresponding to the prearranged fourth sound position on the designation screen; storing the horizontal angle and the vertical angle acquired for each of the prearranged fourth sound positions in association with the prearranged fourth sound position in a storage unit; and forming directivity of the sound collected by the sound collection unit based on the horizontal angle and the vertical angle stored for each of the prearranged fourth sound positions in the storage unit.

A tenth aspect of the present invention provides a sound collection control method in a sound collection system including a sound collection unit that collects a sound, the sound collection control method including: displaying a captured image captured by a first camera apparatus having a same reference coordinate system as the sound collection unit; receiving a selection of one or more second camera apparatuses that image different predetermined sound collection areas; displaying a designation screen used to designate a position corresponding to one or more prearranged fifth sound positions from a captured image of the first camera apparatus corresponding to a captured image of any one selected from the second camera apparatuses; calculating a horizontal angle and a vertical angle from the sound collection unit to the prearranged fifth sound position in accordance with designation of the position corresponding to the prearranged fifth sound position on the designation screen; storing the horizontal angle and the vertical angle acquired for each of the prearranged fifth sound positions in association with the prearranged fifth sound position in a storage unit; and forming directivity of the sound collected by the sound collection unit based on the horizontal angle and the vertical angle stored for each of the prearranged fifth sound positions in the storage unit.

According to non-limited aspects of the present invention, it is possible to output a clear sound of an object present in a direction oriented from a microphone array apparatus to a preset position by calculating a directivity direction oriented from the microphone array apparatus to the preset position and forming directivity in the calculated directivity direction.

According to non-limited aspects of the present invention, it is possible to easily acquire a directivity direction oriented from a microphone array apparatus to a prearranged sound position and to output a clear sound of an object present in a direction oriented from the microphone array apparatus to the prearranged sound position.

BRIEF DESCRIPTION OF THE DRAWINGS

In the accompanying drawings:

FIG. 14A is a diagram illustrating an example of a preset table according to the second embodiment;

FIG. 14B is a diagram illustrating an example of a preset table when a value of (horizontal direction, horizontal angle) of a preset position actually measured in advance is stored as a preset value according to the second embodiment;

FIG. 14C is a diagram illustrating an example of a preset table when a value of (first horizontal direction, second horizontal distance) of a preset position actually measured in advance is stored as a preset value according to the second embodiment FIG. 14D is a diagram illustrating an example of a preset table when a plurality of directivity directions in the preset table illustrated in FIG. 14B are included as preset values;

DETAILED DESCRIPTION

Hereinafter, embodiments of a directivity control system and a directivity control method according to the present invention will be described with reference to the drawings. In the embodiments, the directivity control system is used as a monitoring system (including a manned monitoring system and an unmanned monitoring system) installed in, for example, a factory, a public facility (for example, a library or an event place), or a store (for example, a retail store or a bank), but the present invention is not particularly limited thereto. In the embodiments, the directivity control system according to the embodiments will be described on the assumption that the directivity system is installed in, for example, a store.

The present invention can be expressed as each apparatus (for example, a directivity control apparatus to be described below) included in the directivity control system or a directivity control method including each operation (step) performed by each apparatus (for example, a directivity control apparatus to be described below) included in the directivity control system.

First Embodiment

System Configuration of Directivity Control System

Figure 1B:
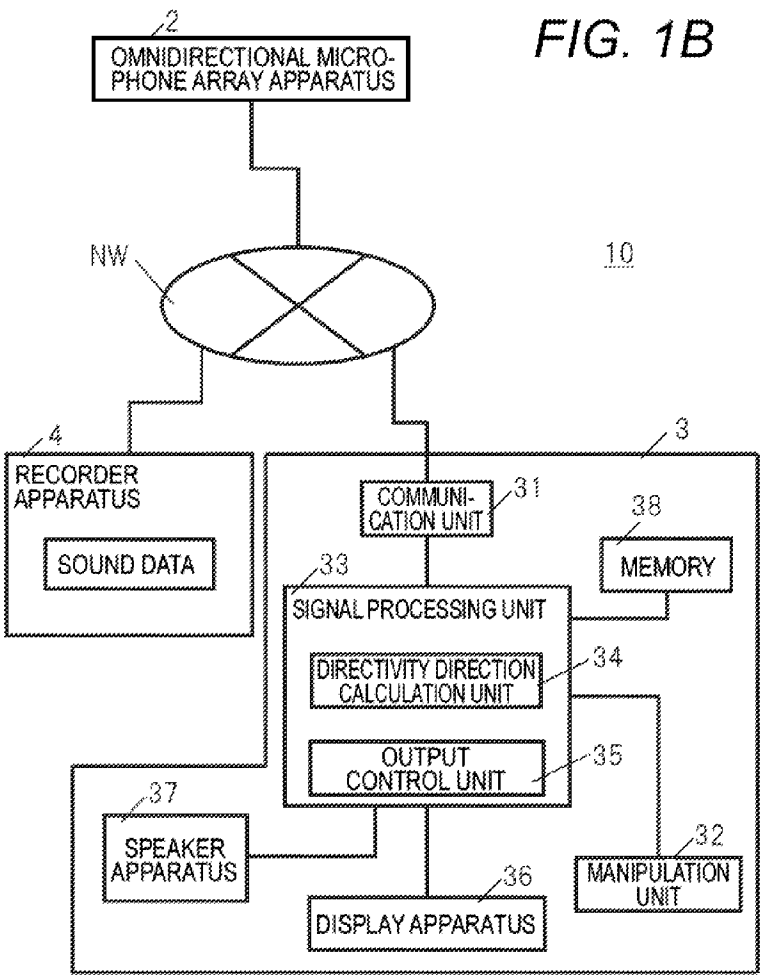
FIG. 1B is a block diagram illustrating the inner configuration of the directivity control system according to the first embodiment.
Figure 1A:
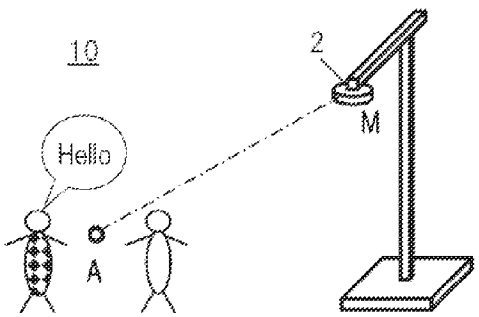
FIG. 1A is a diagram illustrating a system overview of a directivity control system according to a first embodiment.

FIG. 1A is a diagram illustrating the system overview of a directivity control system 10 according to a first embodiment. FIG. 1B is a block diagram illustrating the inner configuration of the directivity control system 10 according to the first embodiment. The directivity control system 10 illustrated in FIGS. 1A and 1B includes an omnidirectional microphone array apparatus 2 serving as a sound collection unit that collects a sound (for example, a sound of dialog of two persons) of targets (for example, two persons in FIG. 1A and the same applies hereinafter), a directivity control apparatus 3, and a recorder apparatus 4.

The omnidirectional microphone array apparatus 2 includes a casing 21C (see FIG. 4D) with, for example, a doughnut shape or a ring shape (circular shape) in which an opening 21*a* is formed at the center of the casing and collects a sound in directions (all directions) of 360° centering on an installation position M of the omnidirectional microphone array apparatus 2. In FIG. 1A, the omnidirectional microphone array apparatus 2 forms directivity to collect a sound with high precision in a directivity direction oriented from the installation position M of the omnidirectional microphone array apparatus 2 to a sound position A to be described below and collects a sound ("Hello") example, of dialog of two persons, who are targets present in the directivity direction, with high precision. The casing shape of the omnidirectional microphone array apparatus 2 is not limited to the doughnut shape or the ring shape (circular shape) and will be described below with reference to FIG. 4.

In the omnidirectional microphone array apparatus 2, a plurality of microphone units 22 are disposed concentrically around the opening 21*a* and along the circumferential direction of the casing 21*c*. In the microphone unit 22, for example, an electret condenser microphone (ECM) with high sound quality and a small size is used and the same also applies to the following embodiments.

In the directivity control system 10 illustrated in FIG. 1B, the omnidirectional microphone array apparatus 2, the directivity control apparatus 3, and the recorder apparatus 4 are connected to each other via a network NW. The network NW may be a wired network (for example, an intranet or the Internet) or may be a wireless network (for example, a wireless local area network (LAN)), and the same also applies to the following embodiments.

The omnidirectional microphone array apparatus 2 is connected to the network NW and includes at least the microphone units 22 and 23 (see FIGS. 4A to 4E) which each include a microphone and are installed at an equal interval and a control unit (not illustrated) controlling operations of the microphone units 22 and 23.

The omnidirectional microphone array apparatus 2 collects a sound in the directivity direction in which a target that is a sound collection target is present using the microphones 22 and 23 and transmits sound data collected by the microphone units 22 and 23 to the directivity control apparatus 3 or the recorder apparatus 4 via the network NW.

The omnidirectional microphone array apparatus 2 forms directivity of each of the microphone units 22 and 23 in a directivity direction ($\theta_{MAh}$, $\theta_{MAv}$) calculated by a direction directivity calculation unit 34 of a signal processing unit 33 of the directivity control apparatus 3 in response to a directivity forming instruction from the directivity control apparatus 3 to be described below.

Thus, the omnidirectional microphone array apparatus 2 can relatively increase a volume level of a sound collected in the directivity direction ($\theta_{MAh}$, $\theta_{MAv}$) in which the directivity is formed and can relatively reduce a volume level of a sound collected in a direction in which the directivity is not formed. A method of calculating the directivity direction ($\theta_{MAh}$, $\theta_{MAv}$) will be described below.

The microphone units 22 and 23 of the omnidirectional microphone array apparatus 2 may each be a non-directional microphone, a bi-directional microphone, a unidirectional microphone, a sharp directional microphone, a super-directional microphone (for example, a shot-gun microphone), or a combination thereof.

The directivity control apparatus 3 may be a stationary personal computer (PC) connected to the network NW and installed in, for example, a monitoring system control room (not illustrated) or may be a data communication terminal which can be carried by a user, such as a portable telephone, a tablet terminal, or a smartphone.

The directivity control apparatus 3 includes at least a communication unit 31, a manipulation unit 32, the signal processing unit 33, a display apparatus 36, a speaker apparatus 37, and a memory 38. The signal processing unit 33 includes the directivity direction calculation unit 34 and an output control unit 35.

The communication unit 31 receives sound data transmitted by the omnidirectional microphone array apparatus 2 and outputs the sound data to the signal processing unit 33 via the network NW.

The manipulation unit 32 is a user interface (UI) for notifying the signal processing unit 33 of content of an input manipulation of the user and is a pointing apparatus such as a mouse or a keyboard. The manipulation unit 32 may be disposed to correspond to a screen of the display apparatus 36 and may be configured using a touch panel or a touch pad on which an input manipulation can be performed with a finger FG of the user or a stylus pen.

The manipulation unit 32 acquires coordinate data indicating a place where the user desires to increase or decrease a volume level of a sound, i.e., a designation position A' on a directivity direction designation screen illustrated in FIG. 2B or 3B or preset designation positions P1', P2', P3-1', P3-2' illustrated in FIG. 9B to be described below in response to an input manipulation of the user, and then output the coordinate data to the signal processing unit 33.

The signal processing unit 33 is configured using a central processing unit (CPU), a micro processing unit (MPU), or a digital signal processor (DSP) and performs a control process of overall controlling the operation of each unit of the directivity control apparatus 3 as a whole, a process of inputting and outputting data with each of the other units, a process of computing (calculating) data, and a process of storing data.

The directivity direction calculation unit 34 calculates coordinates ($\theta_{MAh}$, $\theta_{MAv}$) indicating a directivity direction oriented from the omnidirectional microphone array apparatus 2 to the sound position A corresponding to the designation position A' according to designation of an arbitrary position (=the designation position A') by the user on the directivity direction designation screen (see FIG. 2A or 3A) displayed on the display apparatus 36. A specific calculation method of the directivity direction calculation unit 34 will be described with reference to FIGS. 7 and 8.

In the coordinates ($\theta_{MAh}$, $\theta_{MAv}$) indicating the directivity direction, $\theta_{MAh}$ indicates a horizontal angle of the directivity direction oriented from the omnidirectional microphone array apparatus 2 to the sound position A and $\theta_{MAv}$ indicates a vertical angle of the directivity direction oriented from the omnidirectional microphone array apparatus 2 to the sound position A. The sound position A is a position which corresponds to the designation position A' designated with the finger FG of the user of a stylus pen on the directivity direction designation screen displayed on the display apparatus 36 by the manipulation unit 32 and which is the position of an actual site to be actually monitored (see FIG. 1A).

Figure 2A:
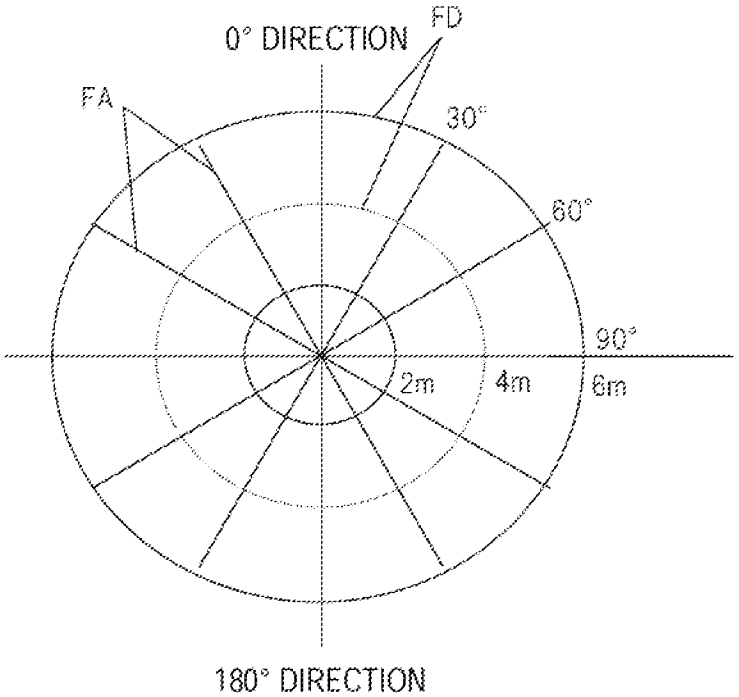
FIG. 2A is a diagram illustrating a first example of a directivity direction designation screen according to the first embodiment.

Here, the directivity direction designation screen will be described with reference to FIGS. 2A, 2B, 3A, and 3B. FIG. 2A is a diagram illustrating a first example of the directivity direction designation screen according to the first embodiment. FIG. 2B is a diagram illustrating a horizontal distance $L_A$ and a horizontal angle $\theta_A$ of the directivity direction oriented to the sound position A corresponding to the designation position A' designated on the directivity direction designation screen illustrated in FIG. 2A. FIG. 3A is a diagram illustrating a second example of the directivity direction designation screen according to the first embodiment. FIG. 3B is a diagram illustrating a first horizontal distance $L_{Ax}$ and a second horizontal distance $L_{Ay}$ of the directivity direction oriented to the sound position A corresponding to the designation position A' designated on the directivity direction designation screen illustrated in FIG. 3A.

On the directivity direction designation screen illustrated in FIG. 2A, the omnidirectional microphone array apparatus 2 is disposed at the position of the origin. A distance from the origin represents a horizontal distance (see FIG. 7A) from the omnidirectional microphone array apparatus 2. An angle relative to a reference direction (for example, the 0° direction) represents a horizontal angle (see FIG. 7A) of the omnidirectional microphone array apparatus 2. The upper side of FIG. 2A represents a 0° direction which is a reference direction of the horizontal angle and the lower side of the drawing represents a 180° direction of the horizontal angle. In FIG. 2A, concentrically curved lines formed using, as a starting point, a straight line of the upper side from the origin of the vertical axis, i.e., a straight line representing the 0° direction of the horizontal angle, represent horizontal distance baselines FD. The horizontal distance baseline FD indicates a horizontal distance from the omnidirectional microphone array apparatus 2 according to the length of the horizontal distance baseline FD using the straight line indicating the 0° direction of the horizontal angle as the starting point. In FIG. 2A, straight lines extending radially from the origin represent horizontal angle base lines FA. Horizontal angle base line FA represents a horizontal angle from a reference direction (for example, the 0° direction) of the horizontal angle from the omnidirectional microphone array apparatus 2. In FIGS. 2A and 2B, a unit of the horizontal distance is, for example, a meter [m].

Figure 2B:
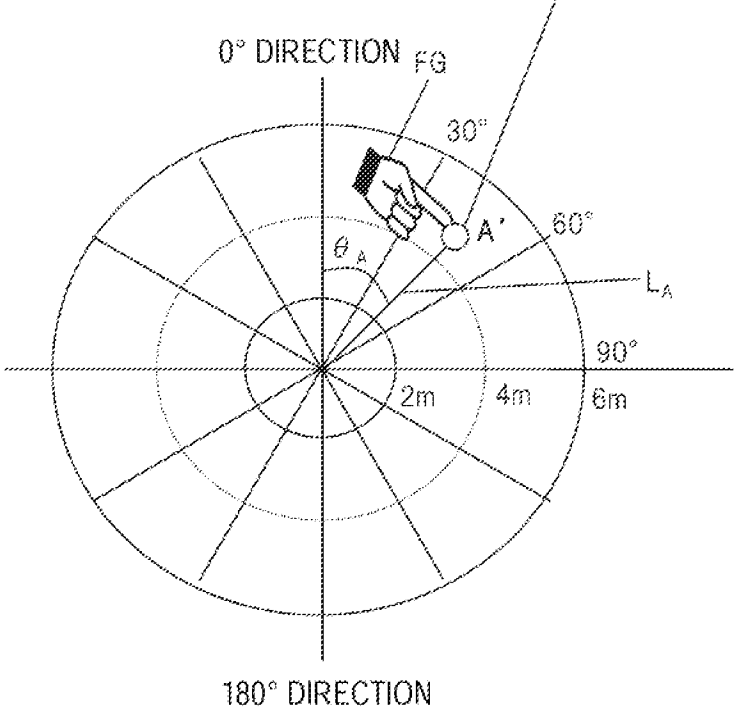
FIG. 2B is a diagram illustrating a horizontal distance $L_A$ and a horizontal angle $\theta_A$ of a directivity direction oriented toward a sound position A corresponding to a designation position A' designated on a directivity direction designation screen illustrated in FIG. 2A.
Figure 3A:
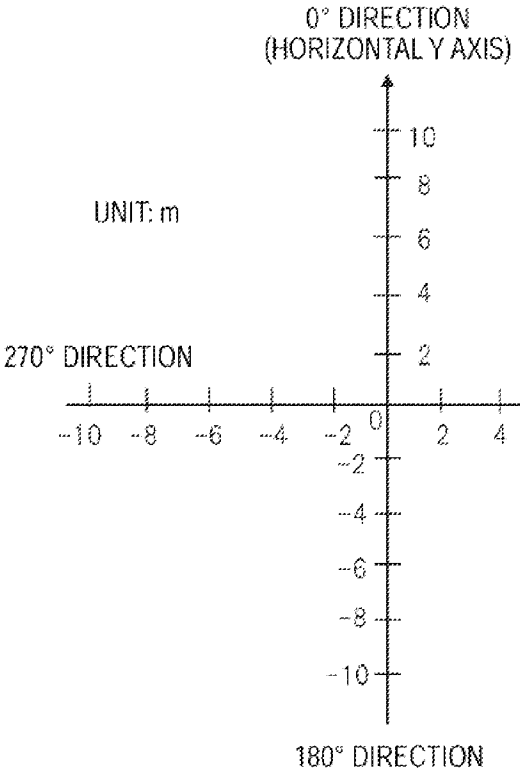
FIG. 3A is a diagram illustrating a second example of a directivity direction designation screen according to the first embodiment.

For example, as illustrated in FIG. 2B, when the arbitrary designation position A' is designated with the finger FG of the user on the directivity direction designation screen illustrated in FIG. 2A, the directivity direction calculation unit 34 acquires coordinate data of the designation position A', i.e., coordinate data of (horizontal distance, horizontal angle)=($L_A$, $\theta_A$), from the manipulation unit 32.

On the directivity direction designation screen illustrated in FIG. 3A, the omnidirectional microphone array apparatus 2 is disposed at the position of the origin. The horizontal axis represents a horizontal distance (first horizontal distance, see FIG. 8A) in the X axis direction from the omnidirectional microphone array apparatus 2 and the vertical axis represents a horizontal distance (second horizontal distance, see FIG. 8A) in the Y axis direction from the omnidirectional microphone array apparatus 2. The upper side of FIG. 3A represents a 0° direction which is a reference direction of the horizontal angle of the omnidirectional microphone array apparatus 2, the right side of the drawing represents a 90° direction of the horizontal angle of the omnidirectional microphone array apparatus 2, the lower side of the drawing represents a 180° direction of the horizontal angle of the omnidirectional microphone array apparatus 2, and finally the left side of the drawing represents a 270° direction of the horizontal angle of the omnidirectional microphone array apparatus 2. In FIGS. 3A and 3B, a unit of the horizontal distance is, for example, a meter [m].

Figure 3B:
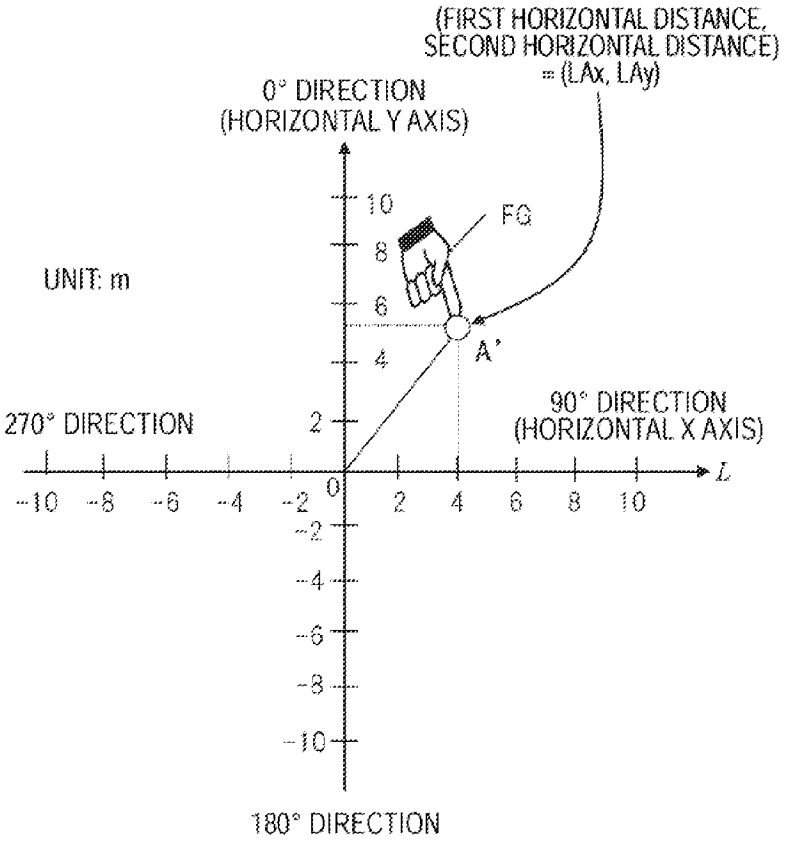
FIG. 3B is a diagram illustrating a first horizontal distance $L_{Ax}$ and a second horizontal distance $L_{Ay}$ of the directivity direction oriented toward the sound position A corresponding to the designation position A' designated on a directivity direction designation screen illustrated in FIG. 3A.

For example, as illustrated in FIG. 3B, when the arbitrary designation position A' is designated with the finger FG of the user on the directivity direction designation screen illustrated in FIG. 3A, the directivity direction calculation unit 34 acquires coordinate data of the designation position A', i.e., coordinate data of (first horizontal distance, second horizontal distance)=($L_{Ax}$, $L_{Ay}$), from the manipulation unit 32.

The output control unit 35 serving as a control unit controls operations of the omnidirectional microphone array apparatus 2, the display apparatus 36, and the speaker apparatus 37. For example, in response to an input manipulation of the user, the output control unit 35 displays the directivity direction designation screen illustrated in FIG. 2A or 3A on the display apparatus 36 and outputs sound data transmitted from the omnidirectional microphone array apparatus 2 to the speaker apparatus 37. The output control unit 35 forms directivity of the sound data in the directivity direction corresponding to sound collection direction coordinates ($\theta_{MAh}$, $\theta_{MAv}$) calculated by the directivity direction calculation unit 34, but may cause the omnidirectional microphone array apparatus 2 to form the directivity.

The display apparatus 36 serving as a display unit displays a directivity direction designation screen used to designate a directivity direction oriented from a position at which the omnidirectional microphone array apparatus 2 is installed to the sound position A at which a target is present under the control of the signal processing unit 33 in response to, for example, an input manipulation of the user.

The speaker apparatus 37 serving as a sound output unit outputs, as a sound, the sound data collected by the omnidirectional microphone array apparatus 2 or the sound data collected by the omnidirectional microphone array apparatus 2 after the directivity is formed in the directivity direction ($\theta_{MAh}$, $\theta_{MAv}$) calculated by the directivity direction calculation unit 34. The display apparatus 36 and the speaker apparatus 37 may be configured independently from the directivity control apparatus 3.

The memory 38 serving as a storage unit is configured using, for example, a random access memory (RAM), functions as a work memory when each unit of the directivity control apparatus 3 operates, and stores data necessary when each unit of the directivity control apparatus 3 operates.

The recorder apparatus 4 records the sound data collected by the omnidirectional microphone array apparatus 2. When one or more camera apparatuses are included in the directivity control system 10 illustrated in FIG. 1A, the recorder apparatus 4 may record the sound data collected by the omnidirectional microphone array apparatus 2 in association with video data captured each camera apparatus.

FIGS. 4A to 4E are diagrams illustrating the outer appearances of the omnidirectional microphone array apparatuses 2. The functions of the omnidirectional microphone array apparatuses 2 illustrated in FIGS. 4A to 4E are the same although the outer appearances and the disposition positions of a plurality of microphone units of the omnidirectional microphone array apparatuses 2 are different.

Figure 4A:
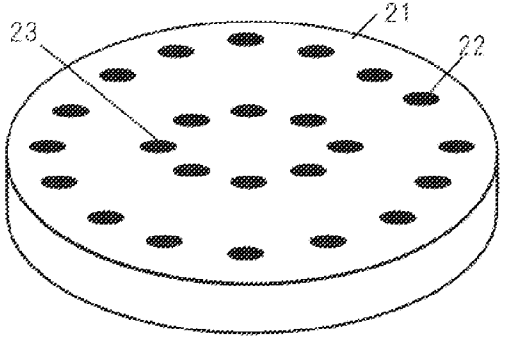
FIGS. 4A to 4E are diagrams illustrating the outer appearances of omnidirectional microphone array apparatuses.

The omnidirectional microphone array apparatus 2 illustrated in FIG. 4A includes a disk-shaped casing 21. In the casing 21, the plurality of microphone units 22 and 23 are arranged concentrically. Specifically, the plurality of microphone units 22 are disposed concentrically along a large circular shape having the same center as the casing 21 and the plurality of microphone units 23 are disposed concentrically along a small circular shape having the same center as the casing 21. The plurality of microphones 22 are mutually disposed at a large interval, have a large diameter, and have characteristics suitable for a low sound range. In contrast, the plurality of microphone units 23 are mutually disposed at a small interval, have a small diameter, and have characteristics suitable for a high sound range.

Figure 4B:
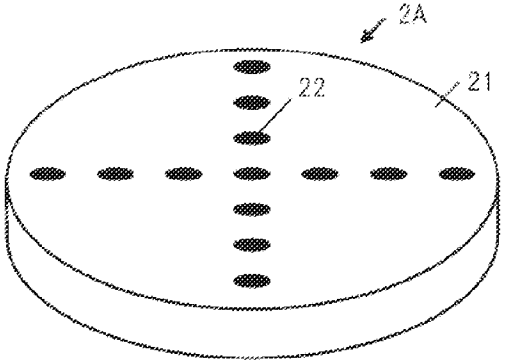

An omnidirectional microphone array apparatus 2A illustrated in FIG. 4B includes a disk-shaped casing 21. In the casing 21, the plurality of microphone units 22 are disposed at a uniform interval on straight lines so that the longitudinal direction and the transverse direction of the horizontal direction intersect each other at the center of the casing 21. Since the plurality of microphone units 22 are disposed in the longitudinal and transverse straight shapes in the omnidirectional microphone array apparatus 2A, a calculation amount of a process of forming the directivity of the sound data can be reduced. The plurality of microphone units 22 may be disposed on only one line in the longitudinal direction or the transverse direction.

Figure 4C:
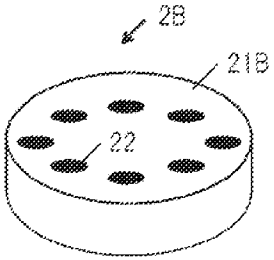

An omnidirectional microphone array apparatus 2B illustrated in FIG. 4C includes a disk-shaped casing 21B with a smaller diameter than the omnidirectional microphone array apparatus 2 illustrated in FIG. 4A. In the casing 21B, the plurality of microphone units 22 are disposed uniformly in the circumferential direction. The omnidirectional microphone array apparatus 2B illustrated in FIG. 4C has characteristics suitable for a high sound range since the interval of the microphone units 22 is short.

Figure 4D:
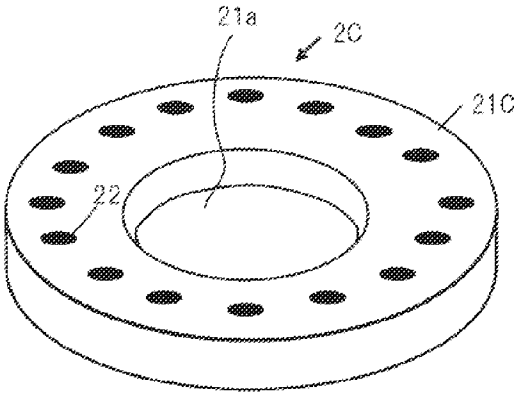

An omnidirectional microphone array apparatus 2C illustrated in FIG. 4D includes a casing 21C with a doughnut shape or a ring shape (circular shape) in which an opening 21*a* with a predetermined diameter is formed at the center of the casing. As described above, the omnidirectional microphone array apparatus 2C illustrated in FIG. 4D is used in the directivity control system 10 illustrated in FIG. 1A. In the casing 21C, the plurality of microphone units 22 are disposed concentrically at a uniform interval in the circumferential direction of the casing 21C.

Figure 4E:
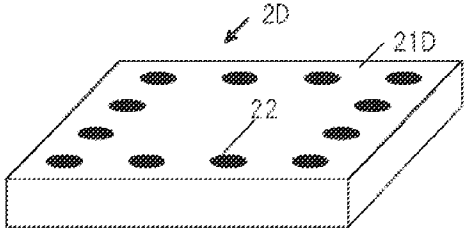

An omnidirectional microphone array apparatus 2D illustrated in FIG. 4E includes a rectangular casing 21D. In the casing 21D, the plurality of microphone units 22 are disposed at a uniform interval in the outer circumferential direction of the casing 21D. Since the casing 21D is formed in a rectangular shape in the omnidirectional microphone array apparatus 2D illustrated in FIG. 4E, for example, the omnidirectional microphone array apparatus 2D can be simply installed even in a place such as a corner.

Figure 5:
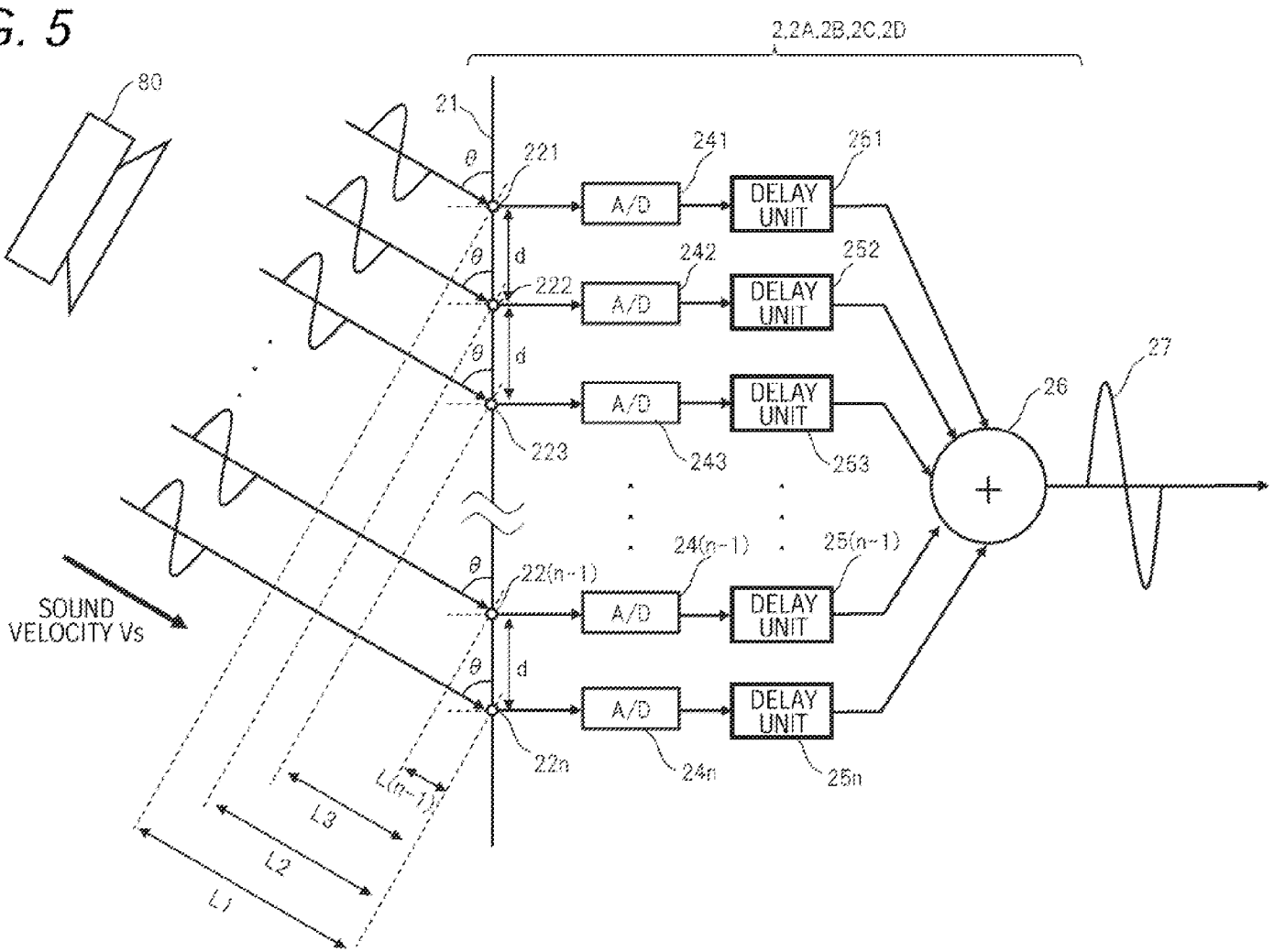
FIG. 5 is a principle diagram for describing content in which the omnidirectional microphone array apparatus forms directivity in a predetermined direction θ as a sound collection direction of a sound.

FIG. 5 is a principle diagram for describing content in which the omnidirectional microphone array apparatus 2 forms directivity in a predetermined angle θ as a sound collection direction of a sound. In FIG. 5, for example, a principle of a directivity control process using a delay summing scheme will be simply described. Sound waves generated from a sound source 80 are incident at a given constant angle (an incident angle=(90−θ) [degrees]) on microphones 221, 222, 223, . . . , 22($n$−1), and 22*n* included in the microphone units 22 or the microphone units 23 of the omnidirectional microphone array apparatus 2. An incident angle θ illustrated in FIG. 5 may be the horizontal angle $\theta_{MAh}$ or the vertical angle $\theta_{MAv}$ of the sound collection direction oriented from the omnidirectional microphone array apparatus 2 to the sound position A.

The sound source 80 is, for example, a target (for example, two persons illustrated in FIG. 1A) of a camera apparatus present in a direction in which the omnidirectional microphone array apparatus 2 collects a sound and is present in a direction of a predetermined angle θ with respect to the surface of the casing 21 of the omnidirectional microphone array apparatus 2. Distances d between the microphones 221, 222, 223, . . . , 22($n$−1), and 22*n* are constant.

The sound waves generated from the sound source 80 first arrive at the microphone 221 so that a sound is collected and then arrive at the microphone 222 so that the sound is collected, the sound is likewise collected in sequence, and the sound waves finally arrive at the microphone 22*n* so that the sound is collected.

A direction oriented from the position of each of the microphones 221, 222, 223, . . . , 22(*n*−1), and 22*n* of the omnidirectional microphone array apparatus 2 to the sound source 80 is the same as, for example, a direction oriented from each microphone of the omnidirectional microphone array apparatus 2 to the sound source A corresponding to the designation position A' designated on the screen of the display apparatus 36 by the user, when the sound source 80 is a sound at the time of dialog of the persons.

Here, arrival time differences τ1, τ2, τ3, . . . , and τn−1 occur between times at which the sound waves arrive at the microphones 221, 222, 223, . . . , and 22(*n*−1) and a time at which the sound waves arrive at the microphone 22*n* and the sound is collected finally. Therefore, when sound data collected by the microphones 221, 222, 223, . . . , 22(*n*−1), and 22*n* are added without change, the sound data is added in a state in which phases are deviated, and thus volume levels of the sound waves may be weakened overall.

Further, τ1 is a time difference between a time at which the sound waves arrive at the microphone 221 and a time at which the sound waves arrive at the microphone 22*n*, τ2 is a time difference between a time at which the sound waves arrive at the microphone 222 and the time at which the sound waves arrive at the microphone 22*n*, and τn−1 is likewise a time difference between a time at which the sound waves arrive at the microphone 22(*n*−1) and the time at which the sound waves arrive at the microphone 22*n*.

In the embodiment, the omnidirectional microphone array apparatus 2 includes A/D converters 241, 242, 243, . . . , 24(*n*−1), and 24*n* and delay units 251, 252, 253, . . . , 25(*n*−1), and 25*n* installed to correspond to the microphones 221, 222, 223, . . . , 22(*n*−1), and 22*n* and an adder 26 (see FIG. 5).

That is, in the omnidirectional microphone array apparatus 2, the A/D converters 241, 242, 243, . . . , 24(*n*−1), and 24*n* perform AD conversion on analog sound data collected by the microphones 221, 222, 223, . . . , 22(*n*−1), and 22*n* to obtain digital sound data.

In the omnidirectional microphone array apparatus 2, the delay units 251, 252, 253, . . . , 25(*n*−1), and 25*n* give delay times corresponding to the arrival time differences in the microphones 221, 222, 223, . . . , 22(*n*−1), and 22*n* to arrange the phases of all of the sound waves, and subsequently the adder 26 adds the sound data subjected to the delay process. Thus, the omnidirectional microphone array apparatus 2 can form directivity of the sound data in the direction of the predetermined angle θ in the microphones 221, 222, 223, . . . , 22(*n*−1), and 22*n*.

For example, in FIG. 5, delay times D1, D2, D3, . . . , D(n−1), and Dn set in the delay units 251, 252, 253, . . . , 25(*n*−1), and 25*n* correspond to the arrival time differences τ1, τ2, τ3, . . . , and τ(n−1), respectively, and are expressed in Equation (1).

[Equation 1]

$$D1 = \frac{L1}{Vs} = \frac{\{d \times (n-1) \times \cos\theta\}}{Vs} \quad (1)$$

$$D2 = \frac{L2}{Vs} = \frac{\{d \times (n-2) \times \cos\theta\}}{Vs}$$

$$D3 = \frac{L3}{Vs} = \frac{\{d \times (n-3) \times \cos\theta\}}{Vs}$$

$$, \cdots ,$$

$$Dn-1 = \frac{\mathrm{Ln}-1}{Vs} = \frac{\{d \times 1 \times \cos\theta\}}{Vs}$$

$$Dn = 0$$

L1 is a difference in a sound wave arrival distance between the microphone 221 and the microphone 22*n*. L2 is a difference in a sound wave arrival distance between the microphone 222 and the microphone 22*n*. L3 is a difference in a sound wave arrival distance between the microphone 223 and the microphone 22*n*. Likewise, L(n−1) is a difference in a sound wave arrival distance between the microphone 22(*n*−1) and the microphone 22*n*. Vs is a speed (sound speed) of the sound waves. L1, L2, L3, . . . , L(n−1), and Vs are known values. In FIG. 5, the delay time Dn set in the delay unit 25*n* is 0 (zero).

Thus, the omnidirectional microphone array apparatus 2 can simply form the directivity of the sound data collected by the microphones 221, 222, 223, . . . , 22(*n*−1), and 22*n* included in the microphone units 22 or the microphone units 23 by changing the delay times D1, D2, D3, . . . , Dn−1, and Dn set in the delay units 251, 252, 253, . . . , 25(*n*−1), and 25*n*.

The description has been made on the assumption that the process described with reference to FIG. 5 is performed by the omnidirectional microphone array apparatus 2. However, when the signal processing unit 33 of the directivity control apparatus 3 is likewise configured to include the same number of AD converters and the same number of delay units as the number of the microphones and one adder, the signal processing unit 33 may perform the above-described process.

Figure 6:
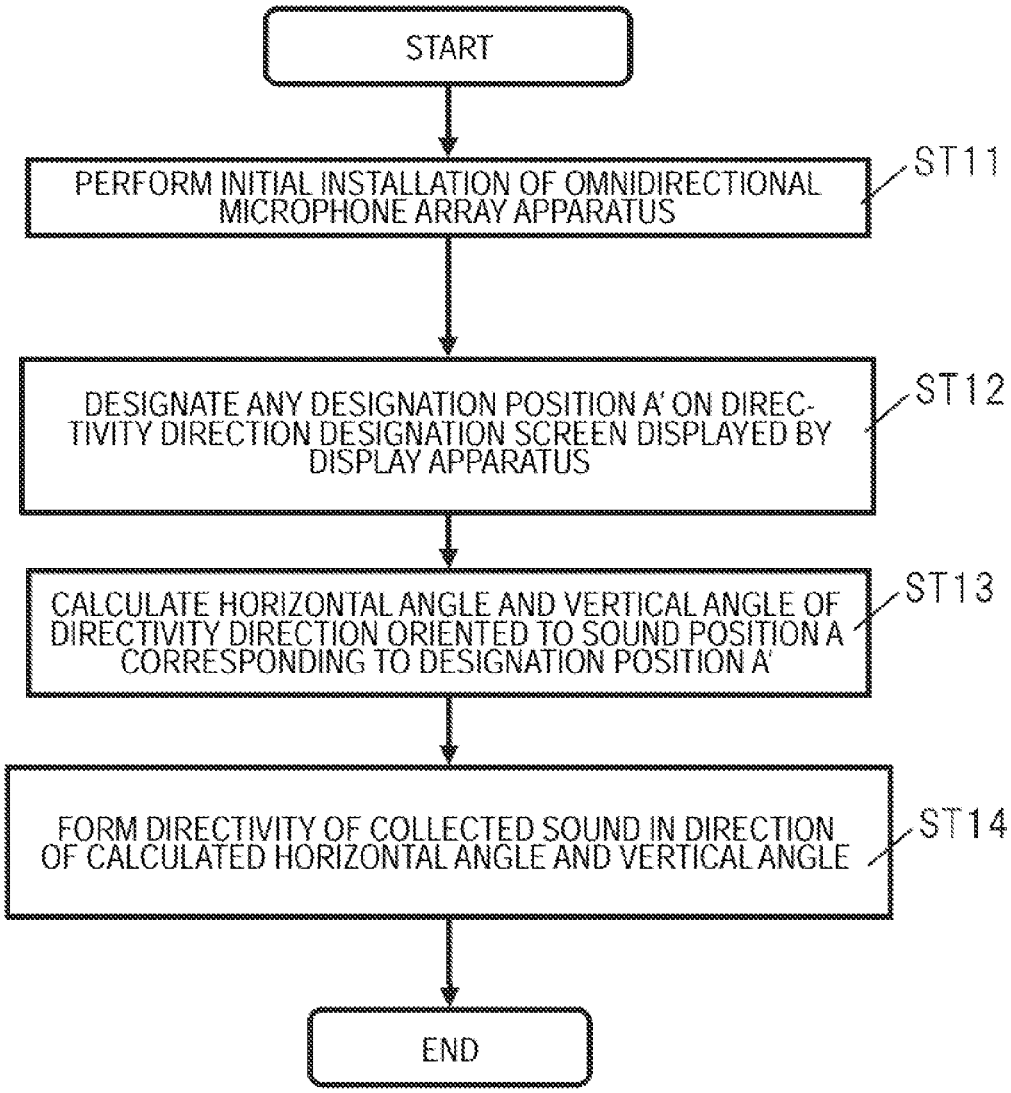
FIG. 6 is a flowchart for describing an operation order of the directivity control system according to the first embodiment.

Next, a detailed operation order of the directivity control system 10 according to the embodiment will be described with reference to FIG. 6. FIG. 6 is a flowchart for describing the operation order of the directivity control system 10 according to the first embodiment. In the description of FIG. 6, an operation of installing or mounting the omnidirectional microphone array apparatus 2 on a predetermined installation surface (for example, a ceiling surface or a stand in a store) is included in the initial installation.

In FIG. 6, the initial installation is performed such that the omnidirectional microphone array apparatus 2 included in the directivity control system 10 is fixed to a predetermined installation surface (for example, a ceiling surface of a stand in a store) (ST11). In the initial installation, a height $H_M$ of the omnidirectional microphone array apparatus 2 from a reference surface (for example, a floor surface of the store, the same applies hereinafter) is measured and is input to the directivity direction calculation unit 34 of the signal processing unit 33 via the manipulation unit 32.

After step ST11, the directivity control apparatus 3 causes the display apparatus 36 to display the directivity direction designation screen illustrated in FIG. 2A or 3A in response to an input manipulation of the user. The directivity control apparatus 3 receives the designation of the arbitrary destination position A' on the directivity direction designation screen displayed by the display apparatus 36 via the manipulation unit 32 (ST12).

Thus, when the arbitrary designation position A' is designated with the finger FG of the user on, for example, the directivity direction designation screen illustrated in FIG. 2A, the directivity control apparatus 3 can acquire the coordinate data of the designation position A', i.e., the coordinate data of (horizontal distance, horizontal angle)= ($L_A$, $\theta_A$), from the manipulation unit 32. Alternatively, when the arbitrary designation position A' is designated with the finger FG of the user on, for example, the directivity direction designation screen illustrated in FIG. 3A, the directivity control apparatus 3 can acquire the coordinate data of the designation position A', i.e., the coordinate data of (first horizontal distance, second horizontal distance)=($L_{Ax}$, $L_{Ay}$), from the manipulation unit 32.

After step ST12, the directivity direction calculation unit 34 of the directivity control apparatus 3 calculates the horizontal angle and the vertical angle ($\theta_{MAh}$, $\theta_{MAh}$) of the directivity direction oriented from the installation position of the omnidirectional microphone array apparatus 2 to the sound position A corresponding to the designation position A' designated in step ST12 based on the coordinate data of (horizontal distance, horizontal angle) or (first horizontal distance, second horizontal distance) acquired in step ST12, the height $H_M$ of the omnidirectional microphone array apparatus 2 from the reference surface (for example, a floor surface of a store, the same applies hereinafter), and a height $H_A$ of the sound position A from a reference surface (for example, a floor surface of a store, the same applies hereinafter) (ST13). The details of the operation of step ST13 will be described below with reference to FIGS. 7 and 8.

Thus, the directivity control apparatus 3 can simply calculate the directivity direction oriented from the omnidirectional microphone array apparatus 2 to the sound position A corresponding to the arbitrary designation position A' designated on the directivity direction designation screen by the user.

The output control unit 35 of the directivity control apparatus 3 transmits a directivity forming instruction including data of the coordinates ($\theta_{MAh}$, $\theta_{MAv}$) indicating the directivity direction calculated in step ST13 to the omnidirectional microphone array apparatus 2. The omnidirectional microphone array apparatus 2 forms the directivity of each of the microphone units 22 and 23 in the sound collection direction of the sound collection direction coordinates ($\theta_{MAh}$, $\theta_{MAv}$) calculated by the directivity control apparatus 3 in response to the directivity forming instruction from the directivity control apparatus 3 (ST14).

Thus, the omnidirectional microphone array apparatus 2 can relatively increase the volume level of the sound data collected in the sound collection direction decided by the sound collection direction coordinates ($\theta_{MAh}$, $\theta_{MAv}$) in which the directivity is formed and can relatively reduce the volume level of the sound data collected in the direction in which no directivity is formed.

In the directivity control system 10 according to the embodiment, a timing at which the omnidirectional microphone array apparatus 2 collects the sound is not limited to a time immediately after step ST14, but may be, for example, a time at which the omnidirectional microphone array apparatus 2 is turned on. The same also applies to each embodiment to be described below.

(Method of Calculating Coordinates ($\theta_{MAh}$, $\theta_{MAv}$) Indicating Directivity Direction of Omnidirectional Microphone Array Apparatus 2)

Figure 7A:
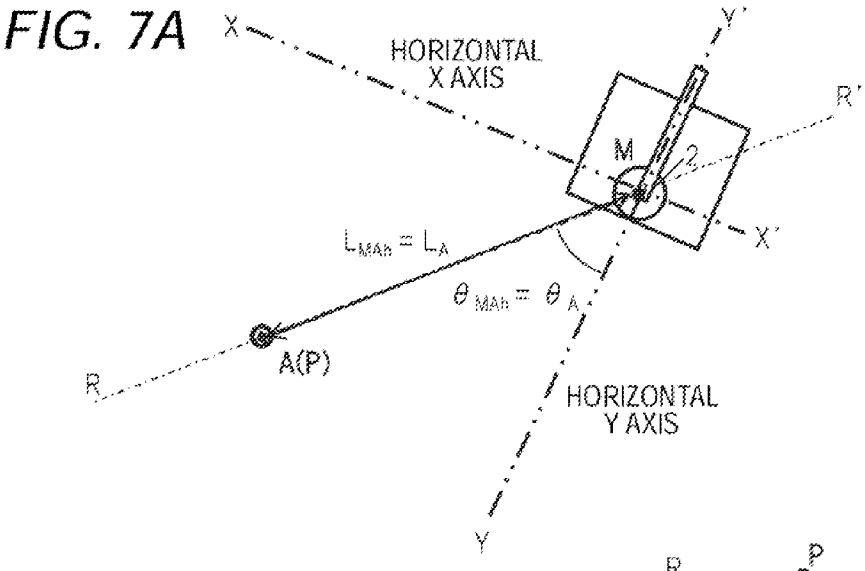
FIG. 7A is a plan view illustrating a geometric arrangement relation between the sound position A corresponding to the designation position A' designated on the directivity direction designation screen illustrated in FIG. 2B and an omnidirectional microphone array apparatus 2.
Figure 7B:
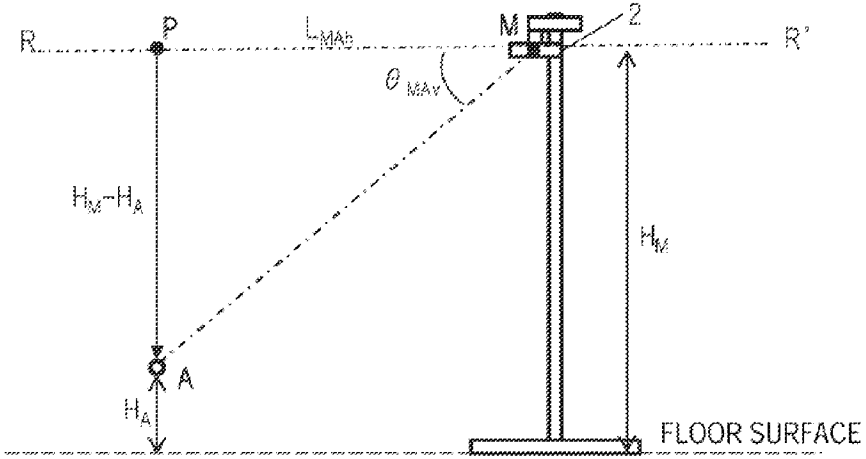
FIG. 7B is a sectional view taken along the line R-R' illustrated in FIG. 7A.
Figure 8A:
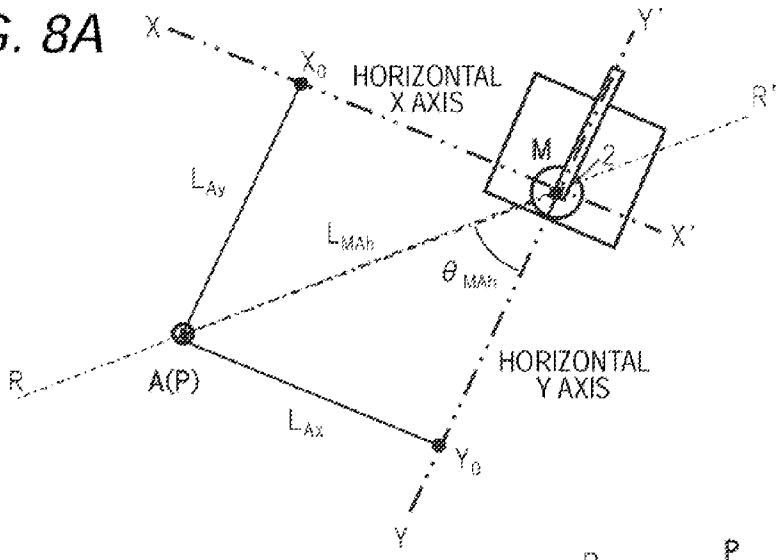
FIG. 8A is a plan view illustrating a geometric arrangement relation between the sound position A corresponding to the designation position A' designated on the directivity direction designation screen illustrated in FIG. 3B and the omnidirectional microphone array apparatus 2.
Figure 8B:
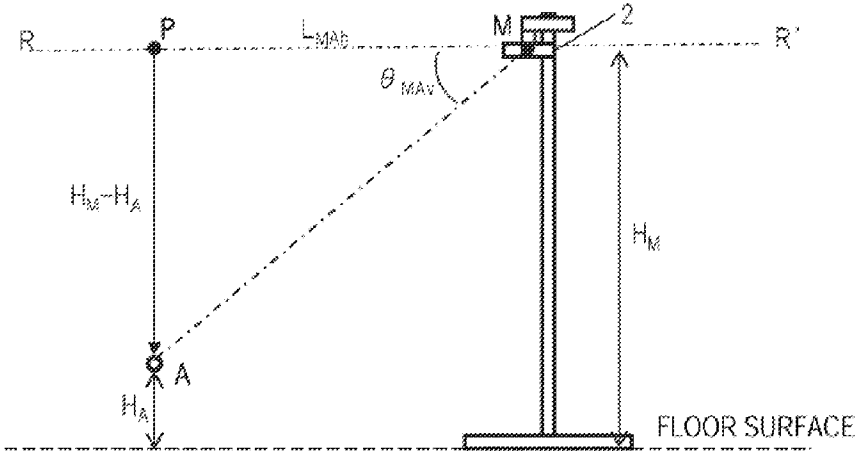
FIG. 8B is a sectional view taken along the line R-R' illustrated in FIG. 8A.

Next, a method of calculating the coordinates ($\theta_{MAh}$, $\theta_{MAv}$) indicating the directivity direction in the directivity control apparatus 3 will be described in detail with reference to FIGS. 7A, 7B, 8A, and 8B. FIG. 7A is a plan view illustrating a geometric arrangement relation between the sound position A corresponding to the designation position A' designated on the directivity direction designation screen illustrated in FIG. 2B and the omnidirectional microphone array apparatus 2. FIG. 7B is a sectional view taken along the line R-R' illustrated in FIG. 7A. FIG. 8A is a plan view illustrating a geometric arrangement relation between the sound position A corresponding to the designation position A' designated on the directivity direction designation screen illustrated in FIG. 3B and the omnidirectional microphone array apparatus 2 and FIG. 8B is a sectional view taken along the line R-R' illustrated in FIG. 8A.

(First Calculation Method: See FIGS. 7A and 7B)

In response to the designation of the arbitrary designation position A' by the user on the directivity direction designation screen (see FIG. 2A) displayed by the display apparatus 36, the directivity direction calculation unit 34 calculates the horizontal angle $\theta_{MAh}$ and the vertical angle $\theta_{MAv}$ of the directivity direction ($\theta_{MAh}$, $\theta_{MAv}$) oriented from the omnidirectional microphone array apparatus 2 to the sound position A corresponding to the designation position A' designated by the user based on:

(1) the height $H_M$ of the omnidirectional microphone array apparatus 2 from the floor surface measured in step ST11;

(2) the coordinate data of (horizontal distance, horizontal angle)=($L_A$, $\theta_A$) of the designation position A' obtained in step ST12; and (3) the height $H_A$ of the sound position A from the floor surface. The horizontal angle $\theta_{MAh}$ of the directivity direction is the same as the horizontal angle $\theta_A$ obtained in step ST12.

(3) The height $H_A$ of the sound position A from the horizontal surface is a fixed value determined in advance. Alternatively, the height $H_A$ is a value input or selected as $H_A$ of the height of a person when the person is present around the sound position A, for example, when the designation position A' is designated with the finger FG of the user on the directivity direction designation screen.

Hereinafter, a first calculation method and a second calculation method for the directivity direction ($\theta_{MAh}$, $\theta_{MAv}$) in the directivity direction calculation unit 34 will be described specifically. First, as the assumption of the description of the first calculation method and the second calculation method, a reference direction (for example, a 0° direction) of the horizontal angle necessary at the time of determination of the horizontal angle of the directivity direction of the omnidirectional microphone array apparatus 2 is assumed to be known and be, for example, a direction oriented from a point Y' to a point Y of the horizontal Y axis illustrated in FIG. 7A. The line Y'-Y illustrated in FIG. 7A is present on a plane including the center of the omnidirectional microphone array apparatus 2 installed at a position of the height $H_M$ from the floor surface and indicates the Y axis (horizontal Y axis) serving as the reference direction of the horizontal angle. The line X'-X illustrated in FIG. 7A is likewise present on a plane including the center of the omnidirectional microphone array apparatus 2 installed at a position of the height $H_M$ from the floor surface and indicates the X axis (horizontal X axis) orthogonal to the Y axis.

The directivity direction calculation unit 34 determines that the horizontal angle $\theta_{MAh}$ of the directivity direction oriented from the omnidirectional microphone array apparatus 2 to the sound position A is the same as ∠AMY illustrated in FIG. 7A, i.e., the horizontal angle $\theta_A$ obtained in step ST12, and calculates the horizontal angle $\theta_{MAh}$ as the "horizontal angle $\theta_{MAh}=\theta_A$" of the directivity direction.

The directivity direction calculation unit 34 calculates the vertical angle $\theta_{MAv}$ of the directivity direction oriented from the omnidirectional microphone array apparatus 2 to the sound position A according to Equation (2) based on the horizontal distance $L_A$ from the omnidirectional microphone array apparatus 2 to the sound position A obtained in step ST12, the height $H_M$ of the omnidirectional microphone array apparatus 2 from the floor surface, and the height $H_A$ of the sound position A from the floor surface in ΔAMP illustrated in FIG. 7B.

[Equation 2]

$$\theta_{MAv} = \arctan\left(\frac{H_M - H_A}{L_A}\right) \quad (2)$$

(Second Calculation Method: See FIGS. 8A and 8B)

In response to the designation of the arbitrary designation position A by the user on the directivity direction designation screen (see FIG. 3A) displayed by the display apparatus 36, the directivity direction calculation unit 34 calculates the horizontal angle and the vertical angle of the directivity direction ($\theta_{MAh}$, $\theta_{MAv}$) oriented from the omnidirectional microphone array apparatus 2 to the sound position A corresponding to the designation position A' designated by the user based on:

(1) the height $H_M$ of the omnidirectional microphone array apparatus 2 from the floor surface measured in step ST11;

(2) the coordinate data of (first horizontal distance, second horizontal distance)=($L_{Ax}$, $L_{Ay}$) of the designation position A' obtained in step ST12; and (3) the height $H_A$ of the sound position A from the floor surface.

The directivity direction calculation unit 34 calculates the horizontal angle $\theta_{MAh}$ of the directivity direction oriented from the omnidirectional microphone array apparatus 2 to the sound position A according to Equation (3) based on the first horizontal distance $L_{Ax}$ and the second horizontal distance $L_{Ay}$ obtained in step ST12 in $\Delta AMY_0$ or $\Delta AMX_0$ illustrated in FIG. 8A.

[Equation 3]

$$\theta_{MAh} = \arctan\left(\frac{L_{Ax}}{L_{Ay}}\right) \quad (3)$$

The directivity direction calculation unit 34 calculates the vertical angle $\theta_{MAv}$ of the directivity direction oriented from the omnidirectional microphone array apparatus 2 to the sound position A according to Equation (4) based on the first horizontal distance $L_{Ax}$ and the second horizontal distance $L_{Ay}$ from the omnidirectional microphone array apparatus 2 to the sound position A obtained in step ST12, the height $H_M$ of the omnidirectional microphone array apparatus 2 from the floor surface, and the height $H_A$ of the sound position A from the floor surface in ΔAMP illustrated in FIG. 8B. The horizontal distance $L_{MAh}$ from the omnidirectional microphone array apparatus 2 to the sound position A is expressed as in Equation (5) using the first horizontal distance $L_{Ax}$ and the second horizontal distance $L_{Ay}$ from the omnidirectional microphone array apparatus 2 to the sound position A obtained in step ST12.

[Equation 4]

$$\theta_{MAv} = \arctan\left(\frac{H_M - H_A}{L_{MAh}}\right) \quad (4)$$

[Equation 5]

$$L_{MAh} = \sqrt{L_{Ax}^2 + L_{Ay}^2} \quad (5)$$

As described above, in the directivity control system 10 according to the embodiment, the directivity direction designation screen used to designate the directivity direction oriented from the omnidirectional microphone array apparatus 2 to the sound position A at which a target is present is displayed by the display apparatus 36. The directivity direction calculation unit 34 of the directivity control apparatus 3 calculates the horizontal angle and the vertical angle from the omnidirectional microphone array apparatus 2 to the sound position A corresponding in the designated directivity direction according to the designation of the directivity direction on the directivity direction designation screen displayed by the display apparatus 36. The output control unit 35 of the directivity control apparatus 3 forms the directivity of the collected sound based on the calculated horizontal angle and vertical angle.

Thus, in the directivity control system 10, the directivity control apparatus 3 can calculate the horizontal angle and the vertical angle indicating the directivity direction oriented from the omnidirectional microphone array apparatus 2 to the sound position A designated on the directivity direction designation screen. Further, the directivity control apparatus 3 can form the directivity to output a clear sound of a target which the user desires to hear based on the calculated horizontal angle and vertical angle of the directivity direction, and thus the clear sound of the target present at the corresponding sound position A can be output.

In the embodiment, the horizontal distance and the horizontal angle from the omnidirectional microphone array apparatus 2 to the sound position A are displayed on the directivity direction designation screen displayed by the display apparatus 36. Accordingly, the directivity direction calculation unit 34 of the directivity control apparatus can simply calculate the horizontal angle and the vertical angle from the omnidirectional microphone array apparatus 2 to the sound position A based on the height $H_M$ of the omnidirectional microphone array apparatus 2 from the floor surface, the height $H_A$ of the sound position A from the floor surface, and the the horizontal distance $L_A$ and the horizontal angle $\theta_A$ from the omnidirectional microphone array apparatus 2 to the sound position A.

In the embodiment, the first horizontal distance $L_{Ax}$ and the second horizontal distance $L_{Ay}$ from the omnidirectional microphone array apparatus 2 to the sound position A are displayed on the directivity direction designation screen displayed by the display apparatus 36. Accordingly, the directivity direction calculation unit 34 of the directivity control apparatus can simply calculate the horizontal angle and the vertical angle from the omnidirectional microphone array apparatus 2 to the sound position Abased on the height $H_M$ of the omnidirectional microphone array apparatus 2 from the floor surface, the height $H_A$ of the sound position A from the floor surface, and the first horizontal distance $L_{Ax}$ and the second horizontal distance $L_{Ay}$ from the omnidirectional microphone array apparatus 2 to the sound position A.

Second Embodiment

In a directivity control system 10 according to a second embodiment, one or more sound positions at which a user desires to hear sounds are determined in advance. When one or more prearranged sound positions are designated, a directivity control apparatus 3 calculates coordinates (horizontal angle, vertical angle) indicating directivity directions oriented from an omnidirectional microphone array apparatus 2 to the designated sound positions and stores the calculation result in a memory 38 of the directivity control apparatus 3. In the directivity control system 10 according to the second embodiment, when an arbitrary sound position is designated on a sound position designation screen (see the following description) displayed by a display apparatus 36, the directivity control apparatus 3 calculates coordinates (horizontal angle, vertical angle) indicating a directivity direction oriented from the omnidirectional microphone array apparatus 2 to the designated sound position based on the coordinates (horizontal angle, vertical angle) indicating the directivity direction of the stored prearranged sound position (preset position).

In each embodiment to be described, an actual prearranged sound position at which the user desires to hear a sound in a store in which the directivity control system 10 illustrated in FIG. 1B is installed is defined as a "preset position" and a designation position on a preset designation position setting screen (see FIG. 9B) corresponding to the preset position in the actual store is defined as a "preset designation position."

In an operation of each unit of the omnidirectional microphone array apparatus 2, the directivity control apparatus 3 and the recorder apparatus 4 included in the directivity control system 10 according to the embodiment, the same reference numerals are given to the same content as the operation of each unit of the omnidirectional microphone array apparatus 2, the directivity control apparatus 3, and the recorder apparatus 4 included in the directivity control system 10 according to the first embodiment, description will be omitted or simplified, and other content will be described.

Figure 9B:
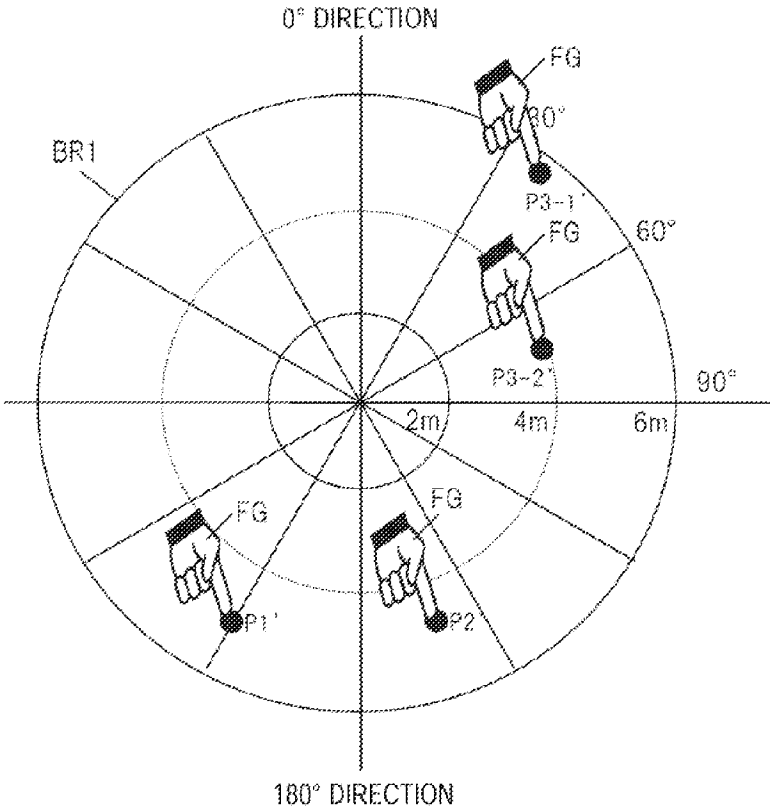
FIG. 9B is a diagram illustrating an example of a preset designation position setting screen used to set preset designation positions corresponding to preset positions based on horizontal directions and horizontal angles of the preset positions illustrated in FIG. 9A.
Figure 9A:
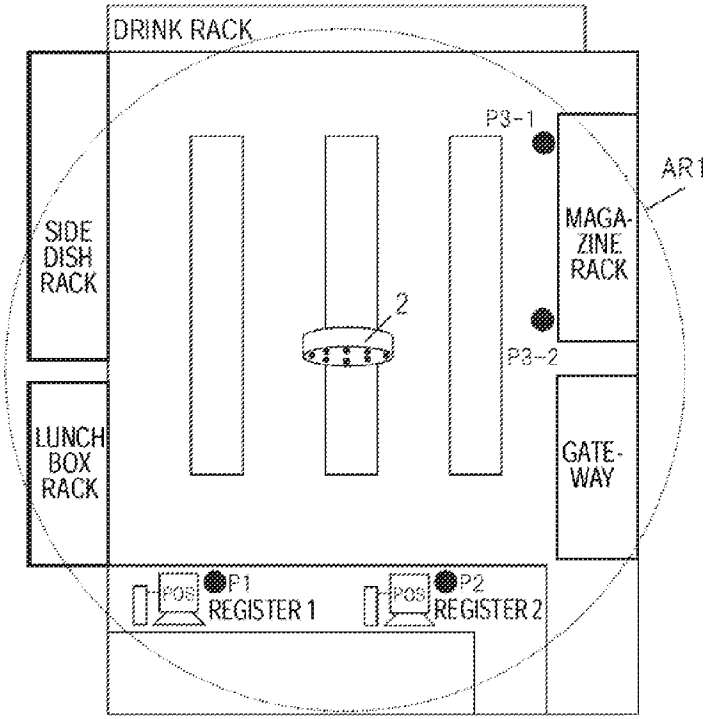
FIG. 9A is a preset designation position diagram illustrating a relation between an entire sound collection area AR1 and a plurality of preset positions P1, P2, P3-1, and P3-2 when a directivity control system 10 according to a second embodiment is installed in a store.

FIG. 9A is a preset designation position diagram illustrating a relation between an entire sound collection area AR1 and a plurality of preset positions P1, P2, P3-1, and P3-2 when the directivity control system 10 according to the second embodiment is installed in a store. FIG. 9B is a diagram illustrating an example of a preset designation position setting screen used to set preset designation positions corresponding to preset positions based on horizontal directions and horizontal angles of the preset positions illustrated in FIG. 9A.

The preset designation position diagram illustrated in FIG. 9A is an example of a design with a bird's eye view illustrating the inside of the store and showing the actual preset positions P1, P2, P3-1, and P3-2 inside one or more sound collection areas from the omnidirectional microphone array apparatus 2. For example, the user actually measure the horizontal distances and the horizontal angles in advance with reference to the preset designation position diagram which is an example of the design with a bird's eye view illustrated in FIG. 9A when the omnidirectional microphone array apparatus 2 is installed. The actually measured horizontal distances and horizontal angles are stored in, for example, the memory 38 (see FIG. 14B).

On the preset designation position setting screen displayed by the display apparatus 36 and illustrated in FIG. 9B, the position of the omnidirectional microphone array apparatus 2 illustrated in FIG. 9A corresponds to the position of the origin illustrated in FIG. 9B and the entire sound collection area AR1 in the preset designation position diagram illustrated in FIG. 9A corresponds to an outermost circle BR1 illustrated in FIG. 9B. The user sets positions corresponding to the horizontal distances and the horizontal angles of the actually measured preset positions on the preset designation position setting screen as preset designation positions P1', P2', P3-1', and P3-2' corresponding to the preset positions P1, P2, P3-1, and P3-2.

In the entire sound collection area AR1 illustrated in FIG. 9A, for example, the preset position P1 is predetermined as a position around a register 1 of a store, the preset position P2 is predetermined as a position around a register 2 of the store, the preset position P3-1 is predetermined as a position around a magazine rack distant from a gateway entrance of the store, and the preset position P3-2 is predetermined as a position around the magazine rack close to the gateway of the store (for example, see FIG. 14A). The preset positions and the corresponding preset designation positions illustrated in FIG. 9A are examples. The present invention is not limited to the above-described preset positions and the preset positions may be changed by the directivity control apparatus 3 according to an input manipulation of the user.

A radial coordinate system is shown in FIG. 9B. However, the directivity control apparatus 3 may display an orthogonal coordinate system or may display a store plan view such as the preset designation position diagram illustrated in FIG. 9A in a superposition manner on the display apparatus 36.

Figure 10B:
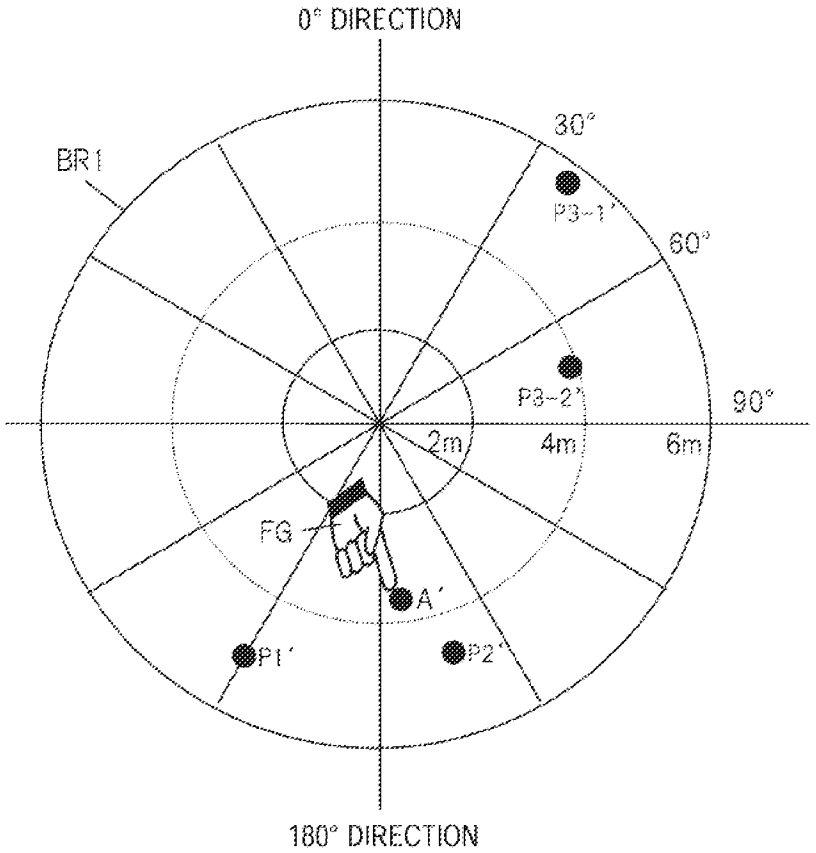
FIG. 10B is a diagram illustrating an example of a sound position designation screen for designating the sound positions at which the users desires to hear within an outermost circle BR1 corresponding to the entire sound collection area AR1.
Figure 10A:
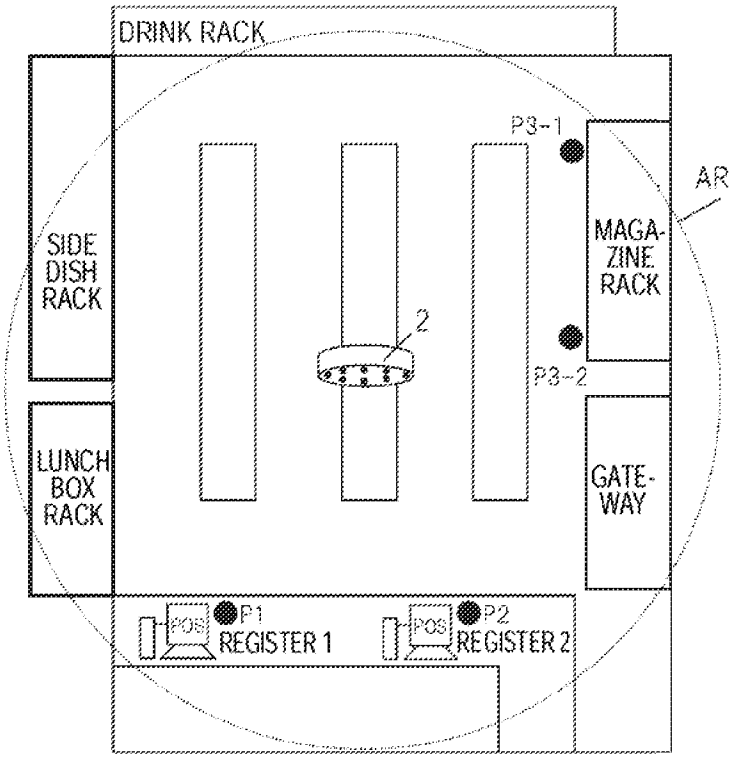
FIG. 10A is a preset designation position diagram illustrating a relation between the plurality of preset positions P1, P2, P3-1, and P3-2 within the entire sound collection area AR1 and sound positions at which a user desires to hear.

FIG. 10A is a preset designation position diagram illustrating a relation between the plurality of preset positions P1, P2, P3-1, and P3-2 within the entire sound collection area AR1 and sound positions at which users desires to hear. FIG. 10B is a diagram illustrating an example of a sound position designation screen for designating the sound positions at which a user desires to hear within the outermost circle BR1 corresponding to the entire sound collection area AR1.

When a direction in which the user desires to hear in FIG. 10B is designated with the finger FG, the directivity control apparatus 3 reads preset data stored in, for example, the memory 38, i.e., data of preset values, calculates the directivity direction based on the preset data, and forms directivity in regard to the sound collected by the omnidirectional microphone array apparatus 2.

Figure 11:
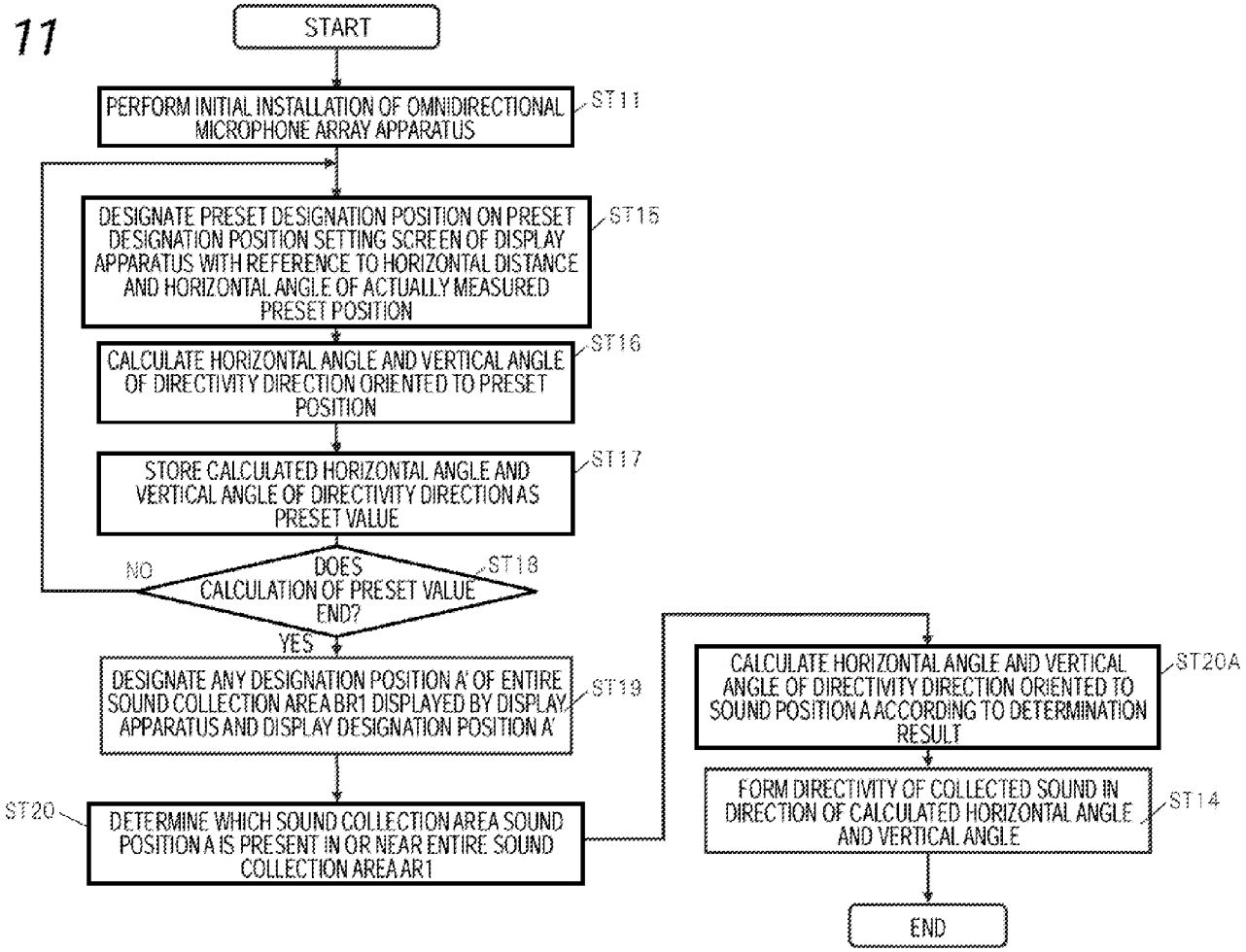
FIG. 11 is a flowchart for describing an operation order of the directivity control system according to the second embodiment.

Next, a detailed operation order of the directivity control system 10 according to the embodiment will be described with reference to FIG. 11. FIG. 11 is a flowchart for describing the operation order of the directivity control system 10 according to the second embodiment. In the description of FIG. 11, an operation of installing or mounting the omnidirectional microphone array apparatus 2 on a predetermined installation surface (for example, a ceiling surface or a stand in a store) is included in the initial installation and an operation of actually measuring each piece of data regarding a pair of horizontal distance and horizontal angle or a pair of first and second horizontal distances from the omnidirectional microphone array apparatus 2 to each of the preset positions P1, P2, P3-1, and P3-2 in advance.

In FIG. 11, the initial installation is performed such that the omnidirectional microphone array apparatus 2 included in the directivity control system 10 is fixed to a predetermined installation surface (for example, a ceiling surface of a stand in a store) (ST11). In the initial installation, the height $H_M$ of the omnidirectional microphone array apparatus 2 from the floor surface of the store is measured and is input to the directivity direction calculation unit 34 of the signal processing unit 33 via the manipulation unit 32.

After step ST11, the directivity control apparatus 3 causes the display apparatus 36 to display the preset designation position setting screen illustrated in FIG. 9B in response to an input manipulation of the user. The user sets a position corresponding to the horizontal distance and the horizontal angle of the actually measured preset position on the preset designation position setting screen as a preset designation position corresponding to the preset position with the finger FG. The directivity control apparatus 3 receives information regarding the preset position, such as a name (for example, register 1 or register 2) of the preset position set on the preset designation position setting screen of the display apparatus 36, via the manipulation unit 32 (ST15).

After step ST15, the directivity direction calculation unit 34 of the directivity control apparatus 3 calculates a horizontal angle and a vertical angle (for example, (horizontal angle, vertical angle)=($\theta_{hp1}$, $\theta_{vp1}$)) of the directivity direction oriented from the installation position of the omnidirectional microphone array apparatus 2 to the preset position (for example, the preset position P1) corresponding to the preset designation position (for example, the preset designation position P1') set in step ST15 based on coordinate data of (horizontal distance, horizontal angle) or (first horizontal distance, second horizontal distance) corresponding to the coordinate data set in step ST15, the height $H_M$ of the omnidirectional microphone array apparatus 2 from the floor surface, and a height $H_{P1}$ of the preset position (for example, the preset position P1) from the floor surface (ST16). Since the details of the operation of step ST16 is the same as the first or second calculation method for the horizontal angle and the vertical angle in the above-described first embodiment, the description thereof will be omitted.

The directivity direction calculation unit 34 of the directivity control apparatus 3 stores the horizontal angle and the vertical angle (for example, (horizontal angle, vertical angle)= ($\theta_{hp1}$, $\theta_{vp1}$)) of the directivity direction oriented to the preset position (for example, the preset position P1), as calculated in step ST16, as the preset value of the preset position (for example, the preset position P1) in the sound collection area in the memory 38 (ST17, see FIG. 14A). Until the calculation of the directivity direction (preset value) in regard to all of the preset positions ends, the operations of step ST15 to step ST17 are repeated (ST18).

Figure 12:
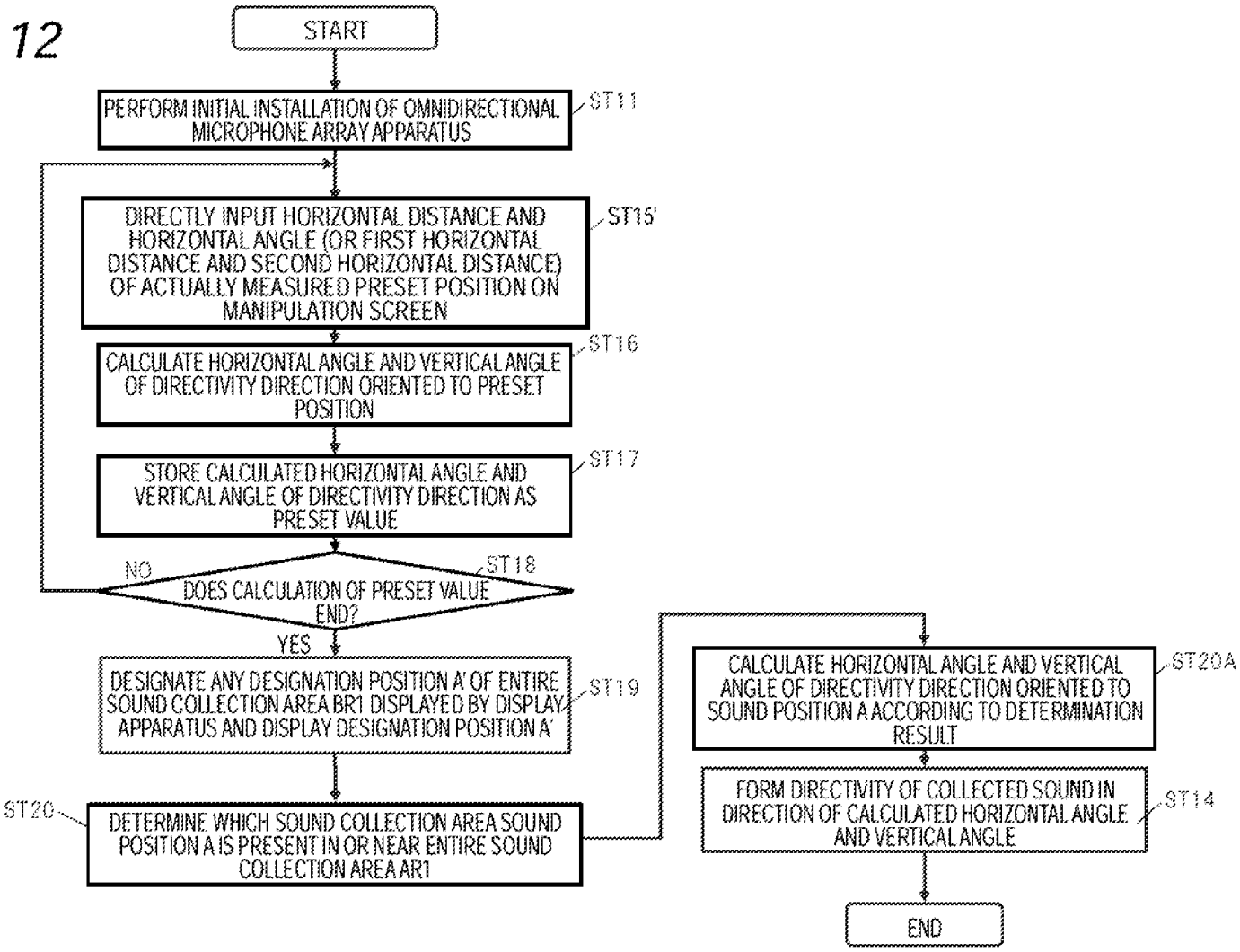
FIG. 12 is a flowchart for describing an operation order of the directivity control system when values of (horizontal distance, horizontal angle) or (first horizontal distance, second horizontal distance) of preset positions actually measured in advance are directly input on a predetermined manipulation screen according to the second embodiment.

In step ST15, the setting of the preset designation position may be directly input on a predetermined manipulation screen from the manipulation unit 32 without using the preset designation position setting screen illustrated in FIG. 9B (see step ST15' illustrated in FIG. 12). FIG. 12 is a flowchart for describing an operation order of the directivity control system when the value of (horizontal distance, horizontal angle) or (first horizontal distance, second horizontal distance) of the preset position actually measured in advance is directly input on a predetermined manipulation screen according to the second embodiment.

FIG. 14A is a diagram illustrating an example of a preset table according to the second embodiment. The preset table illustrated in FIG. 14A includes a preset position, a sound collection area in which the preset position is set as a representative sound collection position, and the directivity direction (preset value) oriented from the omnidirectional microphone array apparatus 2 to the preset position.

Next, a process of forming the directivity in the directivity direction oriented from the omnidirectional microphone array apparatus 2 to the sound position A illustrated in FIG. 10A after step ST17 will be described.

The directivity control apparatus 3 causes the display apparatus 36 to display the sound position designation screen illustrated in FIG. 10B in response to an input manipulation of the user. The directivity control apparatus 3 receives the designation of the arbitrary destination position A on the sound position designation screen displayed by the display apparatus 36 via the manipulation unit 32 (ST19).

After step ST19, based on the coordinate data of the designation position A' acquired in step ST19, the directivity direction calculation unit 34 of the directivity control apparatus 3 determines which sound collection area the sound position A corresponding to the designation position A' is present in or near the entire sound collection area AR1 (ST20).

The directivity direction calculation unit 34 of the directivity control apparatus 3 calculates the horizontal angle and the vertical angle ($\theta_{MAh}$, $\theta_{MAv}$) of the directivity direction oriented from the omnidirectional microphone array apparatus 2 to the actual sound position A according to the determination result of step ST20 (ST20A). Here, when the determination result of step ST20 is one of the following three methods, a calculation example of step ST20A will be described.

That is, the determination result of step ST20 is one of the following cases:

(determination result 1) a case in which a position determined by the coordinate data of the designation position A' on the sound position designation screen is included in a position in a range of one sound collection area;

(determination result 2) a case in which a position determined by the coordinate data of the designation position A' on the sound position designation screen is included in a position between ranges of two adjacent sound collection areas; and (determination result 3) a case in which distances between a position on the sound position designation screen determined by the coordinate data of the designation position A' and the preset designation positions of a plurality of sound collection areas (for example, n sound collection areas and n is an integer equal to or greater than 3) are equal.

The range of the sound collection area is, for example, an area of a circle or an ellipse of a radius prearranged for each sound collection area and is assumed to be stored in advance in the memory 38 at the time of the initial setting.

Accordingly, when the determination result of step ST20 is the above-described (determination result 1), the directivity direction calculation unit 34 of the directivity control apparatus 3 calculates the preset value of the preset position within the range of the corresponding sound collection area as the horizontal angle and the vertical angle ($\theta_{MAh}$, $\theta_{MAv}$) of the directivity direction.

When the determination result of step ST20 is the above-described (determination result 2), the directivity direction calculation unit 34 of the directivity control apparatus 3 selects the sound collection area, for which the distance between the designation position A' and the preset designation position is closer, between two sound collection areas adjacent to each other and calculates the preset value of the preset position within the range of the selected sound collection area as the horizontal angle and the vertical angle ($\theta_{MAh}$, $\theta_{MAv}$) of the directivity direction.

When the determination result of step ST20 is the above-described (determination result 3), the directivity direction calculation unit 34 of the directivity control apparatus 3 adds and averages the preset values of the preset positions within the ranges of all (for example, n) of the sound collection areas for which the distance between the designation positions A and the preset designation positions on the sound position designation screen are equal and calculates the averaged value as the horizontal angle and the vertical angle ($\theta_{MAh}$, $\theta_{MAv}$) of the directivity direction (see Equation (6)).

[Equation 6]

$$(\theta_{MAh}, \theta_{MAv}) = \left(\frac{1}{n}\sum_{i=1}^{n}\theta_{ih}, \frac{1}{n}\sum_{i=1}^{n}\theta_{iv}\right) \quad (6)$$

In Equation 6, $\theta_{ih}$ indicates the horizontal angles of the preset values of the preset positions within the ranges of all (for example, n) of the sound collection areas for which the distances between the designation positions A' and the preset designation positions are equal. Further, $\theta_{iv}$ indicates the vertical angles of the preset values of the preset positions within the ranges of all (for example, n) of the sound collection areas for which the distances between the designation positions A' and the preset designation positions are equal.

Thus, the directivity control apparatus 3 can simply calculate the directivity direction oriented from the omnidirectional microphone array apparatus 2 to the sound position A corresponding to the arbitrary designation position A' designated on the preset designation position setting screen by the user.

The output control unit 35 of the directivity control apparatus 3 transmits a directivity forming instruction including data of the coordinates ($\theta_{MAh}$, $\theta_{MAv}$) indicating the directivity direction calculated in step ST20 to the omnidirectional microphone array apparatus 2. The omnidirectional microphone array apparatus 2 forms the directivity of each of the microphone units 22 and 23 in the sound collection direction of the coordinates ($\theta_{MAh}$, $\theta_{MAv}$) calculated by the directivity control apparatus 3 in response to the directivity forming instruction from the directivity control apparatus 3 (ST14).

Thus, the omnidirectional microphone array apparatus 2 can relatively increase the volume level of the sound data collected in the sound collection direction decided by the sound collection direction coordinates ($\theta_{MAh}$, $\theta_{MAv}$) in which the directivity is formed and can relatively reduce the volume level of the sound data collected in the direction in which no directivity is formed.

In the directivity control system 10 according to the embodiment, as described above, the display apparatus 36 displays the preset designation position setting screen used to set the directivity direction oriented from the omnidirectional microphone array apparatus 2 to the prearranged preset position within one or more sound collection areas. The directivity direction calculation unit 34 of the directivity control apparatus 3 calculates the horizontal angle and the vertical angle from the omnidirectional microphone array apparatus 2 to the preset position corresponding to the designated preset designation position according to the designation of the preset designation position on the preset designation position setting screen displayed by the display apparatus 36, and then stores the horizontal angle and the vertical angle as the preset value. The output control unit 35 of the directivity control apparatus 3 forms the directivity of the collected sound based on the calculated horizontal angle and vertical angle. Further, when the arbitrary designation position A' is designated on the sound position designation screen displayed by the display apparatus, the directivity direction calculation unit 34 of the directivity control apparatus 3 calculates the horizontal angle and the vertical angle of the directivity direction oriented to an arbitrary sound position A designated by the user based on the determination result obtained by determining in which area of one or more sound collection areas the designation position A' is present and based on the horizontal angle and the vertical angle of the directivity direction calculated for each preset position within one or more sound collection areas on the preset position designation setting screen. The output control unit 35 of the directivity control apparatus 3 forms the directivity of the collected sound based on the calculated horizontal angle and vertical angle.

Thus, in the directivity control system 10, the directivity control apparatus 3 can simply calculate the horizontal angle and the vertical angle indicating the directivity direction oriented from the omnidirectional microphone array apparatus 2 to the preset position corresponding to the preset designation position designated on the preset designation position setting screen. The directivity control apparatus 3 can form the directivity in which a clear sound of a target which the user desires to hear is output based on the calculated horizontal angle and vertical angle of the directivity direction, and thus can output the clear sound of the target present in the corresponding sound position A. The directivity control apparatus 3 can calculate the horizontal angle and the vertical angle of the directivity direction oriented to the arbitrary sound position A designated on the sound position designation screen by the user based on the horizontal angle and the vertical angle of the directivity direction calculated for each preset position, can form the directivity in the directivity direction, and thus can output the clear sound in the directivity direction oriented to the arbitrary sound position desired by the user.

In the embodiment, the horizontal angle and the vertical angle of the directivity direction are stored as the preset value in the memory 38. However, as in FIG. 14B or 14C, the coordinate data of (horizontal distance, horizontal angle) or (first horizontal distance, second horizontal distance) actually measured in advance may be stored in the memory 38. FIG. 14B is a diagram illustrating an example of a preset table when the value of (horizontal direction, horizontal angle) of the preset position actually measured in advance is stored as the preset value according to the second embodiment. FIG. 14C is a diagram illustrating an example of a preset table when the value of (first horizontal distance, second horizontal distance) of the preset position actually measured in advance is stored as the preset value according to the second embodiment. FIG. 14D is a diagram illustrating an example of a preset table when a plurality of directivity directions in the preset table illustrated in FIG. 14B are included as the preset values. When the plurality of directivity directions are used as the preset values, the directivity control apparatus 3 calculates the directivity direction to form the directivity using a geometric average of the plurality of directivity directions.

Figure 13:
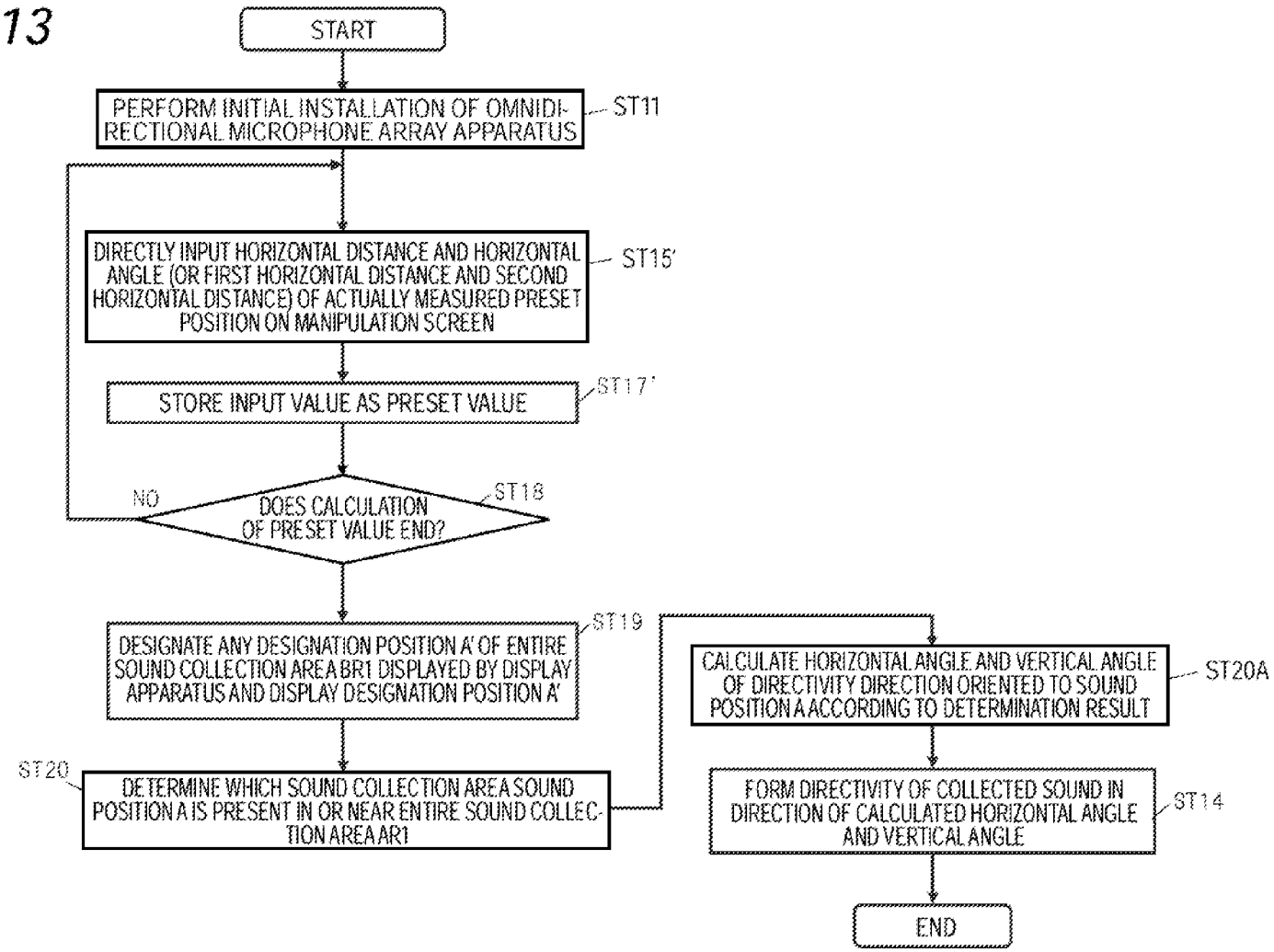
FIG. 13 is a flowchart for describing an operation order of the directivity control system when the values of (the horizontal distance and the horizontal angle) or (the first horizontal distance and the second horizontal distance) at the preset positions input on the predetermined manipulation screen are stored as preset values according to the second embodiment.

For example, in step ST20, the directivity direction calculation unit 34 calculates coordinates (horizontal angle, vertical angle) indicating the directivity direction based on the preset values illustrated in FIG. 14B or 14C (see FIG. 13). The directivity control apparatus 3 may additionally store information (for example, the delay time in the delay unit (see FIG. 5) installed to correspond to each microphone) necessary for the directivity control apparatus 3 to form the directivity as the preset value. FIG. 13 is a flowchart for describing an operation order of the directivity control system when values of (horizontal distance, horizontal angle) or (first horizontal distance, second horizontal distance) of the preset positions input on a predetermined manipulation screen are stored as the preset values according to the second embodiment.

Third Embodiment

Figures 15A, 15B:
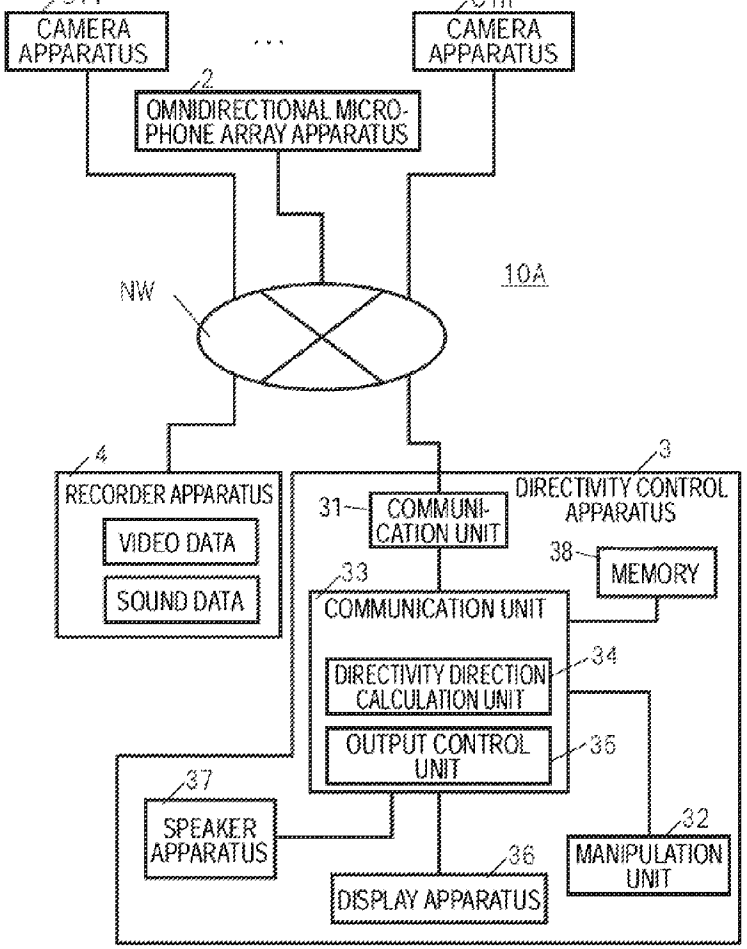
FIG. 15A is a block diagram illustrating the inner configuration of a directivity control system according to a third embodiment.
FIG. 15B is a diagram illustrating an example of a preset table according to the third embodiment.

In a directivity control system 10A according to a third embodiment, one or more camera apparatuses C11 to C1n are further included in addition to the configuration of the directivity control system 10 according to the second embodiment (see FIG. 15A). When one sound collection area is selected from one or more sound collection areas, a directivity control apparatus 3 causes a display apparatus 36 to display a preset position of the selected sound collection area and a captured video captured by the camera apparatuses corresponding to the selected sound collection area. In the directivity control system 10A according to the third embodiment, when one preset designation position in the captured video of the camera apparatus displayed by the display apparatus 36 is designated, the directivity control apparatus 3 reads a directivity direction (preset value) oriented from a omnidirectional microphone array apparatus 2 to the preset position corresponding to the preset designation position from a memory 38 and forms directivity.

FIG. 15A is a block diagram illustrating the inner configuration of the directivity control system 10A according to the third embodiment. FIG. 15B is a diagram illustrating an example of a preset table according to the third embodiment. The directivity control system 10A illustrated in FIG. 15A includes one or more camera apparatuses C11 to C1n, the omnidirectional microphone array apparatus 2, the directivity control apparatus 3, and a recorder apparatus 4.

In an operation of each unit of the omnidirectional microphone array apparatus 2, the directivity control apparatus 3 and the recorder apparatus 4 included in the directivity control system 10A according to the embodiment, the same reference numerals are given to the same content as the operation of each unit of the omnidirectional microphone array apparatus 2, the directivity control apparatus 3, and the recorder apparatus 4 included in the directivity control system 10 according to the second embodiment, description will be omitted or simplified, and other content will be described.

Each of the camera apparatuses C11 to C1n has a function of a monitoring camera, has a casing including an optical system (for example, a wide-angle lens) and an imaging system (for example, an image sensor) (none of which is illustrated), and is installed on a predetermined installation surface (for example, a ceiling surface in a store). Each of the camera apparatuses C11 to C1n is connected to a host computer (not illustrated) of a central control room via a network (not illustrated) and performs a pan-direction operation, a tilt-direction operation, a zoom operation, an imaging operation on a video within the range of a predetermined angle of view, and the like in response to a remote manipulation from the host computer. Each of the camera apparatuses C11 to C1n transmits captured-video data to the directivity control apparatus 3 or the recorder apparatus 4 via a network NW.

Figure 16B:
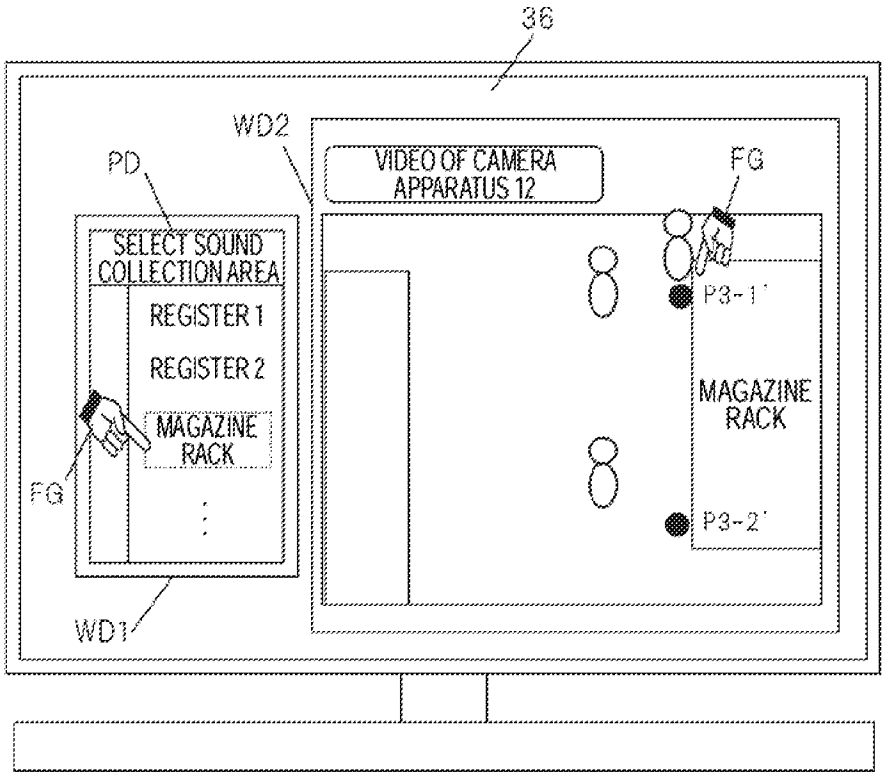
FIG. 16B is a diagram illustrating a sound collection area selection screen and a captured-video display screen indicating a captured video of the camera apparatus corresponding to a selected sound collection area.
Figure 16A:
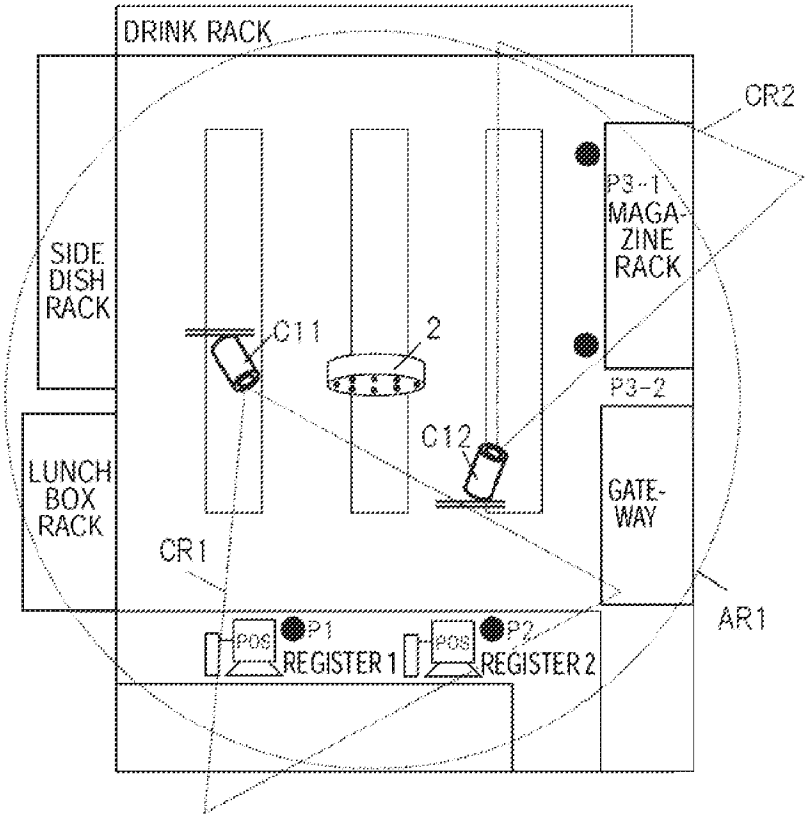
FIG. 16A is a preset designation position diagram illustrating an example of a plurality of preset positions P1, P2, P3-1, and P3-2 in an entire sound collection area AR1 and imaging ranges of each camera apparatus.

In the embodiment, an imaging range of a video in each of the camera apparatuses C11 to C1n is determined in advance in the preset table illustrated in FIG. 15B for every one or more sound collection areas or every plurality of sound collection areas of an entire sound collection area AR1 in the store illustrated in FIG. 16A. The preset table illustrated in FIG. 15B is stored in the memory 38. In the preset table illustrated in FIG. 15B, the camera apparatus C11 captures a video of preset positions P1 and P2 of sound collection areas, "register 1" and "register 2," and the camera apparatus C12 captures a video of preset positions P3-1 and P3-2 of a sound collection area, "magazine rack." The preset values of the preset table illustrated in FIG. 15B are values calculated according to the method (for example, see steps ST15 to ST17 of FIG. 11) described in the second embodiment.

FIG. 16A is a preset designation position diagram illustrating an example of the plurality of preset positions P1, P2, P3-1, and P3-2 in the entire sound collection area AR1 and imaging ranges of the camera apparatuses C11 and C12. FIG. 16B is a diagram illustrating a sound collection area selection screen WD1 and a captured-video display screen WD2 indicating a captured video of the camera apparatus C12 corresponding to the selected sound collection area.

In the preset designation position diagram illustrated in FIG. 16A, the camera apparatuses C11 and C12 and imaging ranges CR1 and CR2 of the camera apparatuses C11 and C12 are additionally illustrated in addition to the content of the preset designation position diagram illustrated in FIG. 9A. The signal processing unit 33 may cause the display apparatus 36 to display the preset designation position diagram illustrated in FIG. 16A in response to an input manipulation of the user, for example, when the directivity control apparatus 3 calculates a preset value (for example, coordinates (horizontal angle, vertical angle) indicating the directivity direction) at the preset position. The imaging range CR1 of the camera apparatus C11 includes a preset designation position P1' corresponding to the preset position P1 and a preset designation position P2' corresponding to the preset position P2. The imaging range CR2 of the camera apparatus C12 includes a preset designation position P3-1' corresponding to the preset position P3-1 and a preset designation position P3-2' corresponding to the preset position P3-2.

On a sound collection area selection screen WD1 illustrated in FIG. 16B, one or more sound collection areas in the entire sound collection area AR1 illustrated in FIG. 16A are displayed to be selectable. Here, for example, when "magazine rack" is selected with the finger FG of the user on the sound collection area selection screen WD1, the signal processing unit 33 of the directivity control apparatus 3 determines the involved camera apparatus, "camera apparatus C12," corresponding to the sound collection area, "magazine rack," of the preset table illustrated in FIG. 15B and displays a captured video of the camera apparatus C12 on the captured-video display screen WD2 of the display apparatus 36. When the signal processing unit 33 displays the captured video of the camera apparatus C12 on the captured-video display screen WD2 of the display apparatus 36, the signal processing unit 33 of the directivity control apparatus 3 displays the preset designation positions, "P3-1' and P3-2'," corresponding to the preset positions, "P3-1 and P3-2," in the sound collection area "magazine rack," together.

Figure 17:
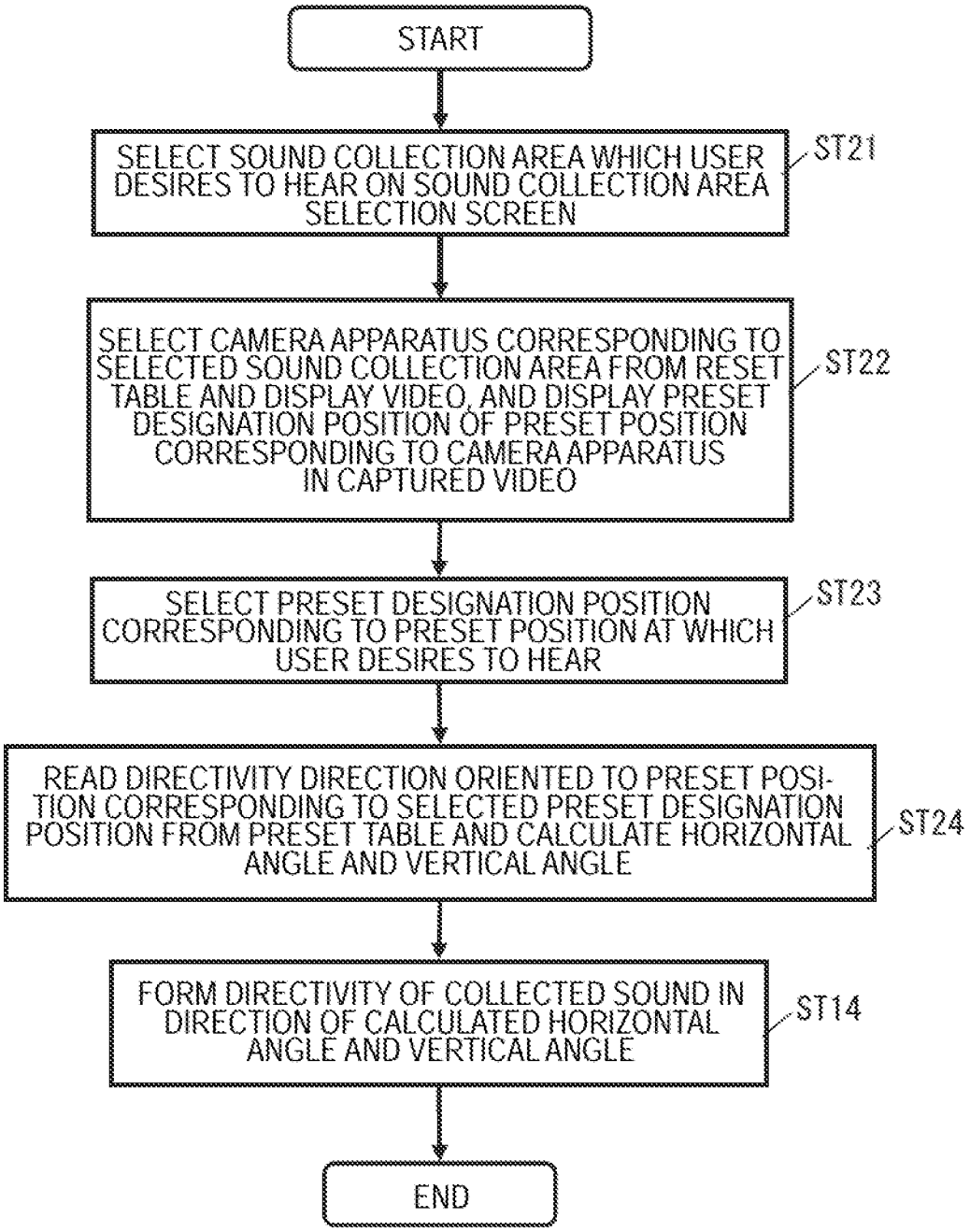
FIG. 17 is a flowchart for describing an operation order of the directivity control system according to the third embodiment.

Next, the detailed operation order of the directivity control system 10A according to the embodiment will be described with reference to FIG. 17. FIG. 17 is a flowchart for describing an operation order of the directivity control system 10A according to the third embodiment. As the assumption of the description of FIG. 17, the preset values (see FIG. 15B) of all of the preset positions P1, P2, P3-1, and P3-2 in the entire sound collection area AR1 illustrated in FIG. 16A are assumed to be calculated in advance according to the calculation method (for example, see steps ST15 to ST17 of FIG. 11) described in the second embodiment.

In FIG. 17, the signal processing unit 33 of the directivity control apparatus 3 causes the display apparatus 36 to display the sound collection area selection screen WD1 used to select a sound collection area in which the user desires to hear the sound in response to, for example, an input manipulation of the user. On the sound collection area selection screen WD1 illustrated in FIG. 16B, a sound collection area (for example, "magazine rack") which the user desires to hear is selected through an input manipulation by the user (ST21).

When the sound collection area (for example, "magazine rack") in which the user desires to hear the sound is selected, the signal processing unit 33 of the directivity control apparatus 3 reads the preset table (see FIG. 15B) stored in the memory 38 and determines the involved camera apparatus (for example, the camera apparatus C12) corresponding to the selected sound collection area in step ST21. The signal processing unit 33 of the directivity control apparatus 3 displays the captured video of the determined involved camera apparatus (for example, the camera apparatus C12) on the captured-video display screen WD2 of the display apparatus 36 and displays the preset designation positions (for example, the preset designation positions P3-1' and P3-2') of the preset positions (for example, the preset positions P3-1 and P3-2) corresponding to the selected sound collection area (for example, "magazine rack") on the captured-video display screen WD2 (ST22, see FIG. 16B).

Here, on the captured-video display screen WD2 displayed by the display apparatus 36, the preset designation position (for example, the preset designation position P3-1') corresponding to the preset position at which the user desires to hear the sound is selected through an input manipulation by the user (ST23).

When the preset designation position (for example, the preset designation position P3-1') corresponding to the preset position at which the user desires to hear the sound is selected, the signal processing unit 33 of the directivity control apparatus 3 reads the directivity direction (preset value) oriented from the omnidirectional microphone array apparatus 2 to the preset position (for example, the preset position P3-1) corresponding to the selected preset designation position (for example, the preset designation position P3-1') from the preset table (ST24).

The output control unit 35 of the directivity control apparatus 3 transmits a directivity forming instruction including data of the coordinates ($\theta_{MAh}$, $\theta_{MAv}$) (=($\theta_{h31}$, $\theta_{v31}$)) indicating the preset value read in step ST24 to the omnidirectional microphone array apparatus 2. The omnidirectional microphone array apparatus 2 forms the directivity of each of the microphone units 22 and 23 in the sound collection direction of the coordinates ($\theta_{MAh}$, $\theta_{MAv}$) calculated by the directivity control apparatus 3 in response to the directivity forming instruction from the directivity control apparatus 3 (ST14).

Thus, the omnidirectional microphone array apparatus 2 can relatively increase the volume level of the sound data collected in the directivity direction oriented to the specific preset position (for example, the preset position P3-1) in the sound collection area in which the user desires to hear the sound and can relatively decrease the volume level of the sound data collected in a direction not oriented from the omnidirectional microphone array apparatus 2 to the preset position.

In the directivity control system 10A according to the embodiment, as described above, one or more camera apparatuses C11 to C1n (where n is an integer equal to or greater than 2) capture videos in the ranges of predetermined different sound collection areas. The display apparatus 36 displays the sound collection area selection screen WD1 used to select one sound collection area from one or more sound collection areas and the captured-video display screen WD2 used to display the captured video of the camera apparatus including the preset position corresponding to the selected sound collection area. The output control unit 35 of the directivity control apparatus 3 forms the directivity of the collected sound based on the horizontal angle and the vertical angle of the directivity direction at each preset position stored in the memory 38 according to the selection of the preset designation position in the captured video displayed on the captured-video display screen WD2 of the camera apparatus.

Thus, in the directivity control system 10A, the directivity control apparatus 3 can allow the user to visually confirm the location of the preset position corresponding to the sound collection area selected on the sound collection area selection screen WD1 displayed by the display apparatus 36 in the captured video of the involved camera apparatus, can form the directivity of the sound in the directivity direction oriented to the preset position corresponding to the sound collection area desired by the user, and thus can output the clear sound of the target present at the preset position.

Fourth Embodiment

Figures 18A, 18B:
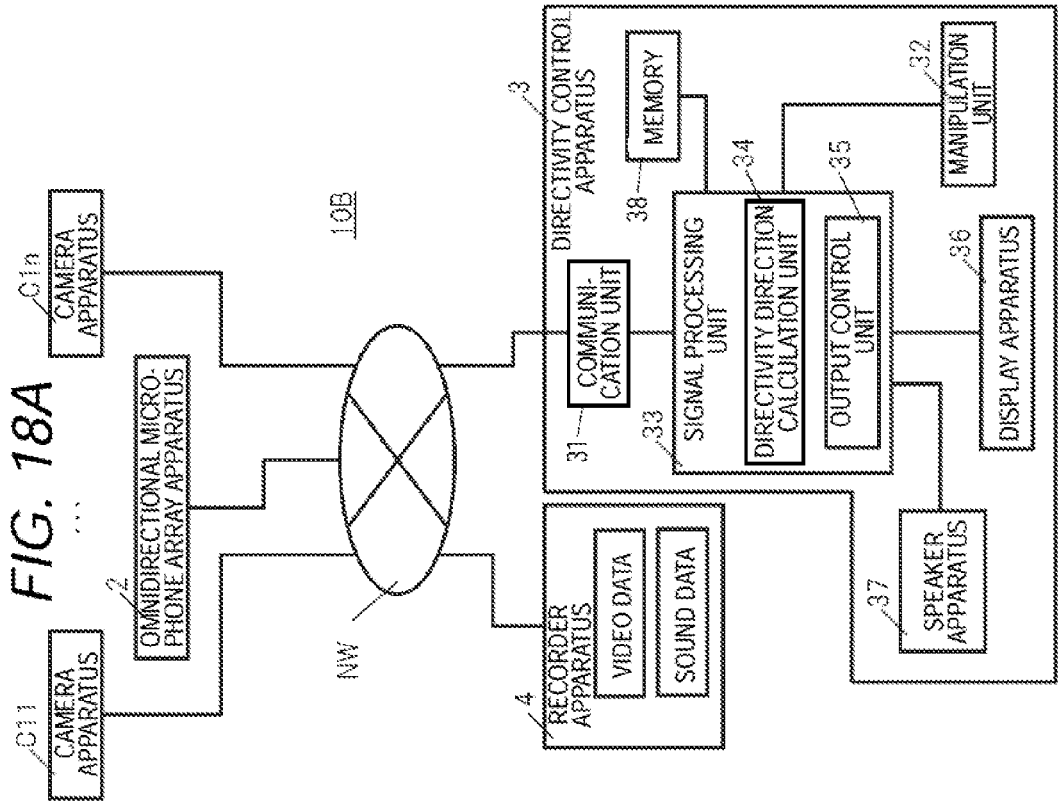
FIG. 18A is a block diagram illustrating the inner configuration of a directivity control system according to a fourth embodiment.
FIG. 18B is a diagram illustrating an example of a preset table according to the fourth embodiment.

In a directivity control system 10B according to the fourth embodiment, captured images of camera apparatuses C11 to C1n correspond to directivity in a one-to-one manner (see FIG. 18B). When one camera apparatus is selected from one or more camera apparatuses, the directivity control apparatus 3 causes the display apparatus 36 to display a captured video of the selected camera apparatus. The directivity control apparatus 3 reads a directivity direction oriented to a preset position according to the selected camera video and a directivity control parameter (preset value) from the memory 38 and forms directivity. The directivity control parameter includes a number of microphones used for addition or a weight coefficient at the time of the addition of each microphone, for example, in the directivity forming process by the delay summing scheme described with reference to FIG. 5. Although described in detail below, a target sound can be emphasized or noise can be suppressed by adjusting the directivity control parameter.

FIG. 18A is a block diagram illustrating the inner configuration of the directivity control system 10B according to the fourth embodiment. FIG. 18B is a diagram illustrating an example of a preset table according to the fourth embodiment.

In an operation of each unit of the omnidirectional microphone array apparatus 2, the directivity control apparatus 3 and the recorder apparatus 4 included in the directivity control system 10B according to the embodiment, the same reference numerals are given to the same content as the operation of each unit of the omnidirectional microphone array apparatus 2, the directivity control apparatus 3, and the recorder apparatus 4 included in the directivity control system 10A according to the third embodiment, description will be omitted or simplified, and other content will be described.

Figure 19B:
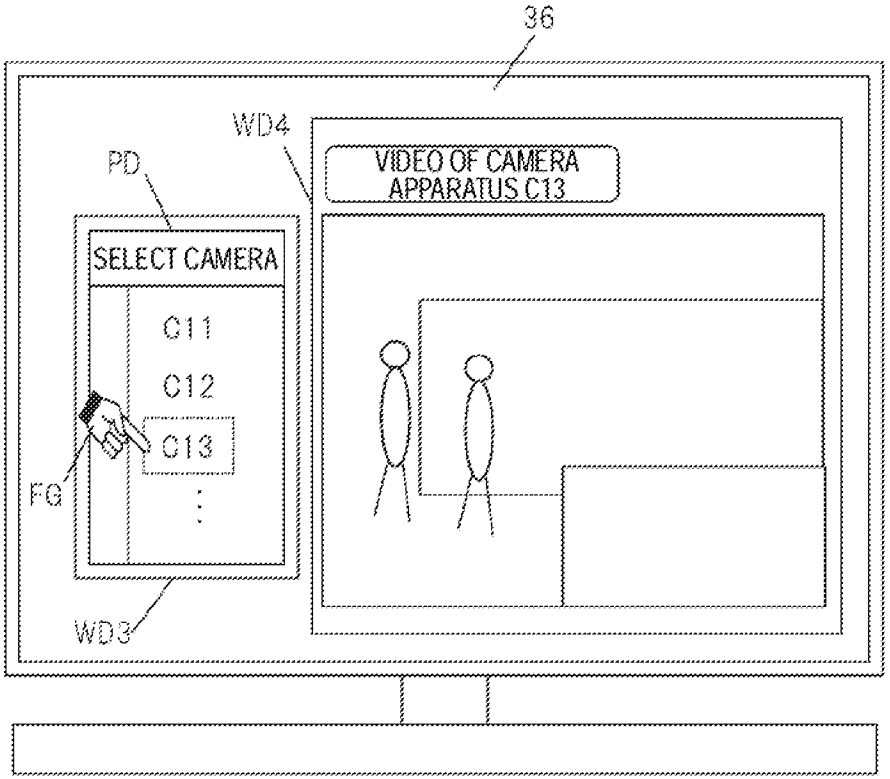
FIG. 19B is a diagram illustrating a camera selection screen and a captured video of a selected camera apparatus.
Figure 19A:
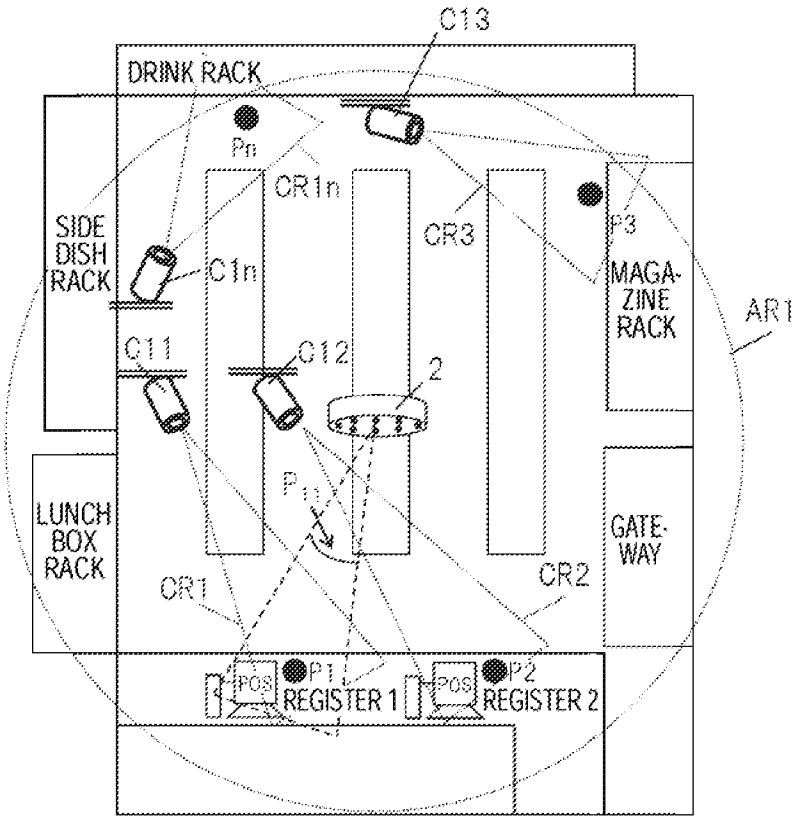
FIG. 19A is a preset designation position diagram illustrating a plurality of preset positions P1, P2, P3, and Pn within an entire sound collection area AR1 and imaging ranges of camera apparatuses.

In the embodiment, one or more sound collections area or a plurality of sound collection areas of the entire sound collection area AR1 in a store illustrated in FIG. 19A is determined in advance in the preset table illustrated in FIG. 18B for each imaging range of a video of each of the camera apparatuses C11 to C1n. The preset table illustrated in FIG. 18B is stored in the memory 38. The preset table illustrated in FIG. 18B shows a correspondent relation among the preset position, the sound collection area, the directivity direction which serves as the preset value, the directivity control parameter, and the involved camera apparatus. Designation of a value of the directivity control parameter and the involved camera apparatus in the preset table illustrated in FIG. 18B is input from the manipulation unit 32 when the preset position is designated according to the method (for example, step ST15 of FIG. 11) described in the second embodiment.

FIG. 19A is a preset designation position diagram illustrating a plurality of preset positions P1, P2, P3, and Pn within the entire sound collection area AR1 and imaging ranges of camera apparatuses. FIG. 19B is a diagram illustrating a camera apparatus selection screen WD3 and a captured-video display screen WD4 showing a captured video of a selected camera apparatus.

In the preset designation position diagram illustrated in FIG. 19A, the camera apparatuses C11, C12, C13, C1n and imaging ranges CR1, CR2, CR3, CRn of the camera apparatuses C11, C12, C13, and C1n are additionally illustrated in addition to the content of the preset designation position diagram illustrated in FIG. 9A. The signal processing unit 33 may cause the display apparatus 36 to display the preset designation position diagram illustrated in FIG. 19A in response to an input manipulation of the user, for example, when the directivity control apparatus 3 calculates a preset value (for example, coordinates (horizontal angle, vertical angle) indicating the directivity direction) at the preset position. The imaging range CR1 of the camera apparatus C11 includes a preset designation position P1' corresponding to the preset position P1. The imaging range CR2 of the camera apparatus C12 includes a preset designation position P2' corresponding to the preset position P2. The imaging range CR3 of the camera apparatus C13 includes a preset designation position corresponding to the preset position P3. The imaging range CRn of the camera apparatus C1n includes a preset designation position corresponding to the preset position Pn.

On the camera apparatus selection screen WD3 illustrated in FIG. 19B, identification numbers (for example, C11, C12, and C13) of the individual camera apparatuses allocated to image the sound collection areas in the entire sound collection area AR1 illustrated in FIG. 19A are displayed to be selectable. Here, for example, when "C13" is selected with the finger FG of the user on the camera apparatus selection screen WD3, the signal processing unit 33 of the directivity control apparatus 3 determines the camera apparatus C13 corresponding to the involved camera apparatus, "C13," of the preset table illustrated in FIG. 18B and displays a captured video of the camera apparatus C13 on the captured-video display screen WD4 of the display apparatus 36.

Figure 20:
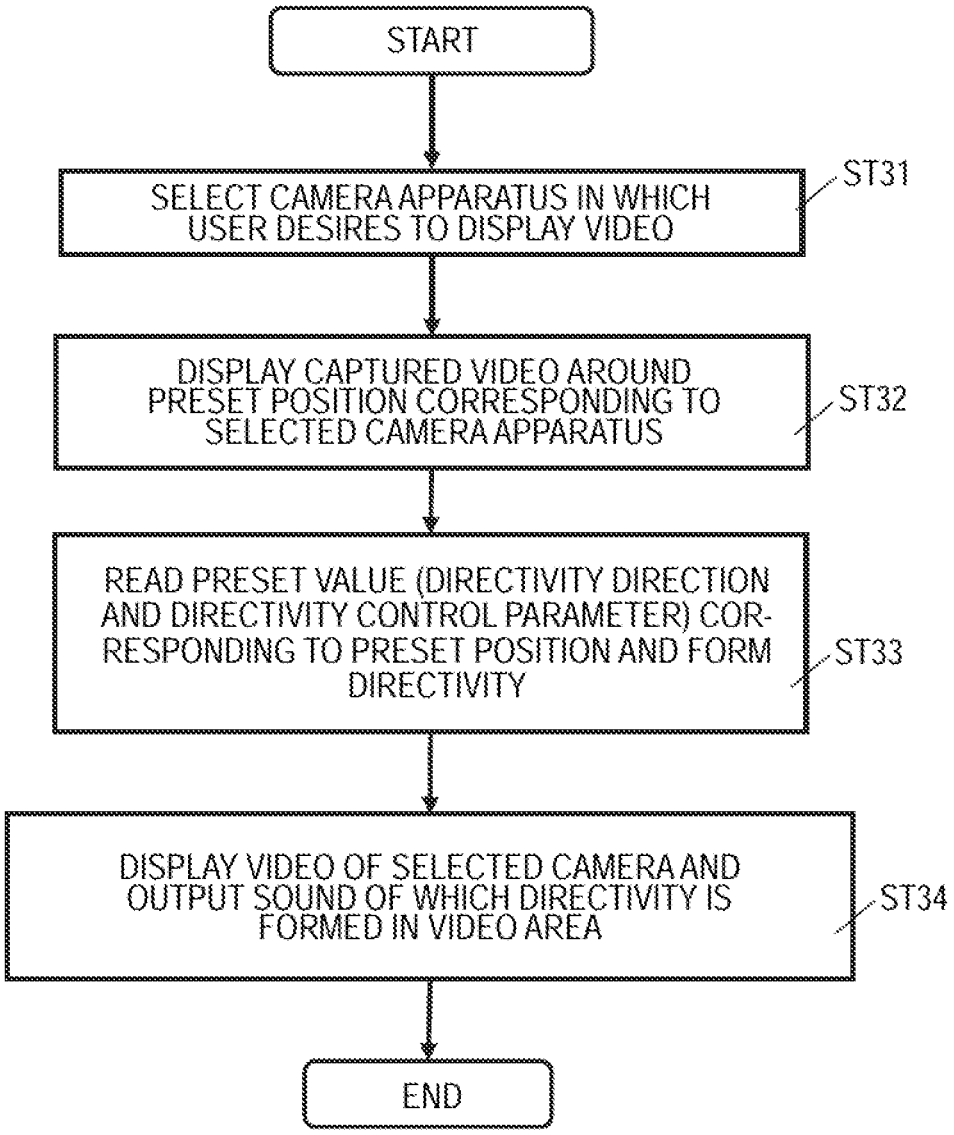
FIG. 20 is a flowchart for describing an operation order of the directivity control system according to the fourth embodiment.

Next, the detailed operation order of the directivity control system 10B according to the embodiment will be described with reference to FIG. 20. FIG. 20 is a flowchart for describing an operation order of the directivity control system 10B according to the fourth embodiment. As the assumption of the description of FIG. 20, the preset values (see FIG. 18B) of all of the preset positions P1, P2, P3, and Pn in the entire sound collection area AR1 illustrated in FIG. 19A are assumed to be calculated in advance according to the calculation method (for example, see steps ST15 to ST17 of FIG. 11) described in the second embodiment.

In FIG. 20, the signal processing unit 33 of the directivity control apparatus 3 causes the display apparatus 36 to display the camera apparatus selection screen WD3 used to select the camera apparatus of which the user desires to display a video in response to, for example, an input manipulation of the user. On the camera apparatus selection screen WD3 illustrated in FIG. 19B, the camera apparatus (for example, "C13") in which the user desires to display the video is selected through an input manipulation by the user (ST31).

When the camera apparatus (for example, "C13") in which the user desires to display the video is selected, the signal processing unit 33 of the directivity control apparatus 3 reads the preset table (see FIG. 18B) stored in the memory 38 and determines the camera apparatus (for example, the camera apparatus C13) selected in step ST31. The signal processing unit 33 of the directivity control apparatus 3 displays the captured video around the preset position (for example, the preset position P3) corresponding to the determined involved camera apparatus (for example, the camera apparatus C13) on the captured-video display screen WD4 of the display apparatus 36 (ST32, see FIG. 19B).

The signal processing unit 33 of the directivity control apparatus 3 reads the directivity direction oriented from the omnidirectional microphone array apparatus 2 to the preset position (for example, the preset position P3) allocated to the selected camera apparatus (for example, the camera apparatus C13) and the directivity control parameter (preset value) from the preset table.

The output control unit 35 of the directivity control apparatus 3 transmits a directivity forming instruction including data of the coordinates ($\theta_{MAh}$, $\theta_{MAv}$) (=($\theta_{h31}$, $\theta_{v31}$)) indicating the preset value read in step ST24 and data of the directivity control parameter to the omnidirectional microphone array apparatus 2. The omnidirectional microphone array apparatus 2 forms the directivity with the range of the directivity control parameter in each of the microphone units 22 and 23 in the sound collection direction of the sound collection direction coordinates ($\theta_{MAh}$, $\theta_{MAv}$) calculated by the directivity control apparatus 3 in response to the directivity forming instruction from the directivity control apparatus 3 (ST33).

The output control unit 35 of the directivity control apparatus 3 outputs the sound collected by the omnidirectional microphone array apparatus 2 from the speaker apparatus 37 after the directivity is formed in the range of the directivity control parameter in step ST33, while displaying the captured video of the camera apparatus (for example, the camera apparatus C13) selected in step ST31 on the captured-video display screen WD4 (ST34).

Thus, the omnidirectional microphone array apparatus 2 can relatively increase the volume level of the sound data collected in the directivity direction oriented to the specific preset position (for example, the preset position P3) in the sound collection area in which the user desires to display the video and can relatively decrease the volume level of the sound data collected in a direction not oriented from the omnidirectional microphone array apparatus 2 to the preset position.

In the directivity control system 10B according to the embodiment, as described above, one or more camera apparatuses C11 to C1n (where n is an integer equal to or greater than 2) each capture a video in the range of one predetermined sound collection area allocated in advance. The display apparatus 36 displays the camera apparatus selection screen WD3 used to select one camera apparatus among one or more camera apparatuses and the captured-video display screen WD4 used to display the captured video of the selected camera apparatus. The output control unit 35 of the directivity control apparatus 3 forms the directivity of the sound with the range of the directivity control parameter based on the data of the directivity direction of the preset position corresponding to the selected camera apparatus and the data of the preset value of the directivity control parameter.

Thus, in the directivity control system 10B, the directivity control apparatus 3 can synchronize the video captured by the camera apparatus selected on the camera apparatus selection screen WD3 displayed by the display apparatus 36 and the sound around the preset position corresponding to the selected camera apparatus so that the user can view the video.

In each of the above-described embodiments, when the user determines the preset position, the user desires to adjust the directivity direction in some cases in order to change the once determined preset position subjectively when the user designates a specific position on the directivity direction designation screen illustrated in FIG. 2A and determines the directivity direction, and then the user hears a sound (or example, a predetermined sound for confirmation (confirmation sound)) of which the directivity is formed in the directivity direction determined by the directivity control apparatus 3. Thus, as illustrated in FIG. 30, the directivity control apparatus 3 may display a directivity direction designation screen including an adjustment interface CTL used to adjust the directivity.

Figure 30:
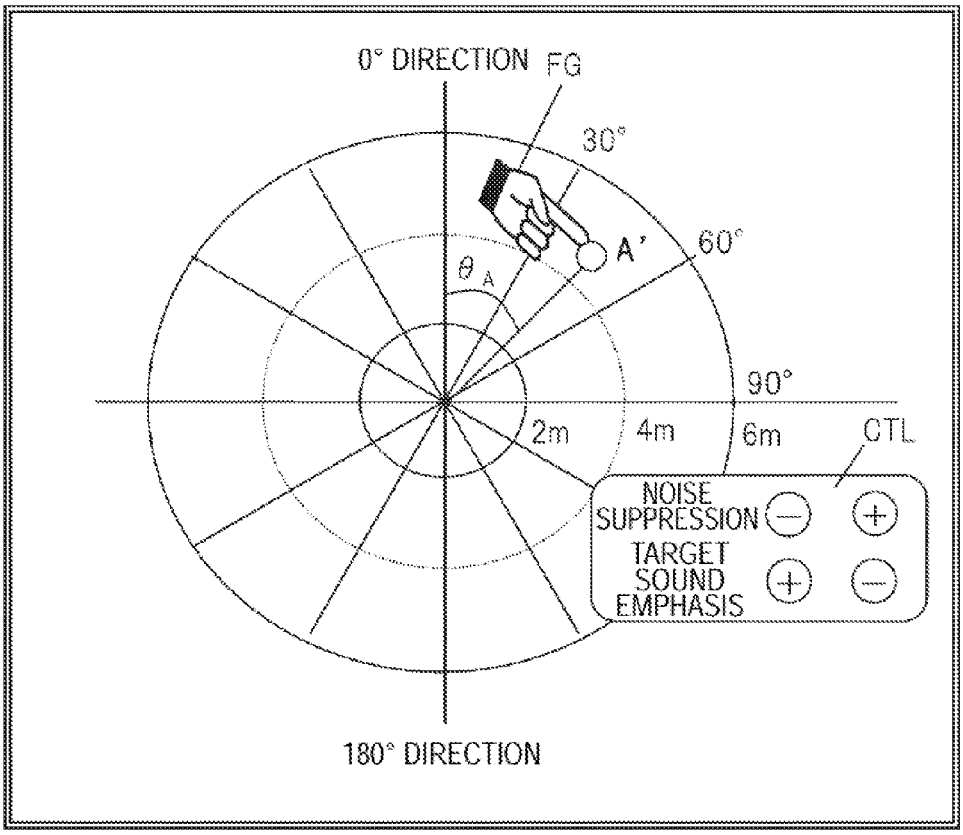
FIG. 30 is a diagram illustrating an example of a directivity direction designation screen in which a control box is displayed to adjust directivity control parameters.

FIG. 30 is a diagram illustrating an example of a directivity direction designation screen in which a control box is displayed to adjust directivity control parameters. For example, the directivity direction designation screen illustrated in FIG. 30 may be displayed through a predetermined manipulation (for example, a predetermined key input manipulation) from the user or may be displayed in advance instead of the directivity direction designation screen illustrated in FIG. 2A by the display apparatus 36.

The adjustment interface CTL shows, for example, a pair of a plus button and a minus button for "noise suppression" and a pair of a plus button and a minus button for "target sound emphasis" as items used to adjust the directivity. When the plus button in "noise suppression" is pressed, the signal processing unit 33 of the directivity control apparatus 3 increases the intensity of "noise suppression" through predetermined signal processing. In contrast, when the minus button in "noise suppression" is pressed, the signal processing unit 33 of the directivity control apparatus 3 decreases the intensity of "noise suppression" through predetermined signal processing.

When the plus button in "target sound emphasis" is pressed, the signal processing unit 33 of the directivity control apparatus 3 raises the volume level of a target sound (for example, a sound of a target output from the speaker apparatus 37) through predetermined signal processing. In contrast, when the minus button in "target sound emphasis" is pressed, the signal processing unit 33 of the directivity control apparatus 3 lowers the volume level of a target sound (for example, a sound of a target output from the speaker apparatus 37) through predetermined signal processing.

Figure 31:
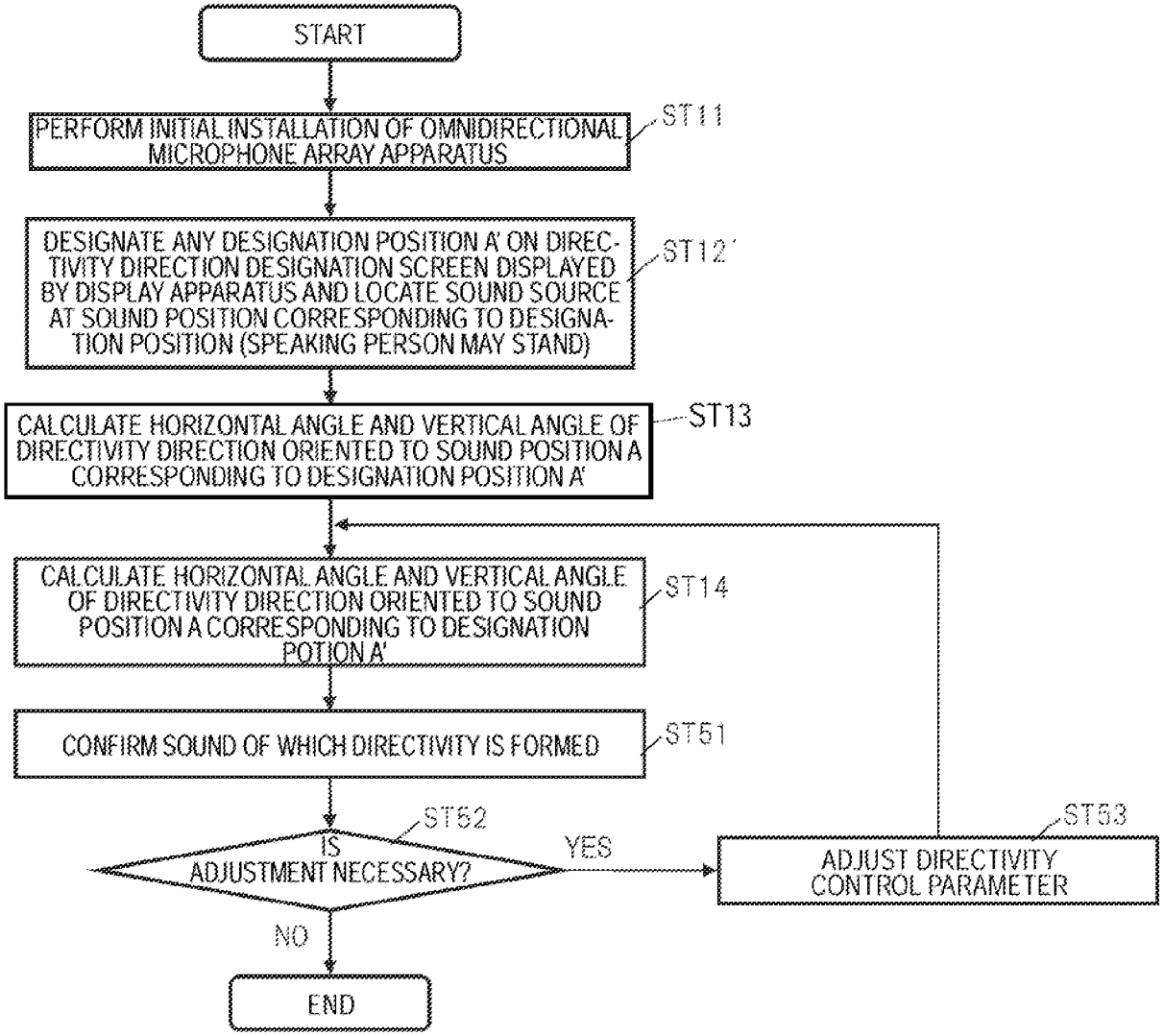
FIG. 31 is a flowchart for describing another operation order of the directivity control system according to the first embodiment.

FIG. 31 is a flowchart for describing another operation order of the directivity control system 10 according to the first embodiment. In the description of FIG. 31, the same step numbers are given to steps in which the same operations as the operations of FIG. 6 are performed, the description thereof will be omitted, and other content will be described.

In FIG. 31, after step ST11, the directivity control apparatus 3 causes the display apparatus 36 to display the directivity direction designation screen illustrated in FIG. 30 in response to an input manipulation of the user. The directivity control apparatus 3 receives designation of the arbitrary designation position A' on the directivity direction designation screen displayed by the display apparatus 36 via the manipulation unit 32 (ST12'). A sound source or a speaking person which is an example of a target is located at a sound position corresponding to the designation position A' (ST12').

Thereafter, the user confirms a sound (for example, a confirmation sound) in the directivity direction in which the directivity is formed in step S14 (ST51). When it is determined that the adjustment of the directivity formed in step ST14 is not necessary (ST52: NO), the operation of the flowchart illustrated in FIG. 30 ends. Conversely, when it is determined that the adjustment of the directivity formed in step ST14 is necessary (ST52: YES), the directivity control apparatus 3 adjusts the directivity control parameter used to adjust the directivity in response to an input manipulation of the user (ST53) and forms the directivity again based on the adjusted directivity control parameter (ST14).

Thus, the display apparatus 36 displays the adjustment interface CTL of the directivity control parameter used to adjust the directivity on the directivity direction designation screen. The directivity control apparatus 3 forms the directivity of the collected sound based on the changed directivity control parameter in response to an input manipulation of the directivity control parameter on the adjustment interface, and thus can form the directivity of the sound suitable for preference or demand of the user, for example, when the user hearing the sound (confirmation sound) of which the directivity is formed once changes and manipulates the adjustment interface.

In each of the above-described embodiments, the present invention is not limited to the case in which the user determines the preset position. The user designates a specific position on the sound position designation screen illustrated in FIG. 10B and determines the directivity direction when actually hearing a sound (when performing), and then subjectively desires to adjust the directivity direction to change the preset position determined once in some cases when the user hears a sound (for example, a predetermined sound (confirmation sound) for confirmation) of which the directivity is formed in the directivity direction determined by the directivity control apparatus 3. Thus, the directivity control apparatus 3 may display a sound position designation screen including the adjustment interface CTL used to adjust the directivity, as illustrated in FIGS. 32A, 32B, 33A, and 33B.

Figure 32B:
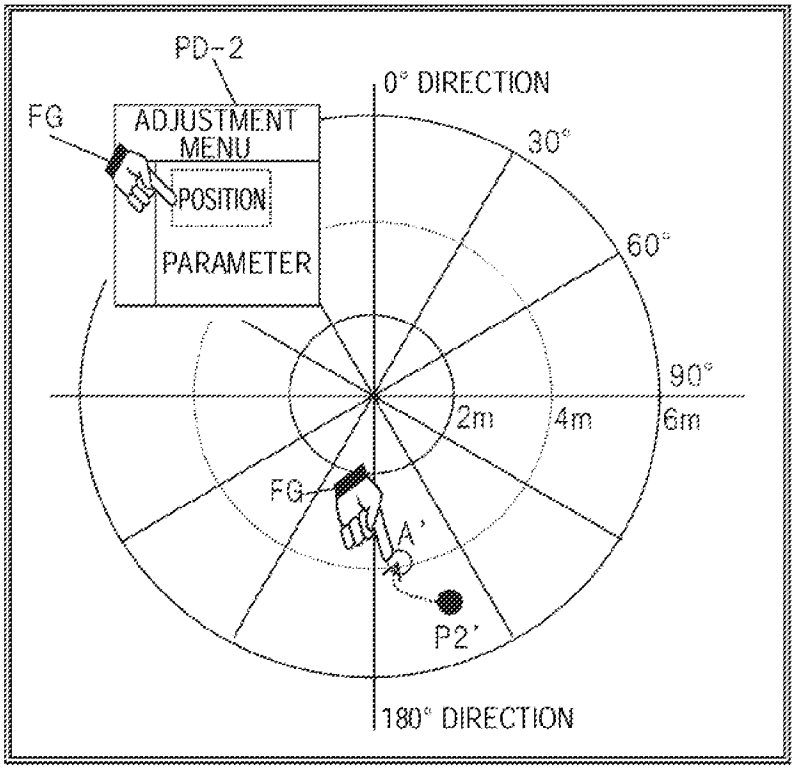
FIG. 32B is a diagram illustrating a first example of the sound position designation screen in which an adjustment menu box is displayed to adjust a preset value.
Figure 32A:
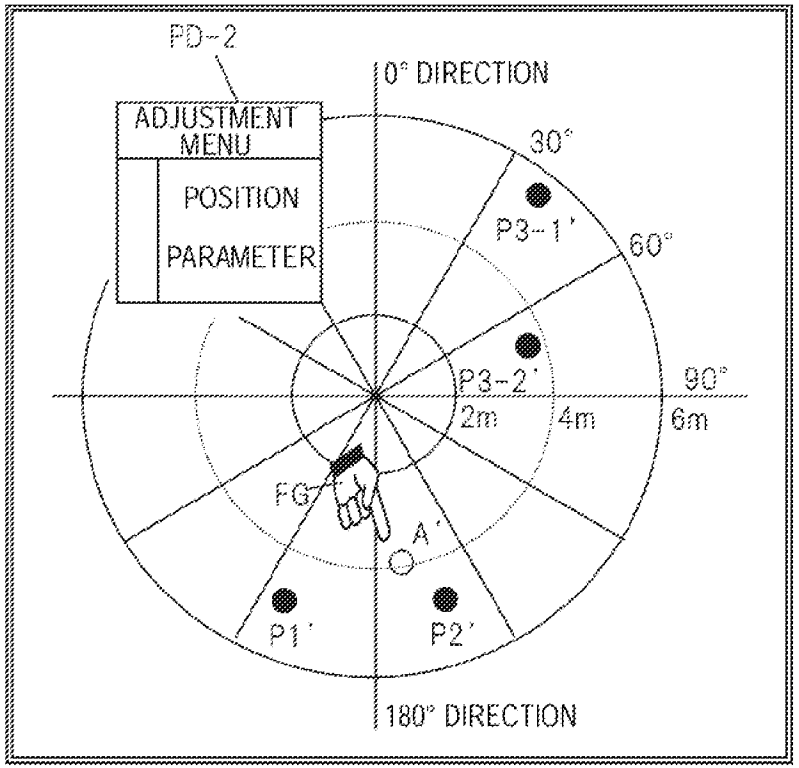
FIG. 32A is a diagram illustrating an example of a sound position designation screen.
Figure 33A:
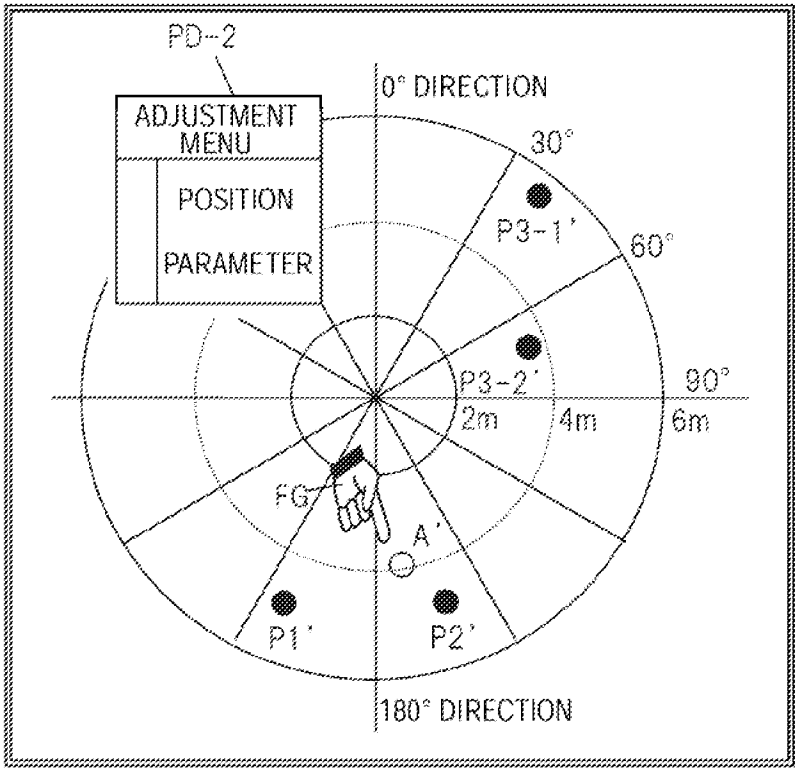
FIG. 33A is a diagram illustrating an example of a sound position designation screen.
Figure 33B:
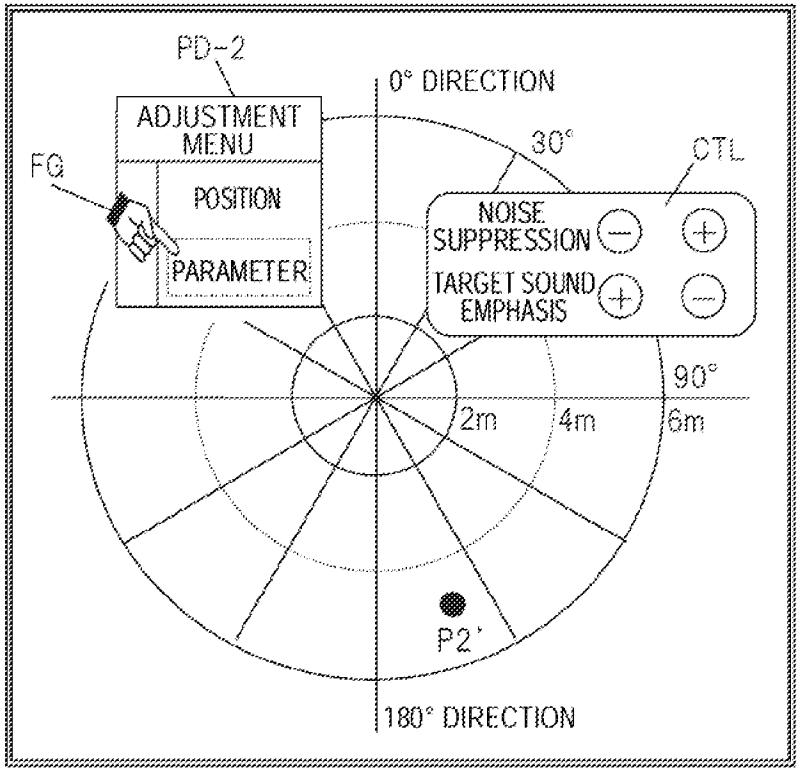
FIG. 33B is a diagram illustrating a second example of the sound position designation screen in which an adjustment menu box is displayed to adjust a preset value.

FIG. 32A is a diagram illustrating an example of a sound position designation screen. FIG. 32B is a diagram illustrating a first example of the sound position designation screen in which an adjustment menu box is displayed to adjust a preset value. FIG. 33A is a diagram illustrating an example of a sound position designation screen. FIG. 33B is a diagram illustrating a second example of the sound position designation screen in which an adjustment menu box is displayed to adjust a preset value.

For example, the sound position designation screen illustrated in FIG. 32A or 33A may be displayed through a predetermined manipulation (for example, a predetermined key input manipulation) from the user or may be displayed in advance instead of the directivity direction designation screen illustrated in FIG. 10B by the display apparatus 36.

When the designation position A' is designated with the finger FG of the user once in FIG. 32A, the directivity control apparatus 3 forms the directivity in the directivity direction oriented to the preset position P2 corresponding to the preset designation position P2' which is the closest to the designation position A' and outputs a sound from the speaker apparatus 37.

Here, when the user subjectively considers changing the preset position P2 and performs, for example, a right-side click manipulation on the sound position designation screen displayed by the display apparatus 36, the directivity control apparatus 3 displays an adjustment menu box PD-2 as an example of the adjustment interface. As shown in FIG. 32B, when "position" of the adjustment menu of the adjustment menu box PD-2 is selected with the finger FG of the user and a movement manipulation (for example, a drag manipulation) is then performed to move the preset designation position from the preset designation position P2' to the designation position A', the directivity control apparatus 3 temporarily changes the preset designation position from the preset designation position P2' to the designation position A'. The designation position A' which is the changed preset designation position may be displayed on the sound position designation screen or may not be displayed.

On the other hand, when the designation position A' is designated with the finger FG of the user once in FIG. 33A, the directivity control apparatus 3 forms the directivity in the directivity direction oriented to the preset position P2 corresponding to the preset designation position P2' which is the closest to the designation position A' and outputs a sound from the speaker apparatus 37.

Here, when the user subjectively considers changing the directivity control parameters of the directivity oriented to the preset position P2 and performs, for example, a right-side click manipulation on the sound position designation screen displayed by the display apparatus 36, the directivity control apparatus 3 displays the adjustment menu box PD-2. As shown in FIG. 33B, when "parameter" of the adjustment menu of the adjustment menu box PD-2 is selected with the finger FG of the user and a manipulation (for example, a touch manipulation) is then performed to press the plus button and the minus button of "noise suppression" and "target sound emphasis" which are the directivity control parameters, the directivity control apparatus 3 temporarily changes the directivity control parameters of the directivity corresponding to the directivity direction oriented to the preset position P2 corresponding to the preset designation position P2'.

Figure 34:
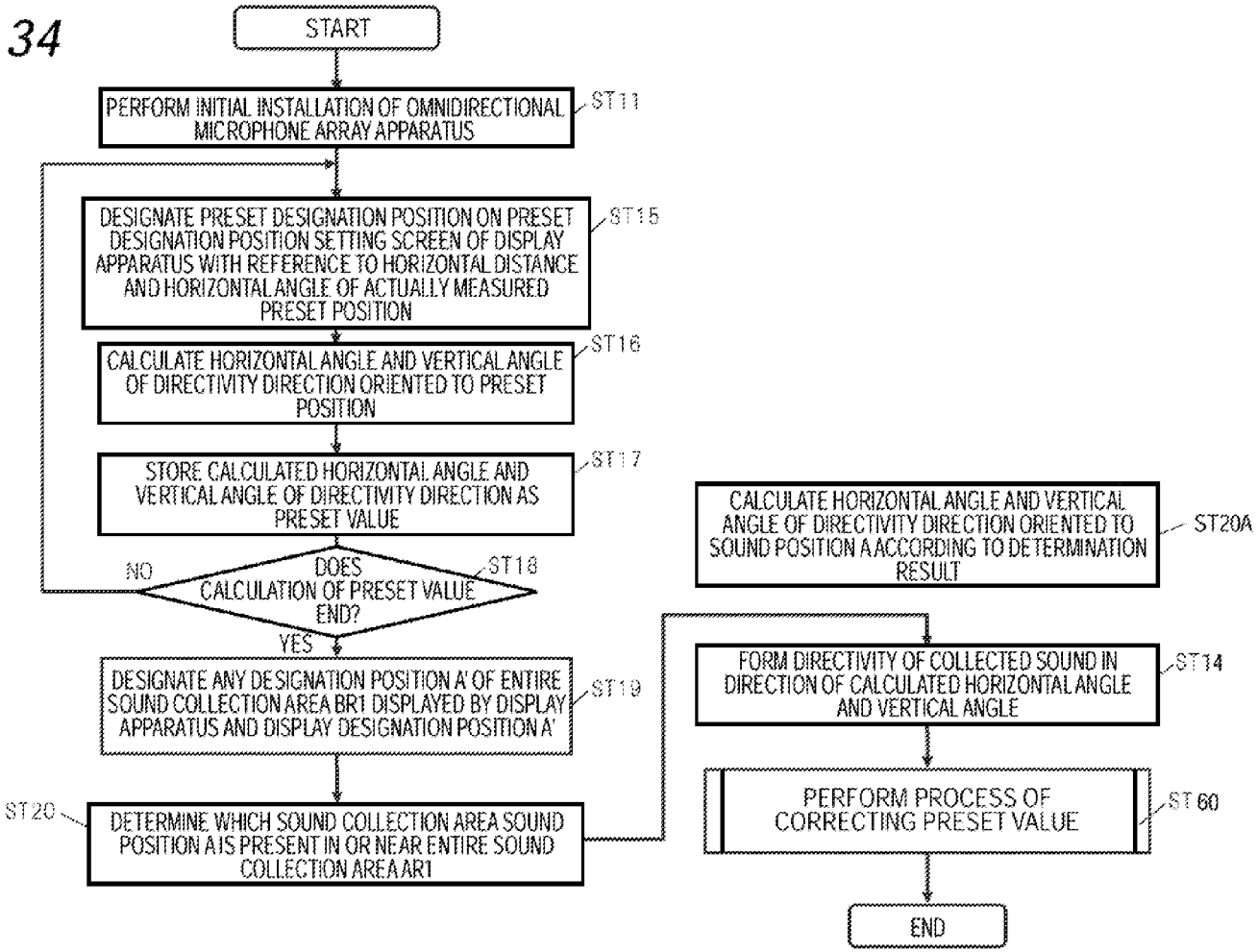
FIG. 34 is a flowchart for describing another operation order of the directivity control system according to the second embodiment.
Figure 35:
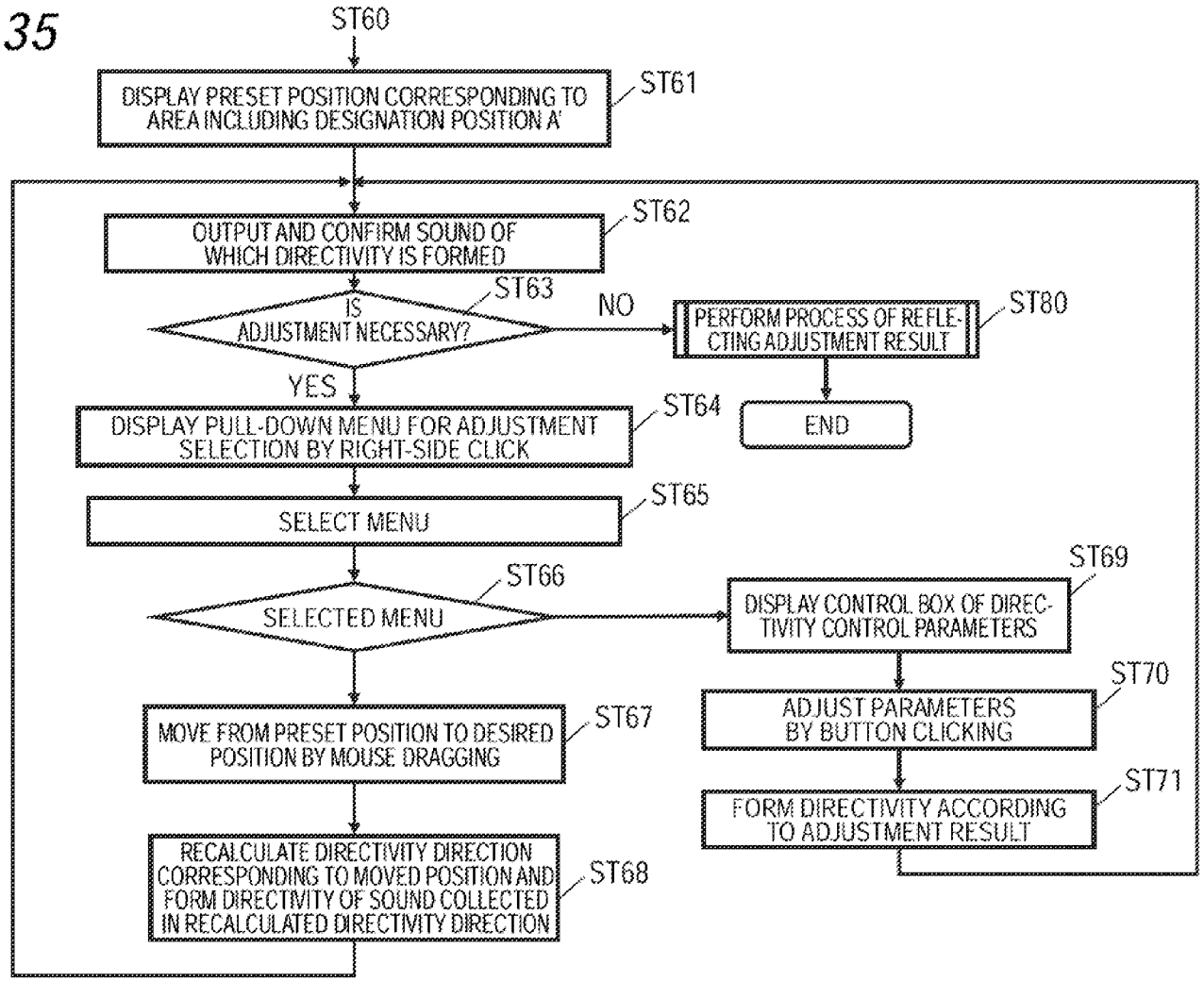
FIG. 35 is a flowchart for describing an operation order of a process of correcting the preset value in FIG. 34.
Figure 36:
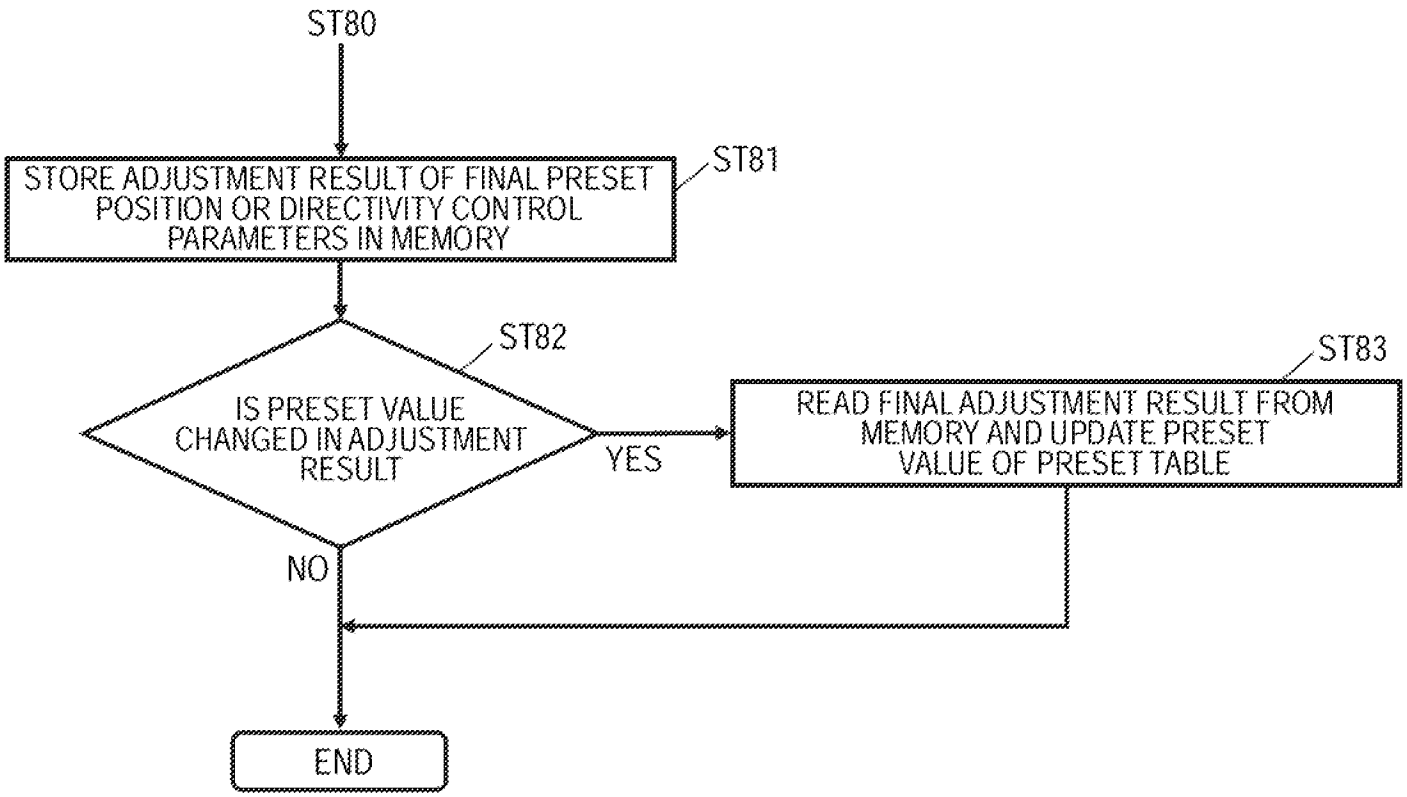
FIG. 36 is a flowchart for describing an operation order of a process of reflecting an adjustment result of the preset value in FIG. 35.

FIG. 34 is a flowchart for describing another operation order of the directivity control system according to the second embodiment. FIG. 35 is a flowchart for describing an operation order of a process of correcting the preset value in FIG. 34. FIG. 36 is a flowchart for describing an operation order of a process of reflecting an adjustment result of the preset value in FIG. 35. In the description of FIG. 34, the same step numbers are given to steps in which the same operations as the operations of FIG. 11 are performed, the description thereof will be omitted, and other content will be described.

In FIG. 34, a process of correcting the preset value is added after step ST14 (ST60). The details of the process of correcting the preset value are illustrated in FIGS. 35 and 36. In FIG. 35, when the designation position A' is designated with the finger FG of the user on the sound position designation screen illustrated in FIG. 32A or 33B, the directivity control apparatus 3 displays the preset position (for example, the preset designation position P2) corresponding to the preset designation position (for example, the preset designation position P2') of an area including the designation position A' (ST61). The directivity control apparatus 3 forms the directivity in the directivity direction oriented to the preset position (for example, the preset position P2) corresponding to the preset designation position (for example, the preset designation position P2') displayed in step ST61 and outputs the sound (ST62). Thus, the sound in regard to the directivity in the directivity direction oriented to the preset position of the user is confirmed.

Here, when it is determined that the change (adjustment) in the preset position or the change (adjustment) in the directivity control parameter of the directivity is not necessary (ST63: NO), the process of correcting the preset value ends via a process (ST80) of reflecting the adjustment result. The process of reflecting the adjustment result will be described in detail in FIG. 36.

Conversely, when it is determined that the change (adjustment) in the preset position or the change (adjustment) in the directivity control parameter of the directivity is not necessary (ST63: YES) and, for example, a right-side click manipulation is performed on the sound position designation screen displayed by the display apparatus 36, the directivity control apparatus 3 displays the adjustment menu box PD-2 (ST64). A manipulation of enabling the adjustment menu of the adjustment menu box PD-2 to be used is assumed to be performed (ST65).

When "position" of the adjustment menu of the adjustment menu box PD-2 is selected with the finger FG of the user ("position" of ST66) and then a movement manipulation (for example, a drag manipulation) is performed to move the preset designation position from the preset designation position P2' to the designation position A' (ST67), the directivity control apparatus 3 temporarily changes the preset designation position from the preset designation position P2' to the designation position A', recalculates the directivity direction oriented to the sound position corresponding to the changed designation position A', and forms the directivity in the recalculated directivity direction (ST68). After step ST68, the process of the directivity control apparatus 3 returns to step ST62.

Conversely, after "parameter" of the adjustment menu of the adjustment menu box PD-2 is selected with the finger FG of the user ("parameter" of ST66), the directivity control apparatus 3 displays the control box CTL on the sound position designation screen to change the directivity control parameters (ST69). When the plus button and the minus button of "noise suppression" and "target sound emphasis" which are the directivity control parameters are subjected to a pressing manipulation (for example, a touch manipulation) with the finger FG of the user (ST70), the directivity control apparatus 3 temporarily changes the directivity control parameters of the directivity corresponding to the directivity direction oriented to the preset position (for example, the preset position P2) corresponding to the preset designation position (for example, the preset designation position P2'), recalculates the directivity direction oriented to the preset position P2 corresponding to the preset designation position P2' based on the changed directivity control parameters, and forms the directivity in the recalculated directivity direction (ST71). After step ST71, the process of the directivity control apparatus 3 returns to step ST62.

In the process of reflecting the adjustment result in step ST80, the directivity control apparatus 3 temporarily stores the final preset position or the adjustment result of the directivity control parameters in the memory 38 (ST81).

After step ST81, when a predetermined manipulation is performed to use the preset position adjusted in the process of correcting the preset value in step ST60 or the directivity control parameters as the preset value (ST81: YES), the directivity control apparatus 3 updates the preset value of the preset table stored in the memory 38 in order to use the adjustment result of the final preset position or the directivity control parameters temporarily stored in step ST81 as the preset value (ST83).

Conversely, when a predetermined manipulation is performed in order not to use the preset position or the directivity control parameters adjusted in the process of correcting the preset value in step ST60 as the preset value (ST81: NO), the adjustment result of the adjustment result of the final preset position or the directivity control parameters is not updated in the preset table and the process of reflecting the adjustment result ends.

Thus, the memory 38 stores the changed directivity control parameters, and the horizontal angle and the vertical angle indicating the directivity direction oriented to the preset position in association with the preset position in the sound collection area. Therefore, it is not necessary for the user to perform a manipulation of changing the control box CTL which is an example of the adjustment interface again, and the directivity control apparatus 3 can simply form the directivity using the changed directivity control parameters, and the horizontal angle and the vertical angle indicating the directivity direction oriented to the preset position (second sound position) as the preset value.

The display apparatus 36 displays, on the sound position designation screen, the control box CTL which is an example of the adjustment interface of the designation position used to change a position corresponding to the preset position on the sound position designation screen to a position corresponding to another sound position on the sound position designation screen. The directivity control apparatus 3 forms the directivity of the collected sound based on the horizontal angle and the vertical angle oriented to another sound position corresponding to the changed designation position through an input manipulation on the control box CTL. Therefore, for example, the user hearing the sound (confirmation sound) of which the directivity is formed once performs a changing manipulation on the adjustment interface so that the directivity of the sound suitable for the preference or the demand of the user can be formed.

The memory 38 stores the horizontal angle and the vertical angle oriented to another sound position corresponding to the changed designation position in association with the preset position in the sound collection area. Therefore, it is not necessary for the user to perform a manipulation of changing the control box CTL which is an example of the adjustment interface again, and the directivity control apparatus 3 can simply form the directivity using the horizontal angle and the vertical angle corresponding to the changed designation position as the preset value.

Each embodiment subsequent to the fifth embodiment, examples of a sound collection system and a sound collection method will be described which easily acquire or calculate a directivity direction oriented from a microphone array apparatus to a prearranged sound position and output a clear sound of a target present in a direction oriented from the microphone array apparatus to the prearranged sound position.

In each embodiment subsequent to the fifth embodiment, the present invention can be expressed as each apparatus (for example, a directivity control apparatus described above) included in the sound collection system or a sound collection control method including each operation (step) performed by each apparatus included in the sound collection system.

Fifth Embodiment

Figure 21B:
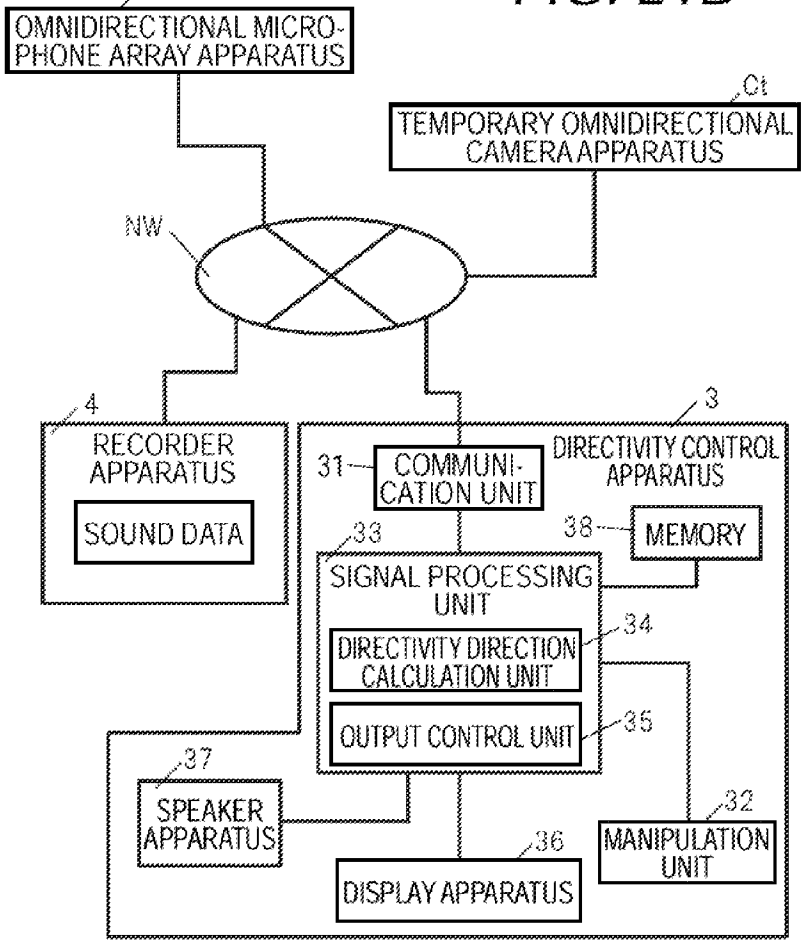
FIG. 21B is a block diagram illustrating the inner configuration of the sound collection system according to the fifth embodiment.
Figure 21A:
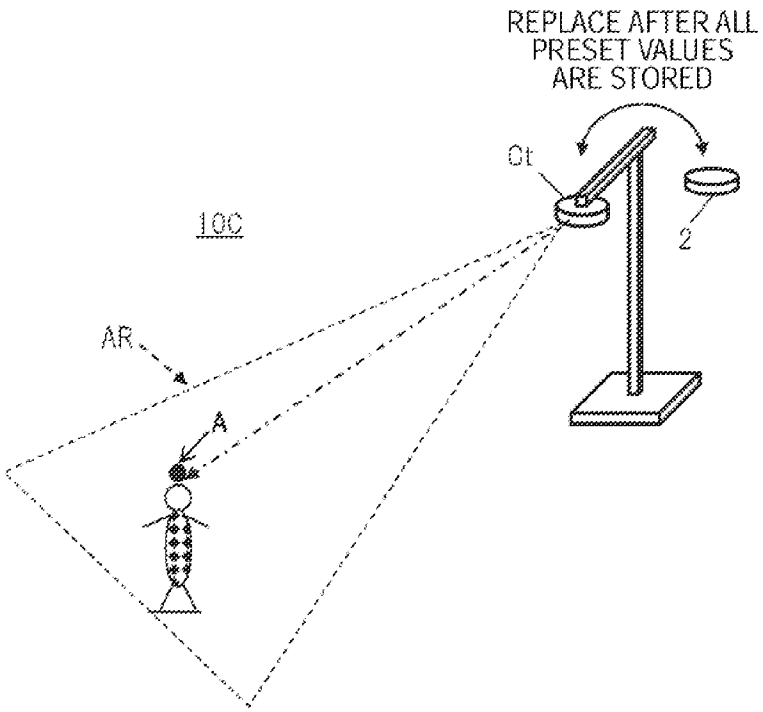
FIG. 21A is a diagram illustrating a system overview of a sound collection system according to a fifth embodiment.

FIG. 21A is a diagram illustrating a system overview of a sound collection system 10C according to a fifth embodiment. FIG. 21B is a block diagram illustrating the inner configuration of the sound collection system 10C according to the fifth embodiment. The sound collection system 10C illustrated in FIGS. 21A and 21B includes an omnidirectional microphone array apparatus 2 which is an example of a sound collection unit that collects a sound of a target (for example, a person in FIG. 21A and the same applies hereinafter), a temporary omnidirectional camera apparatus Ct, a directivity control apparatus 3, and a recorder apparatus 4.

In an operation of each unit of the omnidirectional microphone array apparatus 2, the directivity control apparatus 3, and the recorder apparatus 4 included in the sound collection system 10C according to the embodiment, the same reference numerals are given to the same content as the operation of each unit of the omnidirectional microphone array apparatus 2, the directivity control apparatus 3, and the recorder apparatus 4 included in the sound collection system 10 according to the first embodiment, description will be omitted or simplified, and other content will be described.

The omnidirectional microphone array apparatus 2 forms directivity to collect a sound with high precision in a directivity direction oriented from the installation position of the omnidirectional microphone array apparatus 2 to a prearranged preset position (sound position) A to be described below in a sound collection area AR illustrated in FIG. 21A and collects a sound of a person, who is a target present in the directivity direction, with high precision.

In sound collection systems 10C and 10D according to the following embodiments, the temporary omnidirectional camera apparatus Ct acquires data of a horizontal angle and a vertical angle of the directivity direction oriented from the omnidirectional microphone array apparatus 2 to the prearranged preset position A to be described below and data necessary to calculate the horizontal angle and the vertical angle, and then the temporary omnidirectional camera apparatus Ct is detached from the installation position. Thereafter, the omnidirectional microphone array apparatus 2 is installed at the installation position of the temporary omnidirectional camera apparatus Ct so that a reference direction (for example, a direction in which a horizontal angle is 0 degrees and the same applies hereinafter) of the horizontal angle in the directivity direction of the omnidirectional microphone array apparatus 2 matches a reference direction of a horizontal angle acquired based on the coordinates of an omnidirectional captured image by the temporary omnidirectional camera apparatus Ct.

In the sound collection system 10C illustrated in FIG. 21B, the omnidirectional microphone array apparatus 2, the temporary omnidirectional camera apparatus Ct, the directivity control apparatus 3, and the recorder apparatus 4 are connected to each other via a network NW. The network NW may be a wired network (for example, an intranet or the Internet) or may be a wireless network (for example, a wireless local area network (LAN)), and the same also applies to the following embodiments.

Before the omnidirectional microphone array apparatus 2 is installed, the temporary omnidirectional camera apparatus Ct which is an example of a first camera apparatus is installed at an installation position of the omnidirectional microphone array apparatus 2 so that a reference direction of a horizontal angle acquired based on the coordinates of an omnidirectional captured image by the temporary omnidirectional camera apparatus Ct is a prearranged direction. The prearranged direction refers to, for example, a reference direction of the horizontal angle of the directivity direction of the omnidirectional microphone array apparatus 2 installed after the temporary omnidirectional camera apparatus Ct is detached from the installation position.

The temporary omnidirectional camera apparatus Ct images all directions centering on the installation position of the temporary omnidirectional camera apparatus Ct, i.e., the prearranged range in the degree of 360 degrees, in the store in which the sound collection system 10C according to the embodiment is installed. A captured image (captured video) captured by the temporary omnidirectional camera apparatus Ct is displayed as a preset designation position designation screen CAM-t by the display apparatus 36 of the directivity control apparatus 3 (see FIG. 22A).

Figures 22A, 22B:
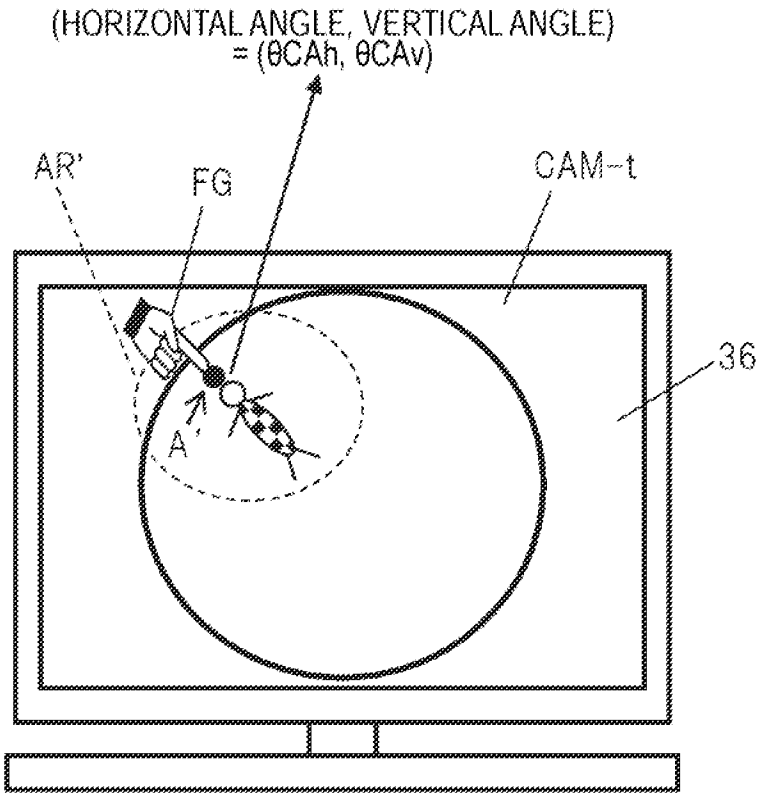
FIG. 22A is a diagram illustrating an example of a preset designation position designation screen used to designate a preset designation position from an omnidirectional captured image of a temporary omnidirectional camera apparatus.
FIG. 22B is a diagram illustrating an example of a preset table according to the first embodiment.

When the preset designation position A' corresponding to a prearranged preset position (for example, a preset position A illustrated in FIG. 21A) which is a sound position is designated with the finger FG of the user on the preset designation position designation screen CAM-t illustrated in FIG. 22A, the temporary omnidirectional camera apparatus Ct acquires the horizontal angle $\theta_{CAh}$ and the vertical angle $\theta_{CAv}$ of the direction oriented from the temporary omnidirectional camera apparatus Ct to the preset designation position A' based on the coordinates of the omnidirectional captured image of the temporary omnidirectional camera apparatus Ct. The temporary omnidirectional camera apparatus Ct transmits the data of the horizontal angle $\theta_{CAh}$ and the vertical angle $\theta_{CAv}$ or data necessary to calculate the data of the horizontal angle $\theta_{CAh}$ and the vertical angle $\theta_{CAv}$ to the directivity control apparatus 3. Since the horizontal angle $\theta_{CAh}$ and the vertical angle $\theta_{CAv}$ can be easily acquired by a function of a known technology of the temporary omnidirectional camera apparatus Ct, the description thereof will be omitted. The directivity control apparatus 3 may calculate (derive) the data of the horizontal angle $\theta_{CAh}$ and the vertical angle $\theta_{CAv}$ based on the data necessary to calculate the horizontal angle $\theta_{CAh}$ and the vertical angle $\theta_{CAv}$ transmitted by the temporary omnidirectional camera apparatus Ct.

FIG. 22A is a diagram illustrating an example of a preset designation position designation screen CAM-t used to designate a preset designation position A' from an omnidirectional captured image of a temporary omnidirectional camera apparatus Ct. On the preset designation position designation screen CAM-t displayed by the display apparatus 36, a sound collection designation region AR' corresponds to the sound collection area AR in an actual store illustrated in FIG. 21A and the preset designation position A' corresponds to the preset position A in the actual store illustrated in FIG. 21A.

The manipulation unit 32 acquires coordinate data indicating a position at which the user desires to increase or decrease a volume level of a sound, i.e., a designation position A' on a preset designation position designation screen CAM-t illustrated in FIG. 22A in response to an input manipulation of the user, and then output the coordinate data to the signal processing unit 33.

The directivity direction calculation unit 34 acquires data of the horizontal angle $\theta_{CAh}$ and the vertical angle $\theta_{CAv}$ transmitted from the temporary omnidirectional camera apparatus Ct and oriented to the preset designation position A' on the preset designation position designation screen CAM-t from the communication unit 31. The directivity direction calculation unit 34 stores the data of the horizontal angle $\theta_{CAh}$ and the vertical angle $\theta_{CAv}$ in association with the preset position A corresponding to the preset designation position A' in the memory 38 (see FIG. 22B).

Here, in the embodiments, as described above, the temporary omnidirectional camera apparatus Ct acquires the data of the horizontal angle $\theta_{CAh}$ and the vertical angle $\theta_{CAv}$ indicating the directivity direction oriented from the omnidirectional microphone array apparatus 2 to the preset position A, and then the temporary omnidirectional camera apparatus Ct is detached from the installation position. Thereafter, the omnidirectional microphone array apparatus 2 is installed at the installation position of the temporary omnidirectional camera apparatus Ct so that the reference direction of the horizontal angle of the directivity direction of the omnidirectional microphone array apparatus 2 matches the reference direction of the horizontal angle acquired based on the coordinates of the omnidirectional captured image by the temporary omnidirectional camera apparatus Ct. That is, the temporary omnidirectional camera apparatus Ct and the omnidirectional microphone array apparatus 2 have the same reference coordinate system.

Accordingly, the data of the horizontal angle $\theta_{CAh}$ and the vertical angle $\theta_{CAv}$ transmitted from the temporary omnidirectional camera apparatus Ct and oriented to the preset designation position A' on the preset designation position designation screen CAM-t can be used as data of the horizontal angle and the vertical angle of the directivity direction oriented to the preset position A by the omnidirectional microphone array apparatus 2. In other words, the omnidirectional microphone array apparatus 2 can form the directivity in the directivity direction oriented from the omnidirectional microphone array apparatus 2 to the preset position A corresponding to the preset designation position A' designated on the preset designation position designation screen CAM-t based on the horizontal angle $\theta_{CAh}$ and the vertical angle $\theta_{CAv}$ transmitted from the temporary omnidirectional camera apparatus Ct.

FIG. 22B is a diagram illustrating an example of a preset table according to the fifth embodiment. FIG. 23A is a preset designation position diagram illustrating a relation between an entire sound collection area AR1 and a plurality of preset positions P1, P2, P3, and Pn when the sound collection system 10C according to the fifth embodiment is installed in a store.

The preset table illustrated in FIG. 22B includes records of data of a prearranged preset position in a store, a sound collection area including the preset position, a preset value indicating a combination of the horizontal angle and the vertical angle of the directivity direction oriented from the omnidirectional microphone array apparatus 2 to the preset position, and is stored in the memory 38.

In the preset designation position diagram illustrated in FIG. 23A, it is assumed that a preset position P1 is located near register 1 in the store and a sound collection area including the preset position P1 is "register 1." It is assumed that a preset position P2 is located near register 2 in the store and a sound collection area including the preset position P2 is "register 2." It is assumed that a preset position P3 is located near a magazine rack in the store and a sound collection area including the preset position P3 is "magazine rack." Likewise, it is assumed that a preset position Pn is located near a drink rack in the store and a sound collection area including the preset position Pn is "drink rack."

When one sound collection area (for example, "register 2") is selected with the finger FG of the user on a sound collection area selection screen WD displayed by the display apparatus 36, the directivity direction calculation unit 34 acquires data of a preset value (for example, (horizontal angle $\theta_{hp2}$, vertical angle $\theta_{vp2}$) corresponding to the selected sound collection area with reference to the preset table (see FIG. 22B) stored in the memory 38. The directivity direction calculation unit 34 outputs the data of the preset value (for example, (horizontal angle $\theta_{hp2}$, vertical angle $\theta_{vp2}$)) corresponding to the selected sound collection area to the output control unit 35.

In the data ($\theta_{hp1}$, $\delta_{vp1}$) to ($\theta_{hp3}$, $\theta_{vp3}$) of the preset values illustrated in FIG. 22B, $\theta_{hp1}$, $\theta_{hp2}$, and $\theta_{hp3}$ indicate horizontal angles of the directivity direction oriented from the omnidirectional microphone array apparatus 2 to the preset position A and $\theta_{vp1}$, $\theta_{vp2}$, and $\theta_{vp3}$ indicate vertical angles of the directivity direction oriented from the omnidirectional microphone array apparatus 2 to the preset position A.

Figure 23B:
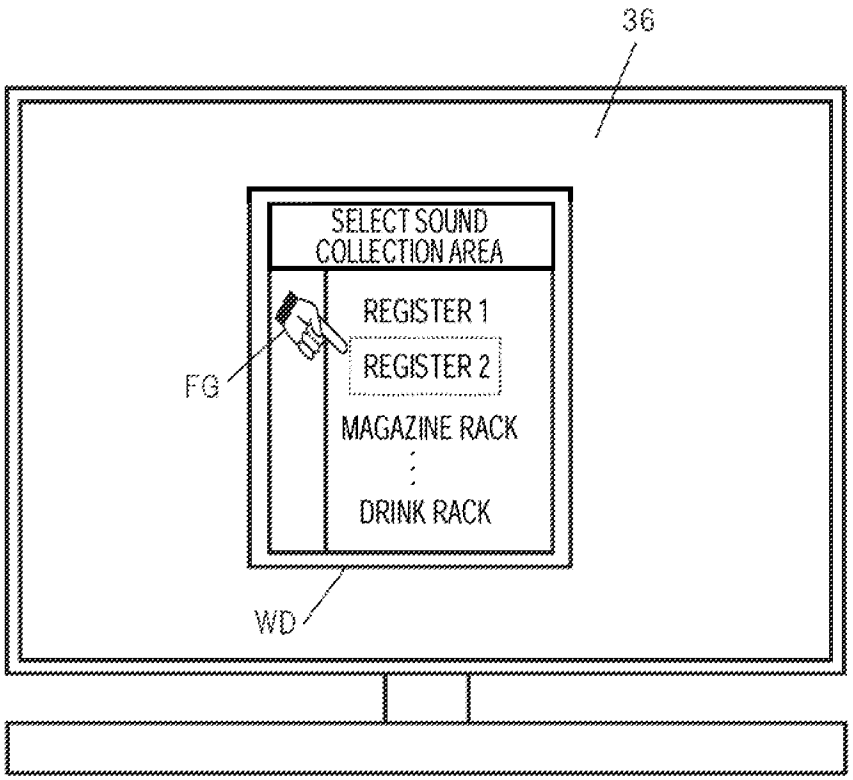
FIG. 23B is a diagram illustrating an example of a selection screen of a sound collection area according to the fifth embodiment.
Figure 23A:
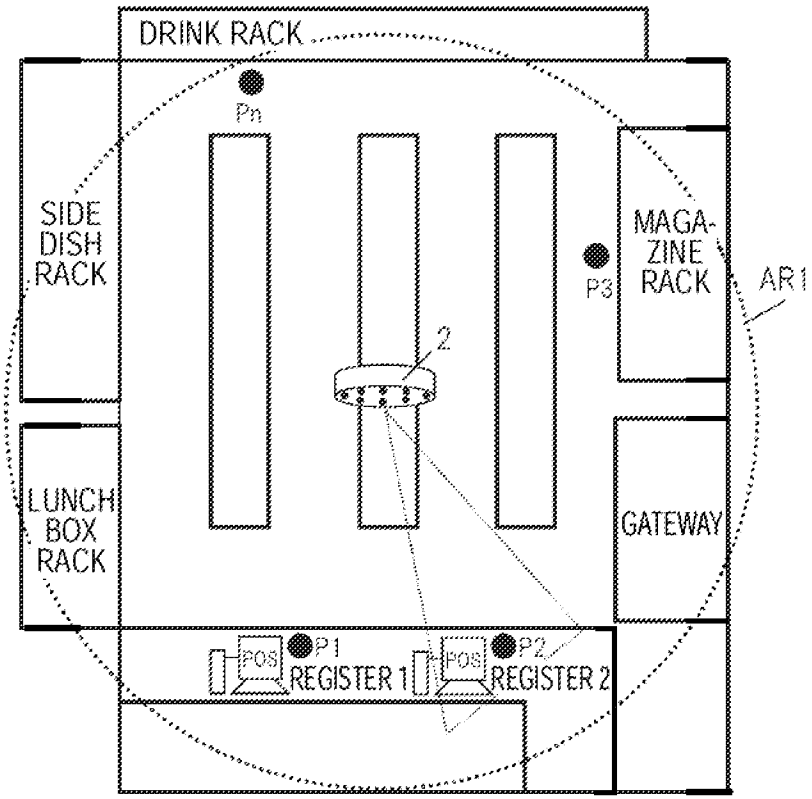
FIG. 23A is a preset designation position diagram illustrating a relation between an entire sound collection area AR1 and a plurality of preset positions P1, P2, P3, and Pn when the sound collection system according to the fifth embodiment is installed in a store.

The output control unit 35 serving as an example of a directivity control unit controls operations of the omnidirectional microphone array apparatus 2, the temporary omnidirectional camera apparatus Ct, the display apparatus 36, and the speaker apparatus 37 and causes the display apparatus 36 to display, for example, the preset designation position designation screen CAM-t illustrated in FIG. 22A or the sound collection area selection screen WD illustrated in FIG. 23B in response to an input manipulation of the user.

The display apparatus 36 serving as an example of a display unit displays the preset designation position designation screen CAM-t used to designate the preset designation position A' corresponding to the preset position A from the installation position of the omnidirectional microphone array apparatus 2 or the sound collection area selection screen WD illustrated in FIG. 23B under the control of the signal processing unit 33, for example, in response to an input manipulation of the user.

Figure 24:
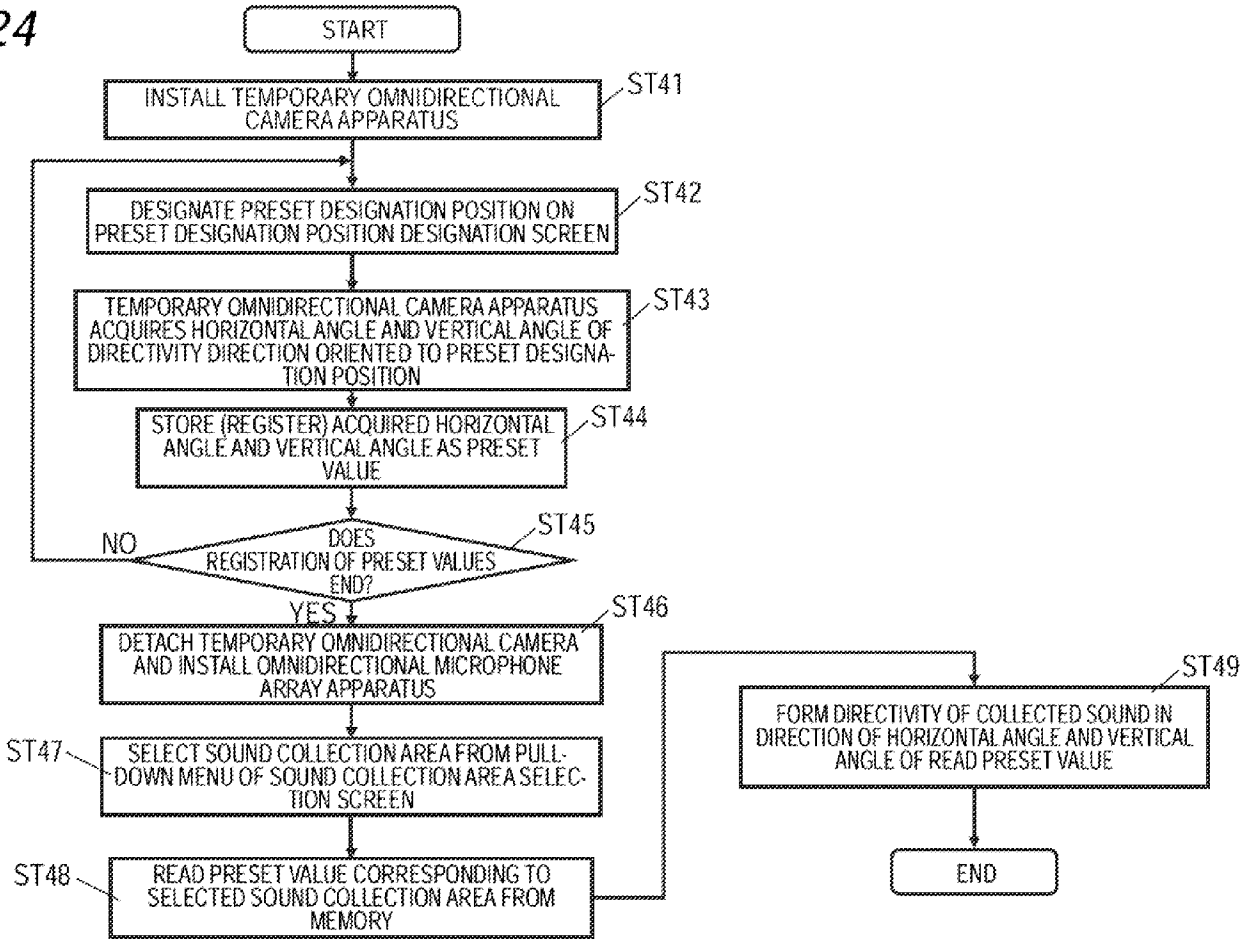
FIG. 24 is a flowchart for describing an operation order of the sound collection system according to the fifth embodiment.

The detailed operation order of the sound collection system 10C according to the embodiment will be described with reference to FIG. 24. FIG. 24 is a flowchart for describing the operation order of the sound collection system 10C according to the fifth embodiment.

In FIG. 24, the temporary omnidirectional camera apparatus Ct included in the sound collection system 10C is installed to be fixed on a predetermined installation surface (for example, a ceiling surface or a stand in a store) in a store (ST41).

After the temporary omnidirectional camera apparatus Ct is installed in step ST41, the directivity control apparatus 3 causes the display apparatus 36 to display the preset designation position designation screen CAM-t illustrated in FIG. 22A in response to an input manipulation of the user. The directivity control apparatus 3 receives designation of the preset designation position A' desired by the user on the preset designation position designation screen CAM-t displayed by the display apparatus 36 via the manipulation unit 32 (ST42).

When the preset designation position A' corresponding to the preset position A is designated with the finger FG of the user on the preset designation position designation screen CAM-t displayed by the display apparatus 36, the temporary omnidirectional camera apparatus Ct acquires the horizontal angle $\theta_{CAh}$ and the vertical angle $\theta_{CAv}$ of the direction oriented from the temporary omnidirectional camera apparatus Ct to the preset designation position A' based on the coordinates of the omnidirectional captured image of the temporary omnidirectional camera apparatus Ct (ST43). The temporary omnidirectional camera apparatus Ct transmits the data of the horizontal angle $\theta_{CAh}$ and the vertical angle $\theta_{CAv}$ to the directivity control apparatus 3.

Thus, the directivity control apparatus 3 can easily acquire the horizontal angle and the vertical angle of the directivity direction oriented from the omnidirectional microphone array apparatus 2 to the preset position A corresponding to the preset designation position A' designated on the preset designation position designation screen CAM-t by the user.

The directivity control apparatus 3 receives the data of the horizontal angle $\theta_{CAh}$ and the vertical angle $\theta_{CAv}$ oriented to the preset designation position A' on the preset designation position designation screen CAM-t from the temporary omnidirectional camera apparatus Ct. The directivity control apparatus 3 stores and registers the data of the horizontal angle $\theta_{CAh}$ and the vertical angle $\theta_{CAv}$ in association with the preset position A corresponding to the preset designation position A' in the memory 38 (ST44).

When the registration of the preset values corresponding to all of the preset positions desired by the user in the memory 38 does not end after step ST44 (ST45: NO), the directivity control apparatus 3 repeats the operations of steps ST42 to ST44 until the end of the registration of the preset values corresponding to all of the preset positions desired by the user in the memory 38.

Conversely, when the registration of the preset values corresponding to all of the preset positions desired by the user in the memory 38 ends (ST45: YES), the temporary omnidirectional camera apparatus Ct is detached from the installation position. After the temporary omnidirectional camera apparatus Ct is detached, the omnidirectional microphone array apparatus 2 is installed at the installation position of the temporary omnidirectional camera apparatus Ct so that the reference direction of the horizontal angle of the directivity direction of the omnidirectional microphone array apparatus 2 matches the reference direction of the horizontal angle acquired based on the coordinates of the omnidirectional captured image by the temporary omnidirectional camera apparatus Ct (ST46).

In step ST46, the omnidirectional microphone array apparatus 2 is installed, for example, in the following way so that the reference direction of the horizontal angle acquired based on the coordinates of the omnidirectional captured image by the temporary omnidirectional camera apparatus Ct matches the reference direction of the horizontal angle of the directivity direction of the omnidirectional microphone array apparatus 2. However, the method of installing the omnidirectional microphone array apparatus 2 in step ST46 is not limited to a method of using a marker to be described below.

Specifically, for example, a triangular or rectangular marker (not illustrated) is added to the outer circumference of the casing of the temporary omnidirectional camera apparatus Ct. The marker is added in a direction indicating a reference direction (for example, a 0-degree direction of the horizontal angle) of the horizontal angle acquired based on the coordinates of the omnidirectional captured image by the temporary omnidirectional camera apparatus Ct.

For example, a marker (not illustrated) with the same shape is added to the periphery of the opening 21*a* formed at the casing center of the omnidirectional microphone array apparatus 2 at a position facing the marker added to the temporary omnidirectional camera apparatus Ct.

Accordingly, by installing the omnidirectional microphone array apparatus 2 so that the marker of the temporary omnidirectional camera apparatus Ct faces the marker of the omnidirectional microphone array apparatus 2, the omnidirectional microphone array apparatus 2 can be installed so that the reference direction of the horizontal angle of the directivity direction of the omnidirectional microphone array apparatus 2 matches the reference direction of the horizontal angle acquired based on the coordinates of the omnidirectional captured image by the temporary omnidirectional camera apparatus Ct.

After the omnidirectional microphone array apparatus 2 is installed, the directivity control apparatus 3 causes the display apparatus 36 to display the sound collection area selection screen WD illustrated in FIG. 23B in response to an input manipulation of the user. The directivity control apparatus 3 receives the designation of the sound collection area desired by the user on a pull-down menu of the sound collection area selection screen WD displayed by the display apparatus 36 via the manipulation unit 32 (ST47).

When one sound collection area (for example, "register 2") is selected with the finger FG of the user on the sound collection area selection screen WD displayed by the display apparatus 36, the directivity control apparatus 3 acquires the data (for example, (horizontal angle $\theta_{hp2}$, vertical angle $\theta_{vp2}$)) of the preset value corresponding to the selected sound collection area with reference to the preset table stored in the memory 38 (ST48). The directivity direction calculation unit 34 outputs the data (horizontal angle $\theta_{hp2}$, vertical angle $\theta_{vp2}$) of the preset value corresponding to the selected sound collection area to the output control unit 35.

The directivity control apparatus 3 causes the output control unit 35 to form the directivity of the sound data in the directivity direction corresponding to the data (horizontal angle $\theta_{hp2}$, vertical angle $\theta_{vp2}$) of the preset value acquired in step ST48 or causes the omnidirectional microphone array apparatus 2 to form the directivity (ST49).

Thus, the omnidirectional microphone array apparatus 2 can relatively increase the volume level of the sound data collected in the sound collection direction decided by the sound collection direction coordinates ($\theta_{hp2}$, $\theta_{vp2}$) in which the directivity is formed and can relatively reduce the volume level of the sound data collected in the direction in which no directivity is formed.

In the sound collection system 10C according to the embodiment, a timing at which the sound is collected by the omnidirectional microphone array apparatus 2 is not limited to a timing immediately after step ST14, but may be, for example, a timing after the omnidirectional microphone array apparatus 2 is turned on. The same also applies to each of the following embodiments.

In the sound collection system 10C according to the embodiment, as described above, the display apparatus 36 displays the preset designation position designation screen CAM-t used to designate one or more preset designation positions A' from a captured image of the temporary omnidirectional camera apparatus Ct having the same reference coordinate system as the omnidirectional microphone array apparatus 2. The directivity direction calculation unit 34 of the directivity control apparatus 3 acquires the horizontal angle and the vertical angle from the omnidirectional microphone array apparatus 2 to the preset position A corresponding to the preset designation position A' from the temporary omnidirectional camera apparatus Ct according to the designation of the preset designation position A' on the preset designation position designation screen CAM-t or the directivity direction calculation unit 34 calculates the horizontal angle and the vertical angle based on data from the temporary omnidirectional camera apparatus Ct, and then stores the horizontal angle and the vertical angle in association with the preset position A in the memory 38. The output control unit 35 of the directivity control apparatus 3 forms the directivity of the collected sound based on the horizontal angle and the vertical angle stored for each preset position.

Thus, in the sound collection system 10C, the directivity control apparatus 3 can easily acquire the horizontal angle and the vertical angle indicating the directivity direction oriented from the omnidirectional microphone array apparatus 2 to the preset position A corresponding to the preset designation position A' designated on the preset designation position designation screen CAM-t displayed as the captured image of the temporary omnidirectional camera apparatus Ct, from the temporary omnidirectional camera apparatus Ct or can simply calculate the horizontal angle and the vertical angle in the directivity control apparatus 3 based on the data from the temporary omnidirectional camera apparatus Ct. The directivity control apparatus 3 can form the directivity in which a clear sound of a target at the preset position A is output based on the horizontal angle and the vertical angle of the directivity direction acquired from the temporary omnidirectional camera apparatus Ct or calculated in the directivity control apparatus 3, and thus can output the clear sound of the target present at the corresponding preset position A.

Sixth Embodiment

Figure 25:
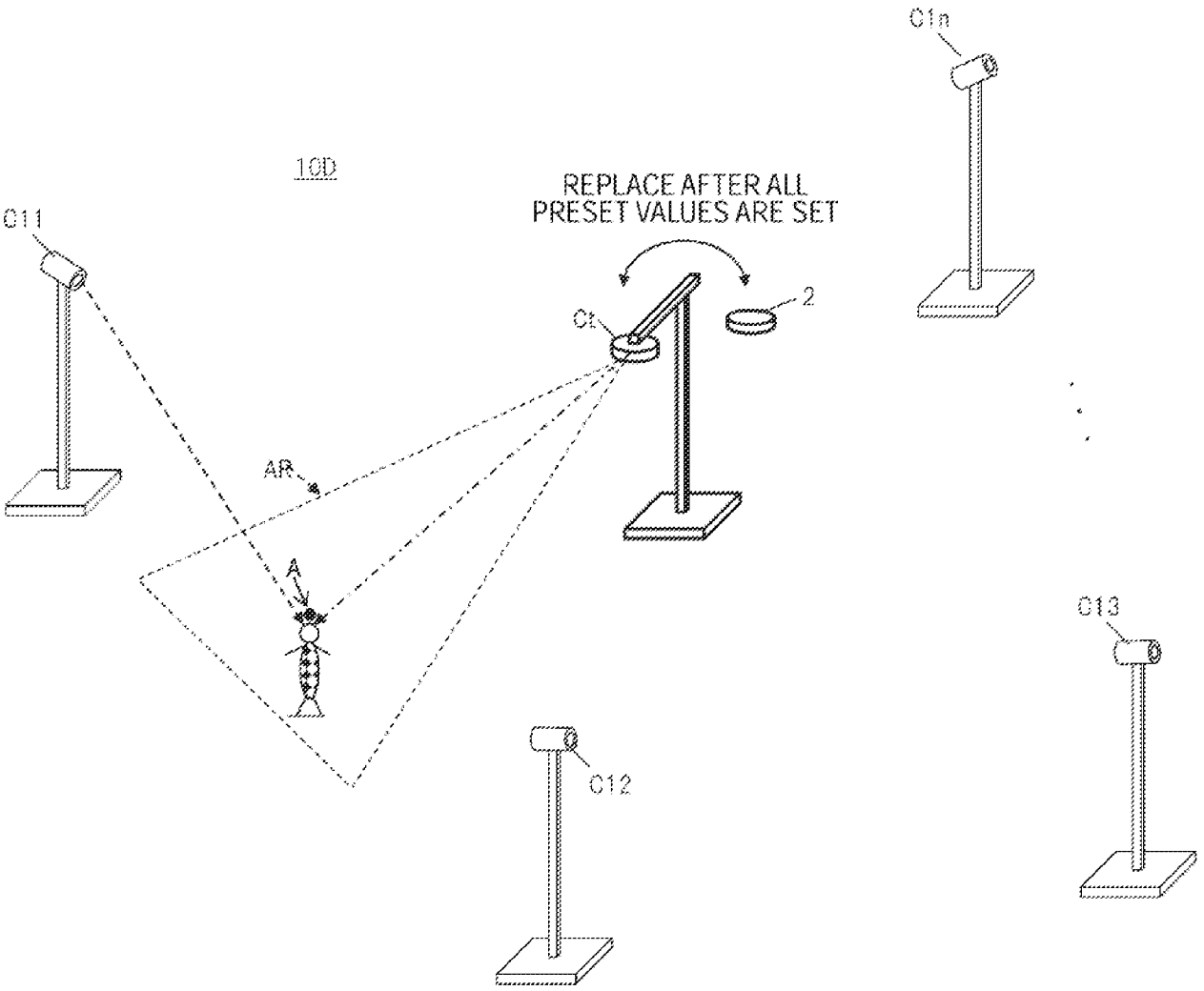
FIG. 25 is a diagram illustrating a system overview of a sound collection system according to a sixth embodiment.

FIG. 25 is a diagram illustrating a system overview of a sound collection system 10D according to a sixth embodiment. The sound collection system 10D according to the sixth embodiment is configured to further include one or more monitoring camera apparatuses CM11 to CM1n imaging predetermined different sound collection areas in addition to the configuration of the sound collection system 10C according to the fifth embodiment. A captured image of the monitoring camera apparatus selected by the user from the monitoring camera apparatuses CM11 to CM1n is displayed by the display apparatus 36.

Thus, when the user designates the preset designation position A' on the preset designation position designation screen CAM-t, the user can designate the suitable preset designation position A' with reference to the captured image of the monitoring camera apparatus in which the preset position A corresponding to the preset designation position A' is best pictured.

Figures 26A, 26B:
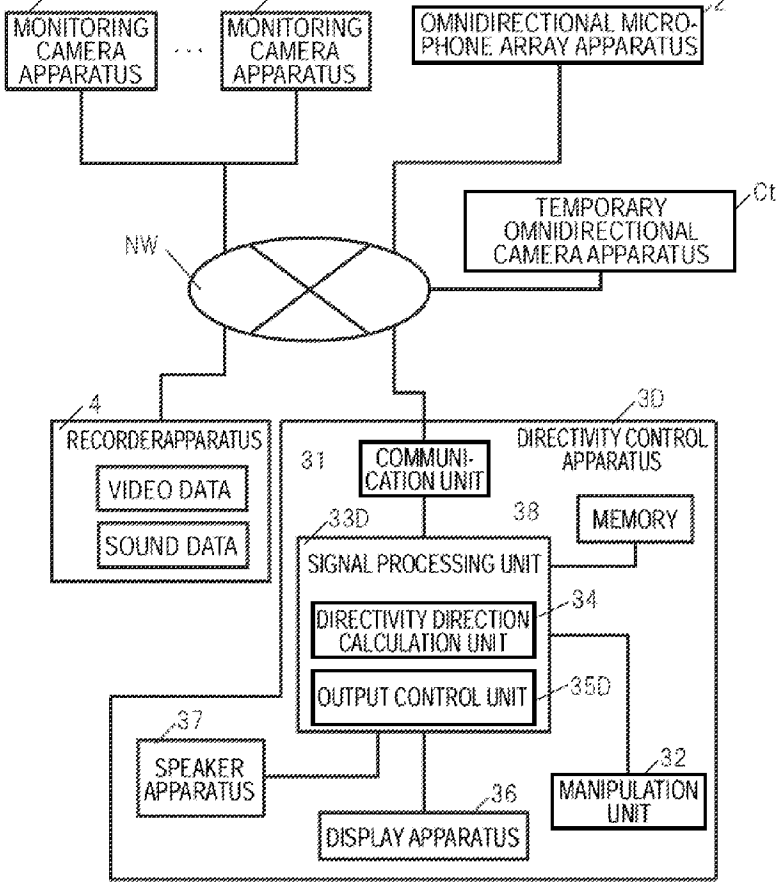
FIG. 26A is a block diagram illustrating the inner configuration of the sound collection system according to the sixth embodiment.
FIG. 26B is a diagram illustrating an example of a preset table according to the sixth embodiment.

FIG. 26A is a block diagram illustrating the inner configuration of the sound collection system 10D according to the sixth embodiment. The sound collection system 10D illustrated in FIG. 25 or 26A includes an omnidirectional microphone array apparatus 2 which is an example of a sound collection unit collecting a sound of a target (for example, a person in FIG. 25), a temporary omnidirectional camera apparatus Ct, a directivity control apparatus 3D, and a recorder apparatus 4.

In an operation of each unit of the omnidirectional microphone array apparatus 2, the temporary omnidirectional camera apparatus Ct, the directivity control apparatus 3D, and the recorder apparatus 4 included in the sound collection system 10D according to the embodiment, the same reference numerals are given to the same content as the operation of each unit of the omnidirectional microphone array apparatus 2, the temporary omnidirectional camera apparatus Ct, the directivity control apparatus 3, and the recorder apparatus 4 included in the sound collection system 10C according to the fifth embodiment, description will be omitted or simplified, and other content will be described.

The monitoring camera apparatuses CM11 to CM1n image predetermined different sound collection areas in a store in which the sound collection system 10D is installed and transmits data of the captured images to the directivity control apparatus 3D or the recorder apparatus 4 via a network NW. Of the monitoring camera apparatuses CM11 to CM1n, imaging ranges of some monitoring camera apparatuses may be overlapped.

FIG. 26B is a diagram illustrating an example of a preset table according to the sixth embodiment. FIG. 27A is a preset designation position diagram illustrating a relation between an entire sound collection area AR1 and a plurality of preset positions P1, P2, P3, and Pn when the sound collection system 10D according to the sixth embodiment is installed in a store.

The preset table illustrated in FIG. 26B includes records of data of a sound collection area including a prearranged preset position in the store and data of a preset value including a combination of a horizontal angle and a vertical angle of a directivity direction oriented from the omnidirectional microphone array apparatus 2 to the preset position and an identification number of the monitoring camera apparatus imaging the sound collection area, and is stored in the memory 38. That is, the preset value registered in the preset table according to the embodiment further includes the identification number in addition to the directivity direction which is the preset value according to the fifth embodiment. For example, the identification numbers of the monitoring camera apparatuses are "CM11" for the monitoring camera apparatus CM11 and are likewise "CM1n" for the monitoring apparatus CM1n.

In the preset designation position diagram illustrated in FIG. 27A, it is assumed that a preset position P1 is located near register 1 in the store and a sound collection area including the preset position P1 is "register 1." It is assumed that a preset position P2 is located near register 2 in the store and a sound collection area including the preset position P2 is "register 2." It is assumed that a preset position P3 is located near a magazine rack in the store and a sound collection area including the preset position P3 is "magazine rack." Likewise, it is assumed that a preset position Pn is located near a drink rack in the store and a sound collection area including the preset position Pn is "drink rack."

The monitoring camera apparatus CM11 images the periphery of the preset position P1 near the sound collection area "register 1." The monitoring camera apparatus CM12 images the periphery of the preset position P2 near the sound collection area "register 2." The monitoring camera apparatus CM13 images the periphery of the preset position P3 near the sound collection area "magazine rack." The monitoring camera apparatus CM1n images the periphery of the preset position Pn near the sound collection area "drink rack."

Figure 28A:
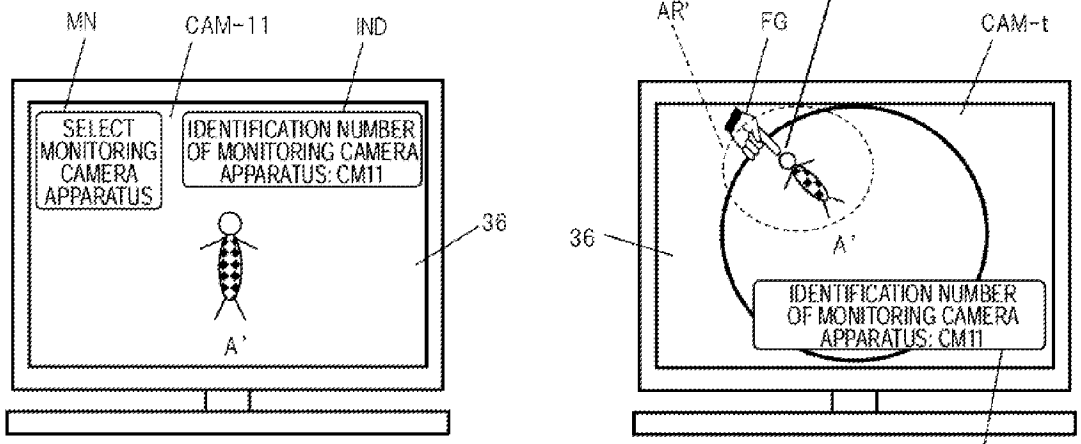
FIG. 28A is a diagram illustrating an example of a display screen of a captured image of a monitoring camera apparatus CM11.
Figure 28B:
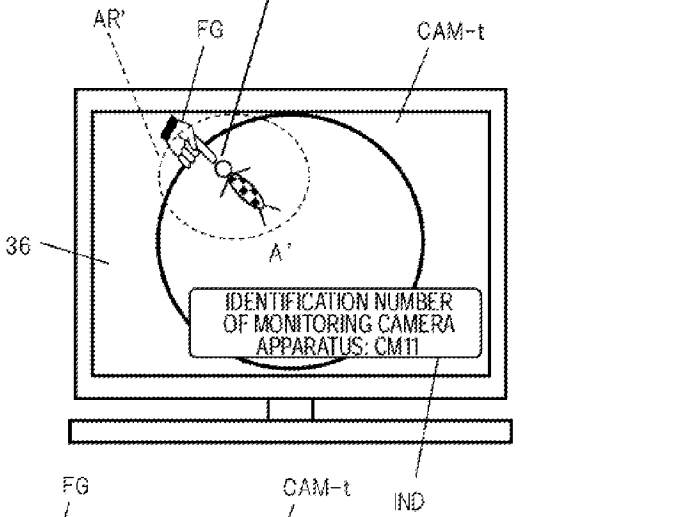
FIG. 28B is a diagram illustrating an example of a display screen of an omnidirectional captured image of a temporary omnidirectional camera apparatus Ct corresponding to the monitoring camera apparatus CM11.

An output control unit 35D which is an example of a directivity control unit controls the operations of the omnidirectional microphone array apparatus 2, the temporary omnidirectional camera apparatus Ct, the display apparatus 36, and the speaker apparatus 37 and causes the display apparatus 36 to display, for example, a display screen of the captured image of one monitoring camera apparatus (for example, the monitoring camera apparatus CM11) illustrated in FIG. 28A and a preset designation position designation screen CAM-t illustrated in FIG. 28B in response to an input manipulation of the user.

FIG. 28A is a diagram illustrating an example of a display screen of the captured image of the monitoring camera apparatus CM11. FIG. 28B is a diagram illustrating an example of a display screen of an omnidirectional captured image of the temporary omnidirectional camera apparatus Ct corresponding to the captured image of the monitoring camera apparatus CM11. For example, the omnidirectional captured image of the temporary omnidirectional camera apparatus Ct corresponding to the captured image of the monitoring camera apparatus CM11 is an example of a captured image indicating how the captured image of the monitoring camera apparatus CM11 is displayed in the omnidirectional captured image of the temporary omnidirectional camera apparatus Ct.

On the display screen illustrated in FIG. 28A, an indicator IND of the monitoring camera apparatus indicating which monitoring camera apparatus captures the captured image and a selection menu button MN of the monitoring camera apparatus used to switch the captured image of the monitoring camera apparatus are displayed in addition to the captured image of the monitoring camera apparatus CM11.

On the display screen illustrated in FIG. 28B, an indicator IND of the monitoring camera apparatus indicating which monitoring camera apparatus captures the captured image is displayed in addition to the omnidirectional captured image of the temporary omnidirectional camera apparatus Ct.

Figure 28C:
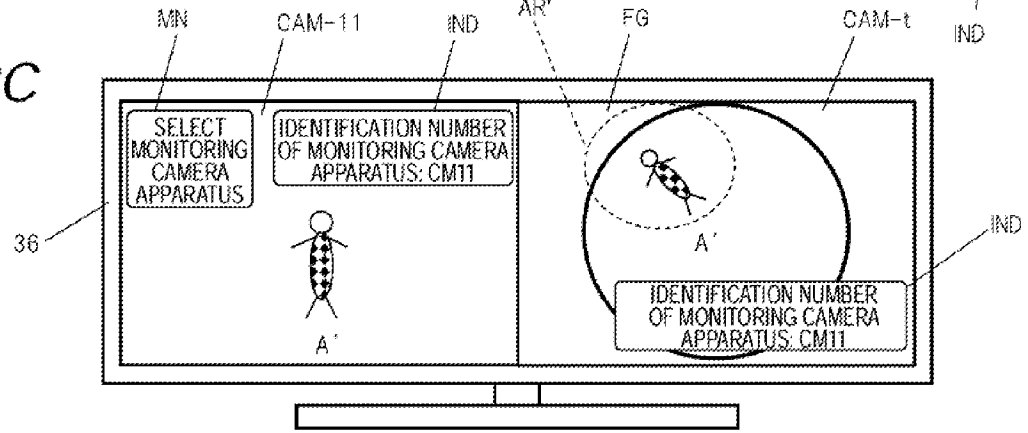
FIG. 28C is a diagram illustrating a contrast display example between the display screen of the captured image of the monitoring camera apparatus CM11 and the display screen of the omnidirectional captured image of the temporary omnidirectional camera apparatus Ct corresponding to the captured image of the monitoring camera apparatus CM11.

The output control unit 35D alternately switches and displays the display screen of the captured image of the monitoring camera apparatus CM11 illustrated in FIG. 28A and the display screen of the captured image of the temporary omnidirectional camera apparatus Ct illustrated in FIG. 28B and corresponding to the captured image of the monitoring camera apparatus CM11 at each given time. The output control unit 35D may contrastively display the display screen of the captured image of the monitoring camera apparatus CM11 illustrated in FIG. 28A and the display screen of the omnidirectional captured image of the temporary omnidirectional camera apparatus Ct illustrated in FIG. 28B and corresponding to the captured image of the monitoring camera apparatus CM11, as illustrated in FIG. 28C. FIG. 28C is a diagram illustrating a contrast display example between the display screen of the captured image of the monitoring camera apparatus CM11 and the display screen of the omnidirectional captured image of the temporary omnidirectional camera apparatus Ct corresponding to the captured image of the monitoring camera apparatus CM11.

Figure 27B:
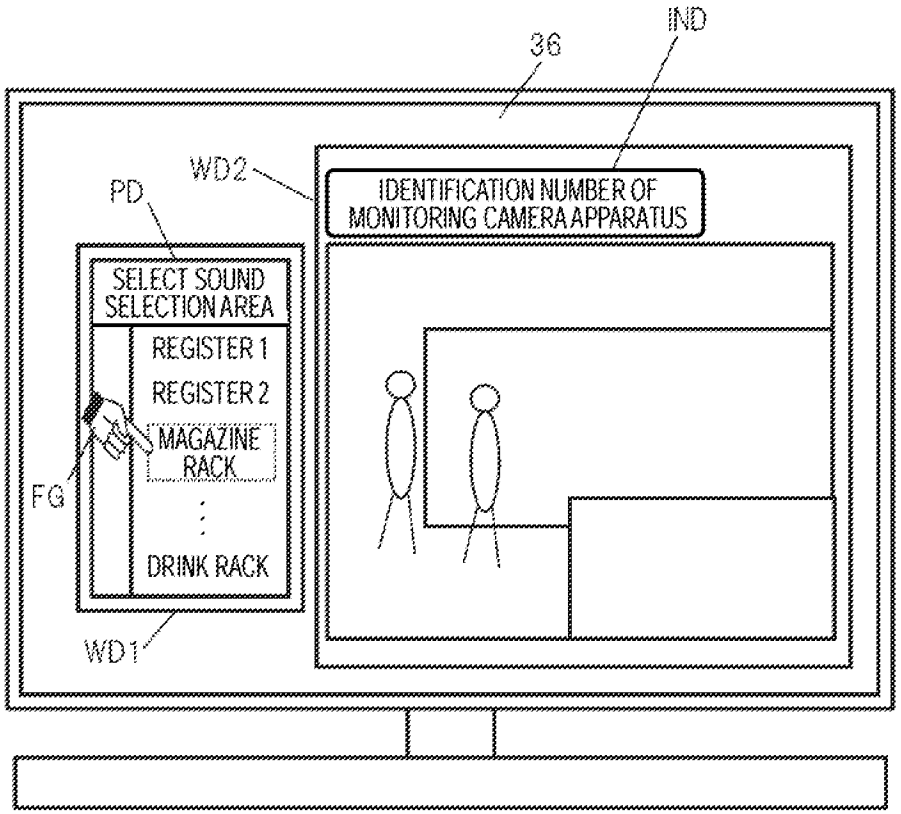
FIG. 27B is a diagram illustrating an example of a sound collection area selection screen and a display screen of a captured image of a monitoring camera apparatus C13 (an identification number of the monitoring camera apparatus) according to the sixth embodiment.
Figure 27A:
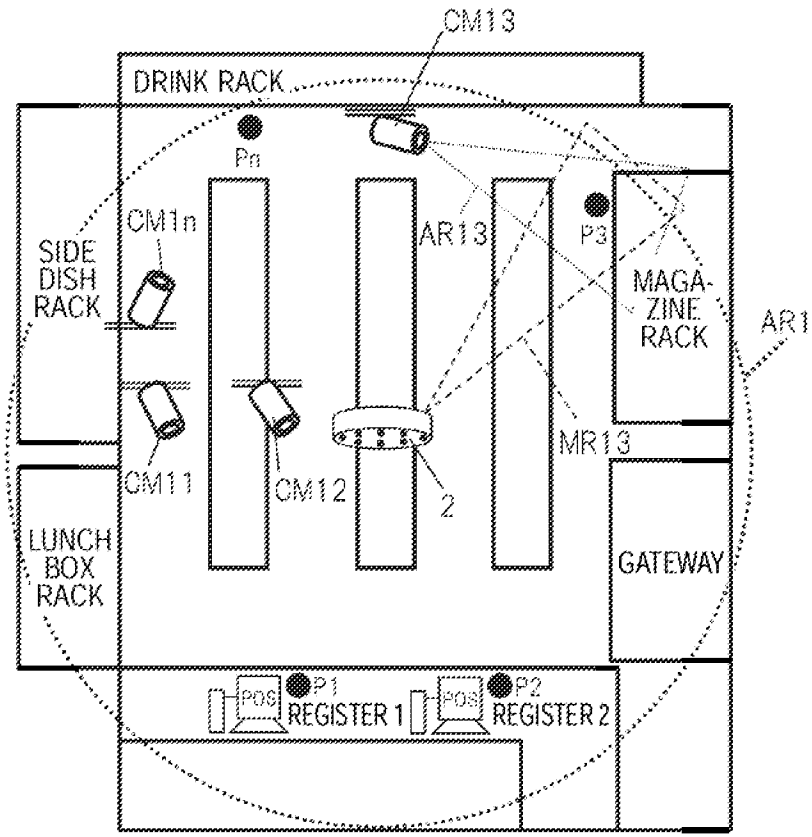
FIG. 27A is a preset designation position diagram illustrating a relation between an entire sound collection area AR1 and a plurality of preset positions P1, P2, P3, and Pn when the sound collection system according to the sixth embodiment is installed in a store.

As illustrated in FIG. 27B, the output control unit 35D causes the display apparatus 36 to display a sound collection area selection screen WD1 and a display screen WD2 of the captured image of the monitoring camera apparatus imaging the sound collection area selected on the sound collection area selection screen WD1. FIG. 27B is a diagram illustrating examples of the sound collection area selection screen WD1 and the display screen WD2 of the captured image of the monitoring camera apparatus (identification number of the monitoring camera apparatus) C13 according to the sixth embodiment. The identification number of the monitoring camera apparatus imaging the sound collection area selected on the sound collection area selection screen WD1 is displayed on the display screen WD2 illustrated in FIG. 27B.

The recorder apparatus 4 according to the embodiment may store video data captured by each monitoring camera apparatus and sound data collected by the omnidirectional microphone array apparatus 2 in association therewith.

Figure 29:
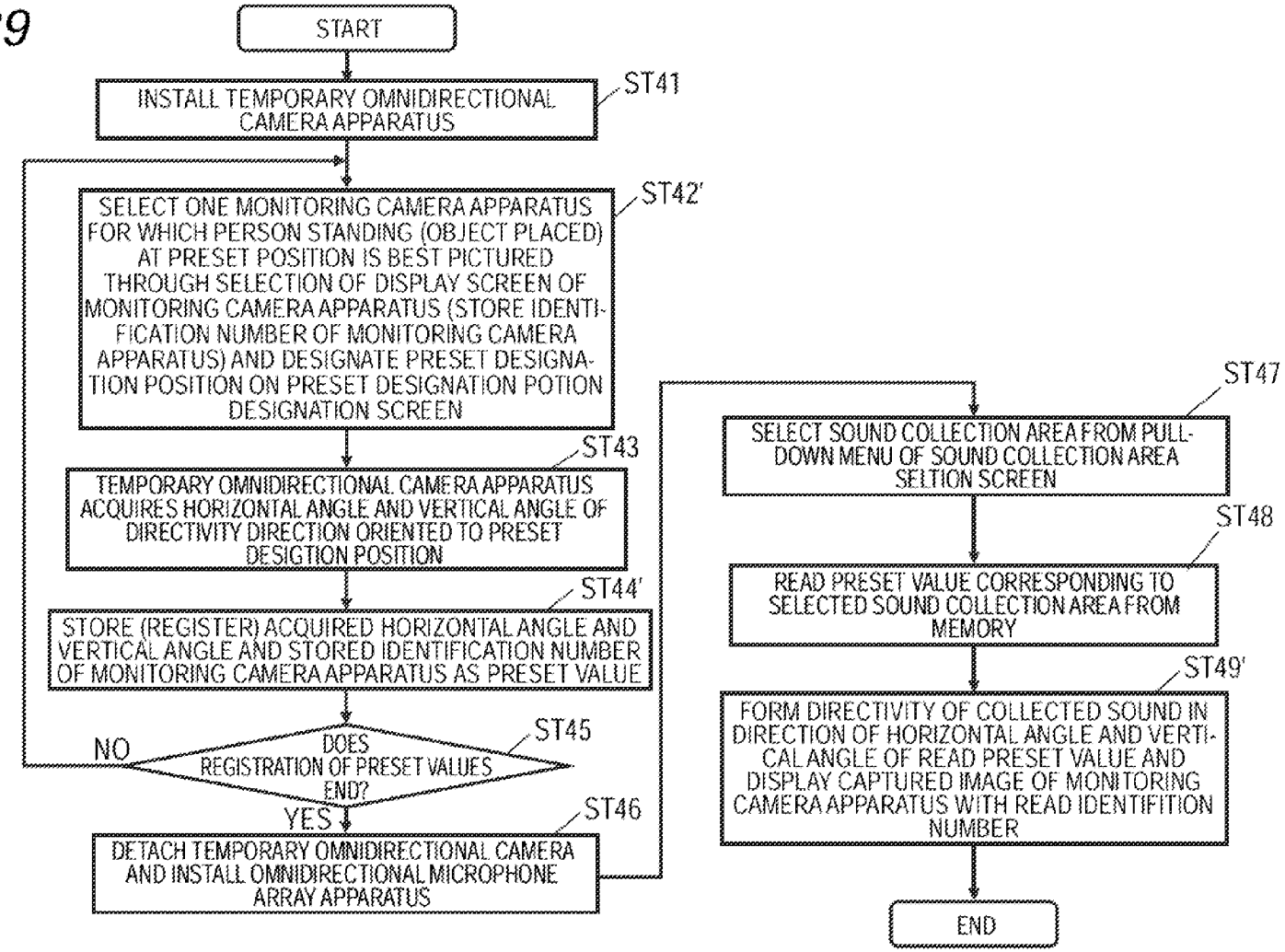
FIG. 29 is a flowchart for describing an operation order of the sound collection system according to the sixth embodiment.

Next, the detailed operation order of the sound collection system 10D according to the embodiment will be described with reference to FIG. 29. FIG. 29 is a flowchart illustrating an operation order of the sound collection system 10D according to the sixth embodiment. In the description of the flowchart illustrated in FIG. 29, the same step numbers are given to steps in which the same operations as the operations illustrated in the flowchart of FIG. 24 are performed, the description thereof will be omitted or simplified, and other content will be described.

In FIG. 29, after the temporary omnidirectional camera apparatus Ct is installed in step ST41, the directivity control apparatus 3D causes the display apparatus 36 to display the display screen of the captured image of one monitoring camera apparatus (for example, the monitoring camera apparatus CM11) illustrated in FIG. 28A in response to an input manipulation of the user (ST42'). When a person standing or an object placed at the preset position is best pictured in a switching manipulation of the display screen of the captured image of the monitoring camera apparatus by the user and one monitoring camera apparatus determined by the user is selected, the directivity control apparatus 3D temporarily stores the identification number (for example, CM11) of the selected monitoring camera apparatus (for example, the monitoring camera apparatus CM11) in the memory 38 (ST42').

The directivity control apparatus 3D causes the display apparatus 36 to display the preset designation position designation screen CAM-t illustrated in FIG. 28B in response to an input manipulation of the user. The directivity control apparatus 3D receives designation of the preset designation position A' desired by the user referring to the captured image of the selected monitoring camera apparatus on the preset designation position designation screen CAM-t displayed by the display apparatus 36 via the manipulation unit 32 (ST42').

After steps ST42' and ST43, the directivity control apparatus 3D receives the data of the horizontal angle $\theta_{CAh}$ and the vertical angle $\theta_{CAv}$ oriented to the preset designation position A' on the preset designation position designation screen CAM-t from the temporary omnidirectional camera apparatus Ct. The directivity control apparatus 3D stores and registers the data of the horizontal angle $\theta_{CAh}$ and the vertical angle $\theta_{CAv}$ and the identification number of the monitoring camera apparatus temporarily stored in the memory 38 in step ST42' in association with the preset position A corresponding to the preset designation position A' in the memory 38 (ST44').

In step ST49', when one sound collection area is selected on the sound collection area selection screen WD1 displayed by the display apparatus 36, the directivity control apparatus 3D displays the captured image of the monitoring camera apparatus with the identification number which is the data of the preset value read in step ST48 on the display screen WD2 of the display apparatus 36 with reference to the preset table stored in the memory 38.

In the sound collection system 10D according to the embodiment, as described above, the display apparatus 36 displays the preset designation position designation screen CAM-t used to designate one or more preset designation positions A' from the captured image of the temporary omnidirectional camera apparatus Ct corresponding to the captured image of the monitoring camera apparatus selected from one or more monitoring camera apparatuses CM11 to CM1n imaging the predetermined different sound collection areas. The directivity direction calculation unit 34 of the directivity control apparatus 3D acquires the horizontal angle and the vertical angle from the omnidirectional microphone array apparatus 2 to the preset position A corresponding to the preset designation position A' from the temporary omnidirectional camera apparatus Ct according to designation of the preset designation position A' on the preset designation position designation screen CAM-t or calculates the horizontal angle and the vertical angle of the directivity direction calculation unit 34 based on the data from the temporary omnidirectional camera apparatus Ct, and stores the horizontal angle and the vertical angle along with the identification number of the selected monitoring camera apparatus in association with the preset position A in the memory 38. The output control unit 35D of the directivity control apparatus 3D forms the directivity in which the sound of the target is collected in the output control unit 35D based on the horizontal angle and the vertical angle stored for each preset position and causes the omnidirectional microphone array apparatus 2 to form the directivity, and displays the captured image of the monitoring camera apparatus with the recorded identification number.

Thus, in the sound collection system 10D, the user views the captured image of the corresponding monitoring camera apparatus, and then designates the preset designation position A' corresponding to the preset position A. Therefore, the directivity control apparatus 3D can easily and accurately acquire the horizontal angle and the vertical angle indicating the directivity direction oriented from the omnidirectional microphone array apparatus 2 to the preset position A corresponding to the preset designation position A' from the temporary omnidirectional camera apparatus Ct or can calculate the horizontal angle and the vertical angle in the directivity control apparatus 3D based on the data acquired from the temporary omnidirectional camera apparatus Ct. Further, the directivity control apparatus 3D can form the directivity in which the clear sound of the target at the preset position A is output based on the horizontal angle and the vertical angle of the directivity direction acquired from the temporary omnidirectional camera apparatus Ct, and can display the captured image of the sound collection area including the preset position A and output the clear sound of the target present at the corresponding preset position A.

The configurations, the operations, and the advantages of the directivity control system and the directivity control method according to some aspects of the present invention will be described.

A first aspect of the present invention provides a directivity control system including: a sound collection unit, configured to collect a sound; a display unit, configured to display a designation screen used to designate a directivity direction oriented from the sound collection unit to a first sound position; a directivity direction calculation unit, configured to calculate a horizontal angle and a vertical angle from the sound collection unit to the first sound position corresponding to the designated directivity direction in accordance with a designation of the directivity direction on the designation screen displayed by the display unit; and a control unit, configured to form directivity of the sound collected by the sound collection unit based on the horizontal angle and the vertical angle calculated by the directivity direction calculation unit.

The directivity control system may be configured so that a horizontal distance and a horizontal angle from the sound collection unit to the first sound position are displayed on the designation screen, and the directivity direction calculation unit calculates the horizontal angle and the vertical angle from the sound collection unit to the first sound position based on a height of the sound collection unit from a horizontal surface, a height of the first sound position from the horizontal surface, and the horizontal distance and the horizontal angle from the sound collection unit to the first sound position displayed on the designation screen.

The directivity control system may be configured so that a first horizontal distance and a second horizontal distance from the sound collection unit to the first sound position are displayed on the designation screen, and the directivity direction calculation unit calculates the horizontal angle and the vertical angle of the directivity direction oriented from the sound collection unit to the first sound position based on a height of the sound collection unit from a horizontal surface, a height of the first sound position from the horizontal surface, and the first horizontal distance and the second horizontal distance from the sound collection unit to the first sound position displayed on the designation screen.

A second aspect of the present invention provides a directivity control system including: a sound collection unit, configured to collect a sound; a display unit, configured to display a setting screen of a directivity direction oriented from the sound collection unit to a prearranged second sound position in one or more sound collection areas or a designation screen of a directivity direction oriented from the sound collection unit to a third arbitrary sound position in the one or more sound collection areas; a directivity direction calculation unit, configured to calculate a horizontal angle and a vertical angle from the sound collection unit to the prearranged second sound position corresponding to the directivity direction as set in accordance with a set value of the directivity direction on the setting screen displayed by the display unit; a storage unit, configured to store the horizontal angle and the vertical angle calculated for each of the prearranged second sound positions in the sound collection areas in association with each of the prearranged second sound positions in the sound collection areas; and a control unit, configured to form directivity of the sound collected by the sound collection unit based on the horizontal angle and the vertical angle calculated by the directivity direction calculation unit, wherein the directivity direction calculation unit calculates the horizontal angle and the vertical angle of the directivity direction oriented to the third arbitrary sound position as designated in accordance with designation of the directivity direction oriented to the third arbitrary sound position of the one more sound collection areas on the designation screen displayed by the display unit, based on the horizontal angle and the vertical angle corresponding to the prearranged second sound position in the sound collection area stored in the storage unit.

A third aspect of the present invention provides a directivity control system including: a sound collection unit, configured to collect a sound; a display unit, configured to display a setting screen of a directivity direction oriented from the sound collection unit to a prearranged second sound position in one or more sound collection areas or a designation screen of a directivity direction oriented from the sound collection unit to a third arbitrary sound position in the one or more sound collection areas; a storage unit, configured to store a set value of the one or more directivity directions on the setting screen displayed by the display unit in association with the prearranged second sound position in the sound collection area; a directivity direction calculation unit, configured to calculate a horizontal angle and a vertical angle up to the prearranged second sound position corresponding to the directivity direction based on the set value of the directivity direction stored in the storage unit; and a control unit, configured to form directivity of the sound collected by the sound collection unit based on the horizontal angle and the vertical angle calculated by the directivity direction calculation unit, wherein the set value of the directivity direction indicates a horizontal distance and a horizontal angle or a first horizontal distance and a second horizontal distance from the sound collection unit to the prearranged second sound position, and the directivity direction calculation unit calculates the horizontal angle and the vertical angle of the directivity direction oriented to the third arbitrary sound position as designated in accordance with designation of the directivity direction oriented to the third arbitrary sound position of the one or more sound collection areas on the designation screen displayed by the display unit, based on the set value of the horizontal angle and the vertical angle corresponding to the prearranged second sound position in the sound collection area stored in the storage unit.

The directivity control system may be configured so that the directivity direction calculation unit calculates the horizontal angle and the vertical angle from the sound collection unit to the prearranged second sound position corresponding to the directivity direction as designated in accordance with designation of the prearranged second sound position corresponding to the directivity direction on the designation screen displayed by the display unit.

The directivity control system may be configured by further including one or more camera apparatuses, configured to image predetermined different sound collection areas, wherein the display unit further displays a selection screen of one or more sound collection areas and a captured video of the camera apparatus including a sound collection area as selected, and the control unit forms directivity of the sound collected by the sound collection unit based on the directivity direction corresponding to the prearranged second sound position stored in the storage unit in accordance with selection of the prearranged second sound position displayed in the captured video of the camera apparatus.

The directivity control system may be configured by further including one or more camera apparatuses, each configured to image one prearranged sound collection area, wherein the display unit further displays a selection screen of the one or more camera apparatuses and a captured video of a camera apparatus as selected including the sound collection area corresponding to the camera apparatus as selected, and the control unit forms directivity of the sound collected by the sound collection unit based on the directivity direction corresponding to the prearranged second sound position stored in the storage unit in accordance with selection of the camera apparatus.

A fourth aspect of the present invention provides a directivity control method in a directivity control system including a sound collection unit that collects a sound, the directivity control method including: displaying a designation screen used to designate a directivity direction oriented from the sound collection unit to a first sound position; calculating a horizontal angle and a vertical angle from the sound collection unit to the first sound position corresponding to the directivity direction as designated in accordance with designation of the directivity direction on the displayed designation screen; and forming directivity of the sound collected by the sound collection unit based on the calculated horizontal angle and the calculated vertical angle.

In the above-described method, the display apparatus 36 displays the directivity direction designation screen used to designate the directivity direction oriented from the omnidirectional microphone array apparatus 2 to the sound position A (first sound position) at which the target is present. The directivity direction calculation unit 34 of the directivity control apparatus 3 calculates the horizontal angle and the vertical angle from the omnidirectional microphone array apparatus 2 to the corresponding sound position A in the designated directivity direction according to the designation of the directivity direction on the directivity direction designation screen displayed by the display apparatus 36. The output control unit 35 of the directivity control apparatus 3 forms the directivity in which the sound of the target is collected based on the calculated horizontal angle and vertical angle.

A fifth aspect of the present invention provides a directivity control method in a directivity control system including a sound collection unit that collects a sound, the directivity control method including: displaying a setting screen of a directivity direction oriented from the sound collection unit to a prearranged second sound position in one or more sound collection areas; calculating a horizontal angle and a vertical angle from the sound collection unit to the prearranged second sound position corresponding to the directivity direction as set in accordance with a set value of the directivity direction on the displayed setting screen; storing the horizontal angle and the vertical angle calculated for each of the prearranged second sound positions in the sound collection areas in association with each of the prearranged second sound positions in the sound collection areas; displaying a designation screen of the directivity direction oriented from the sound collection unit to the third arbitrary sound position on the one or more sound collection areas; calculating the horizontal angle and the vertical angle of the directivity direction oriented to the third arbitrary sound position as designated in accordance with designation of the directivity direction oriented to the third arbitrary sound position of the one more sound collection areas on the displayed designation screen, based on the stored directivity direction of each of the prearranged second sound positions in the sound collection areas; and forming directivity of the sound collected by the sound collection unit based on the calculated horizontal angle and the calculated vertical angle.

A sixth aspect of the present invention provides a directivity control method in a directivity control system including a sound collection unit that collects a sound, the directivity control method including: displaying a setting screen of a directivity direction oriented from the sound collection unit to a prearranged second sound position in one or more sound collection areas; storing a set value of the directivity direction on the displayed setting screen in association with the prearranged second sound position in the sound collection area; calculating a horizontal angle and a vertical angle up to the prearranged second sound position corresponding to the directivity direction based on the stored set value of the directivity direction; displaying a designation screen of the directivity direction oriented from the sound collection unit to the third arbitrary sound position on the one or more sound collection areas; and calculating the horizontal angle and the vertical angle of the directivity direction oriented to the third arbitrary sound position as designated in accordance with designation of the directivity direction oriented to the third arbitrary sound position of the one more sound collection areas on the displayed designation screen, based on the stored set value of the directivity direction of each of the prearranged second sound positions in the sound collection areas, wherein the set value of the directivity direction indicates a horizontal distance and a horizontal angle or a first horizontal distance and a second horizontal distance from the sound collection unit to the prearranged second sound position.

The directivity control system may be configured so that the display unit displays an adjustment interface of a directivity control parameter used to adjust the directivity formed by the control unit on the setting screen or the designation screen, and the control unit forms the directivity of the sound collected by the sound collection unit based on the directivity control parameter as changed in accordance with an input manipulation on the adjustment interface of the directivity control parameter.

The directivity control system may be configured so that the storage unit stores the changed directivity control parameter and the horizontal angle and the vertical angle oriented to the prearranged second sound position, in association with the prearranged second sound position in the sound collection area.

The directivity control system may be configured so that the display unit displays a designation position adjustment interface used to change a first designation position corresponding to the prearranged second sound position on the setting screen to a second designation position corresponding to another sound position on the setting screen, and the control unit forms the directivity of the sound collected by the sound collection unit based on the horizontal angle and the vertical angle oriented to the other sound position corresponding to the second designation position as changed in accordance with an input manipulation on the designation position adjustment interface.

The directivity control system may be configured so that the storage unit stores the horizontal angle and the vertical angle oriented to the other sound position corresponding to the second designation position as changed, in association with the prearranged second sound position in the sound collection area.

The configurations, the operations, and the advantages of the sound collection system and the sound collection control method according to some aspects of the present invention will be described.

A seventh aspect of the present invention provides a sound collection system including: a sound collection unit, configured to collect a sound; a first camera apparatus that has a same reference coordinate system as the sound collection unit; a display unit, configured to display a designation screen used to designate a position corresponding to one or more prearranged fourth sound positions from a captured image of the first camera apparatus; a directivity direction calculation unit, configured to calculate a horizontal angle and a vertical angle from the sound collection unit to the prearranged fourth sound position in accordance with designation of the position corresponding to the prearranged fourth sound position on the designation screen; a storage unit, configured to store the horizontal angle and the vertical angle acquired for each of the prearranged fourth sound positions in association with the prearranged fourth sound position; and a directivity control unit, configured to form directivity of the sound collected by the sound collection unit based on the horizontal angle and the vertical angle stored for each of the prearranged fourth sound positions.

The sound collection system may be configured so that the display unit further displays a selection screen of sound collection areas including the prearranged fourth sound position, the directivity direction calculation unit acquires the horizontal angle and the vertical angle of the directivity direction oriented from the sound collection unit to the prearranged fourth sound position in the selected sound collection area from the storage unit in accordance with selection of one of the sound collection areas on the selection screen, and the directivity control unit forms the directivity of the sound collected by the sound collection unit in the selected sound collection area based on the horizontal angle and vertical angle acquired by the directivity direction calculation unit.

An eighth aspect of the present invention provides a sound collection system including: a sound collection unit, configured to collect a sound; a first camera apparatus that has a same reference coordinate system as the sound collection unit; one or more second camera apparatuses, configured to image predetermined different sound collection areas; a display unit, configured to display a designation screen used to designate a position corresponding to one or more prearranged fifth sound positions from a captured image of the first camera apparatus corresponding to any one selected from the second camera apparatuses; a directivity direction calculation unit, configured to calculate a horizontal angle and a vertical angle from the sound collection unit to the prearranged fifth sound position in accordance with designation of the position corresponding to the prearranged fifth sound position on the designation screen; a storage unit, configured to store the horizontal angle and the vertical angle acquired for each of the prearranged fifth sound positions, in association with the prearranged fifth sound position; and a directivity control unit, configured to form directivity of the sound collected by the sound collection unit based on the horizontal angle and the vertical angle stored for each of the prearranged fifth sound positions.

The sound collection system may be configured so that the storage unit stores the horizontal angle and the vertical angle acquired for each of the prearranged fifth sound positions and an identification number of the selected second camera apparatus, in association with the prearranged fifth sound position.

The sound collection system may be configured so that the display unit displays a selection screen of the sound collection area corresponding to the second camera apparatus and a display screen of a captured image of the second camera apparatus imaging the sound collection area selected on the selection screen, the directivity direction calculation unit acquires the horizontal angle and the vertical angle of a directivity direction corresponding to the identification number of the second camera apparatus imaging the sound collection area from the storage unit as selected in accordance with selection of the sound collection area corresponding to the second camera apparatus, and the directivity control unit forms the directivity of the sound collected by the sound collection unit in the selected sound collection area based on the horizontal angle and the vertical angle acquired by the directivity direction calculation unit.

The sound collection system may be configured so that the first camera apparatus is an omnidirectional camera apparatus.

A ninth aspect of the present invention provides a sound collection control method in a sound collection system including a sound collection unit that collects a sound, the sound collection control method including: displaying a captured image captured by a first camera apparatus having a same reference coordinate system as the sound collection unit; displaying a designation screen used to designate a position corresponding to one or more prearranged fourth sound positions from the captured image of the first camera apparatus; calculating a horizontal angle and a vertical angle from the sound collection unit to the prearranged fourth sound position in accordance with designation of the position corresponding to the prearranged fourth sound position on the designation screen; storing the horizontal angle and the vertical angle acquired for each of the prearranged fourth sound positions in association with the prearranged fourth sound position in a storage unit; and forming directivity of the sound collected by the sound collection unit based on the horizontal angle and the vertical angle stored for each of the prearranged fourth sound positions in the storage unit.

A tenth aspect of the present invention provides a sound collection control method in a sound collection system including a sound collection unit that collects a sound, the sound collection control method including: displaying a captured image captured by a first camera apparatus having a same reference coordinate system as the sound collection unit; receiving a selection of one or more second camera apparatuses that image different predetermined sound collection areas; displaying a designation screen used to designate a position corresponding to one or more prearranged fifth sound positions from a captured image of the first camera apparatus corresponding to a captured image of any one selected from the second camera apparatuses; calculating a horizontal angle and a vertical angle from the sound collection unit to the prearranged fifth sound position in accordance with designation of the position corresponding to the prearranged fifth sound position on the designation screen; storing the horizontal angle and the vertical angle acquired for each of the prearranged fifth sound positions in association with the prearranged fifth sound position in a storage unit; and forming directivity of the sound collected by the sound collection unit based on the horizontal angle and the vertical angle stored for each of the prearranged fifth sound positions in the storage unit.

The various embodiments have been described above with reference to the drawings. Of course, the present invention is not limited to the examples. It should be apparent to those skilled in the art that various modifications and corrections occur within the ranges of the present invention and, of course, the modifications and the corrections are construed to pertain to the technical range of the present invention.

The present invention is useful as a directivity control system and a directivity control method that output a clear sound of a target present in a direction oriented from a microphone array apparatus to a preset position by calculating a directivity direction oriented from the microphone array apparatus to the preset position and forming directivity in the calculated directivity direction.

The present invention is useful as a sound collection system and a directivity control method that output a clear sound of a target present in a direction oriented from a microphone array apparatus to a preset position by calculating a directivity direction oriented from the microphone array apparatus to the preset position and forming directivity in the calculated directivity direction.

The present application is based on and claims the benefits of three Japanese patent applications No. 2013-151012 filed on Jul. 19, 2013, No. 2013-189379 filed on Sep. 12, 2013 and No. 2014-135117 filed on Jun. 30, 2014, the contents of which are incorporated by reference in its entirety.

What is claimed is:

1. A directivity control system comprising:

a sound collector, which in operation, collects a sound;

a display apparatus, which in operation, displays a setting screen of a directivity direction oriented from the sound collector to a prearranged second sound position in one or more sound collection areas or a designation screen of a directivity direction oriented from the sound collector to a third arbitrary sound position in the one or more sound collection areas;

a directivity direction calculation processor, which in operation, calculates a horizontal angle and a vertical angle from the sound collector to the prearranged second sound position corresponding to the directivity direction as set in accordance with a set value of the directivity direction on the setting screen displayed by the display apparatus;

memory, which in operation, stores the horizontal angle and the vertical angle calculated for each of the prearranged second sound positions in the sound collection areas in association with each of the prearranged second sound positions in the sound collection areas; and an output controller, which in operation, forms directivity of the sound collected by the sound collector based on the horizontal angle and the vertical angle calculated by the directivity direction calculation processor, wherein the directivity direction calculation processor calculates the horizontal angle and the vertical angle of the directivity direction oriented to the third arbitrary sound position as designated in accordance with designation of the directivity direction oriented to the third arbitrary sound position of the one more sound collection areas on the designation screen displayed by the display apparatus, based on the horizontal angle and the vertical angle corresponding to the prearranged second sound position in the sound collection area stored in the memory.

2. The directivity control system according to claim 1, wherein the directivity direction calculation processor calculates the horizontal angle and the vertical angle from the sound collector to the prearranged second sound position corresponding to the directivity direction as designated in accordance with designation of the prearranged second sound position corresponding to the directivity direction on the designation screen displayed by the display apparatus.

3. The directivity control system according to claim 1, further comprising:

one or more camera apparatuses, configured to image predetermined different sound collection areas, wherein the display apparatus further displays a selection screen of one or more sound collection areas and a captured video of the camera apparatus including a sound collection area as selected, and the output controller forms directivity of the sound collected by the sound collector based on the directivity direction corresponding to the prearranged second sound position stored in the memory in accordance with selection of the prearranged second sound position displayed in the captured video of the camera apparatus.

4. The directivity control system according to claim 1, further comprising:

one or more camera apparatuses, each configured to image one prearranged sound collection area, wherein the display apparatus, which in operation, further displays a selection screen of the one or more camera apparatuses and a captured video of a camera apparatus as selected including the sound collection area corresponding to the camera apparatus as selected, and the output controller forms directivity of the sound collected by the sound collection unit based on the directivity direction corresponding to the prearranged second sound position stored in the memory in accordance with selection of the camera apparatus.

5. The directivity control system according to claim 1, wherein the display apparatus displays an adjustment interface of a directivity control parameter used to adjust the directivity formed by the output controller on the setting screen or the designation screen, and the output controller forms the directivity of the sound collected by the sound collector based on the directivity control parameter as changed in accordance with an input manipulation on the adjustment interface of the directivity control parameter.

6. The directivity control system according to claim 5, wherein the memory stores the changed directivity control parameter and the horizontal angle and the vertical angle oriented to the prearranged second sound position, in association with the prearranged second sound position in the sound collection area.

7. The directivity control system according to claim 1, wherein the display apparatus displays a designation position adjustment interface used to change a first designation position corresponding to the prearranged second sound position on the setting screen to a second designation position corresponding to another sound position on the setting screen, and the output controller forms the directivity of the sound collected by the sound collector based on the horizontal angle and the vertical angle oriented to the other sound position corresponding to the second designation position as changed in accordance with an input manipulation on the designation position adjustment interface.

8. The directivity control system according to claim 7, wherein the memory stores the horizontal angle and the vertical angle oriented to the other sound position corresponding to the second designation position as changed, in association with the prearranged second sound position in the sound collection area.

9. A directivity control system comprising:

a sound collector, which in operation, collects sound;

a display apparatus, which in operation, displays a setting screen of a directivity direction oriented from the sound collector to a rearranged second sound position in one or more sound collection areas or a designation screen of a directivity direction oriented from the sound collector to a third arbitrary sound position in the one or more sound collection areas;

memory, which in operation, stores a set value of the one or more directivity directions on the setting screen displayed by the display apparatus in association with the prearranged second sound position in the sound collection area;

a directivity direction calculation processor, which in operation, calculates a horizontal angle and a vertical angle up to the prearranged second sound position corresponding to the directivity direction based on the set value of the directivity direction stored in the memory; and an output controller, which in operation, forms directivity of the sound collected by the sound collector based on the horizontal angle and the vertical angle calculated by the directivity direction calculation processor, wherein the set value of the directivity direction indicates a horizontal distance and a horizontal angle or a first horizontal distance and a second horizontal distance from the sound collector to the prearranged second sound position, and the directivity direction calculation processor calculates the horizontal angle and the vertical angle of the directivity direction oriented to the third arbitrary sound position as designated in accordance with designation of the directivity direction oriented to the third arbitrary sound position of the one or more sound collection areas on the designation screen displayed by the display apparatus, based on the set value of the horizontal angle and the vertical angle corresponding to the prearranged second sound position in the sound collection area stored in the memory.

10. A directivity control method in a directivity control system including a sound collector that collects a sound, the directivity control method comprising:

displaying a setting screen of a directivity direction oriented from the sound collector to a prearranged second sound position in one or more sound collection areas;

calculating a horizontal angle and a vertical angle from the sound collector to the prearranged second sound position corresponding to the directivity direction as set in accordance with a set value of the directivity direction on the displayed setting screen;

storing the horizontal angle and the vertical angle calculated for each of the prearranged second sound positions in the sound collection areas in association with each of the prearranged second sound positions in the sound collection areas;

displaying a designation screen of the directivity direction oriented from the sound collection unit to the third arbitrary sound position on the one or more sound collection areas;

calculating the horizontal angle and the vertical angle of the directivity direction oriented to the third arbitrary sound position as designated in accordance with designation of the directivity direction oriented to the third arbitrary sound position of the one more sound collection areas on the displayed designation screen, based on the stored directivity direction of each of the prearranged second sound positions in the sound collection areas; and forming directivity of the sound collected by the sound collection unit based on the calculated horizontal angle and the calculated vertical angle.

11. A directivity control method in a directivity control system including a sound collector that collects a sound, the directivity control method comprising:

displaying a setting screen of a directivity direction oriented from the sound collector to a prearranged second sound position in one or more sound collection areas;

storing a set value of the directivity direction on the displayed setting screen in association with the prearranged second sound position in the sound collection area;

calculating a horizontal angle and a vertical angle up to the prearranged second sound position corresponding to the directivity direction based on the stored set value of the directivity direction;

displaying a designation screen of the directivity direction oriented from the sound collection unit to the third arbitrary sound position on the one or more sound collection areas; and calculating the horizontal angle and the vertical angle of the directivity direction oriented to the third arbitrary sound position as designated in accordance with designation of the directivity direction oriented to the third arbitrary sound position of the one more sound collection areas on the displayed designation screen, based on the stored set value of the directivity direction of each of the prearranged second sound positions in the sound collection areas, wherein the set value of the directivity direction indicates a horizontal distance and a horizontal angle or a first horizontal distance and a second horizontal distance from the sound collector unit to the prearranged second sound position.

12. A sound collection system comprising:

a sound collector, which in operation, collects a sound;

a first camera apparatus that has a reference coordinate system that is the same as a reference coordinate system of the sound collector;

a display apparatus, configured to display a designation screen used to designate a position corresponding to one or more prearranged fourth sound positions from a captured image of the first camera apparatus and configured to display a selection screen of sound collection areas including a sound collection area that includes a position corresponding to a prearranged fourth sound position;

a directivity direction calculation processor, which in operation, calculates a horizontal angle and a vertical angle from the sound collector to the prearranged fourth sound position in accordance with designation of the position corresponding to the prearranged fourth sound position on the designation screen, the directivity direction calculation processor configured to acquire the horizontal angle and the vertical angle of the directivity direction oriented from the sound collector to the prearranged fourth sound position in a selected sound collection area from memory in accordance with selection of one of the sound collection areas on the selection screen;

memory, which in operation, stores the horizontal angle and the vertical angle acquired for each of the prearranged fourth sound positions; and an output controller, which in operation, forms directivity of the sound collected by the sound collector in the selected sound collection area based on the horizontal angle and the vertical angle stored for each of the prearranged fourth sound positions and acquired by the directivity direction calculation processor.

13. A sound collection system comprising:

a sound collector, which in operation, collects a sound;

a first omnidirectional camera apparatus that has a reference coordinate system that is the same as a reference coordinate system of the sound collector;

a display apparatus, which in operation, displays a designation screen used to designate a position corresponding to one or more prearranged fourth sound positions from a captured image of the first omnidirectional camera apparatus;

a directivity direction calculation processor, which in operation, calculates a horizontal angle and a vertical angle from the sound collector to the prearranged fourth sound position in accordance with designation of the position corresponding to the prearranged fourth sound position on the designation screen;

memory, which in operation, stores the horizontal angle and the vertical angle acquired for each of the prearranged fourth sound positions; and an output controller, configured to form directivity of the sound collected by the sound collector based on the horizontal angle and the vertical angle stored for each of the prearranged fourth sound positions.

* * * * *